US010170055B2

(12) United States Patent
Kimura et al.

(10) Patent No.: US 10,170,055 B2
(45) Date of Patent: Jan. 1, 2019

(54) DISPLAY DEVICE AND DRIVING METHOD THEREOF

(71) Applicant: Semiconductor Energy Laboratory Co., Ltd., Kanagawa-ken (JP)

(72) Inventors: Hajime Kimura, Kanagawa (JP); Hiroyuki Miyake, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 463 days.

(21) Appl. No.: 14/862,531

(22) Filed: Sep. 23, 2015

(65) Prior Publication Data

US 2016/0093263 A1 Mar. 31, 2016

(30) Foreign Application Priority Data

Sep. 26, 2014 (JP) ..... 2014-196518

(51) Int. Cl.
*G09G 3/36* (2006.01)
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0842* (2013.01); (Continued)

(58) Field of Classification Search
CPC .... G09G 3/00; G09G 2310/08; G09G 3/3688; G09G 2320/0233; G09G 2320/0252; G09G 3/36
See application file for complete search history.

(56) References Cited

U.S. PATENT DOCUMENTS 5,731,856 A 3/1998 Kim et al.
5,744,864 A 4/1998 Cillessen et al.
(Continued)

FOREIGN PATENT DOCUMENTS

EP 1737044 A 12/2006
EP 2226847 A 9/2010
(Continued)

OTHER PUBLICATIONS

Asakuma.N et al., "Crystallization and Reduction of SOL-GEL-Derived Zinc Oxide Films by Irradiation With Ultraviolet Lamp", Journal of SOL-GEL Science and Technology, 2003, vol. 26, pp. 181-184.
(Continued)

*Primary Examiner* — Carolyn R Edwards
(74) *Attorney, Agent, or Firm* — Husch Blackwell LLP

(57) ABSTRACT

To provide a display device which can perform external correction in parallel with display operation. The display device includes a plurality of pixels arranged in a matrix and a plurality of reading circuits provided outside the pixels. Each of the pixels includes a light-emitting element and a transistor which supplies current to the light-emitting element. In the display device, in a blanking period of the display device, a row in which all the pixels are displayed in black is selected so that a reading signal is input thereto; data on current characteristics of the transistors included in the pixels in the selected row is read out, and at the same time, display is performed in pixels in rows other than the selected row; and a signal for black display is input in the selected row so that the pixels in the row are displayed in black.

16 Claims, 36 Drawing Sheets

(52) U.S. Cl.
CPC ..... *G09G 2310/0297* (2013.01); *G09G 2320/029* (2013.01); *G09G 2320/0233* (2013.01); *G09G 2320/0238* (2013.01); *G09G 2320/045* (2013.01)

(56) References Cited

U.S. PATENT DOCUMENTS 6,294,274 B1 9/2001 Kawazoe et al.
6,563,174 B2 5/2003 Kawasaki et al.
6,727,522 B1 4/2004 Kawasaki et al.
7,049,190 B2 5/2006 Takeda et al.
7,061,014 B2 6/2006 Hosono et al.
7,064,346 B2 6/2006 Kawasaki et al.
7,088,052 B2 8/2006 Kimura
7,105,868 B2 9/2006 Nause et al.
7,211,825 B2 5/2007 Shih et al.
7,282,782 B2 10/2007 Hoffman et al.
7,297,977 B2 11/2007 Hoffman et al.
7,323,356 B2 1/2008 Hosono et al.
7,385,224 B2 6/2008 Ishii et al.
7,402,506 B2 7/2008 Levy et al.
7,411,209 B2 8/2008 Endo et al.
7,429,985 B2 9/2008 Kimura et al.
7,453,065 B2 11/2008 Saito et al.
7,453,087 B2 11/2008 Iwasaki
7,462,862 B2 12/2008 Hoffman et al.
7,468,304 B2 12/2008 Kaji et al.
7,501,293 B2 3/2009 Ito et al.
7,674,650 B2 3/2010 Akimoto et al.
7,732,819 B2 6/2010 Akimoto et al.
2001/0024186 A1 9/2001 Kane et al.
2001/0046027 A1 11/2001 Tai et al.
2002/1005683 5/2002 Ogawak
2002/0132454 A1 9/2002 Ohtsu et al.
2003/0016190 A1 1/2003 Kondo
2003/0057895 A1* 3/2003 Kimura ..... G09G 3/3233 315/370
2003/0132931 A1* 7/2003 Kimura ..... G09G 3/2022 345/212
2003/0189401 A1 10/2003 Kido et al.
2003/0218222 A1 11/2003 Wager, III et al.
2004/0038446 A1 2/2004 Takeda et al.
2004/0127038 A1 7/2004 Carcia et al.
2005/0017302 A1 1/2005 Hoffman
2005/0199959 A1 9/2005 Chiang et al.
2006/0035452 A1 2/2006 Carcia et al.
2006/0043377 A1 3/2006 Hoffman et al.
2006/0091793 A1 5/2006 Baude et al.
2006/0108529 A1 5/2006 Saito et al.
2006/0108636 A1 5/2006 Sano et al.
2006/0110867 A1 5/2006 Yabuta et al.
2006/0113536 A1 6/2006 Kumomi et al.
2006/0113539 A1 6/2006 Sano et al.
2006/0113549 A1 6/2006 Den et al.
2006/0113565 A1 6/2006 Abe et al.
2006/0169973 A1 8/2006 Isa et al.
2006/0170111 A1 8/2006 Isa et al.
2006/0197092 A1 9/2006 Hoffman et al.
2006/0208977 A1 9/2006 Kimura
2006/0228974 A1 10/2006 Thelss et al.
2006/0231882 A1 10/2006 Kim et al.
2006/0238135 A1 10/2006 Kimura
2006/0244107 A1 11/2006 Sugihara et al.
2006/0284171 A1 12/2006 Levy et al.
2006/0284172 A1 12/2006 Ishii
2006/0292777 A1 12/2006 Dunbar
2007/0024187 A1 2/2007 Shin et al.
2007/0046191 A1 3/2007 Saito
2007/0052025 A1 3/2007 Yabuta
2007/0054507 A1 3/2007 Kaji et al.
2007/0090365 A1 4/2007 Hayashi et al.
2007/0108446 A1 5/2007 Akimoto
2007/0152217 A1 7/2007 Lai et al.
2007/0172591 A1 7/2007 Seo et al.
2007/0187678 A1 8/2007 Hirao et al.
2007/0187760 A1 8/2007 Furuta et al.
2007/0194379 A1 8/2007 Hosono et al.
2007/0252928 A1 11/2007 Ito et al.
2007/0268210 A1 11/2007 Uchino et al.
2007/0272922 A1 11/2007 Kim et al.
2007/0287296 A1 12/2007 Chang
2008/0006877 A1 1/2008 Mardilovich et al.
2008/0038882 A1 2/2008 Takechi et al.
2008/0038929 A1 2/2008 Chang
2008/0050595 A1 2/2008 Nakagawara et al.
2008/0073653 A1 3/2008 Iwasaki
2008/0083950 A1 4/2008 Pan et al.
2008/0088648 A1* 4/2008 Nathan ..... G09G 3/3233 345/690
2008/0106191 A1 5/2008 Kawase
2008/0128689 A1 6/2008 Lee et al.
2008/0129195 A1 6/2008 Ishizaki et al.
2008/0166834 A1 7/2008 Kim et al.
2008/0182358 A1 7/2008 Cowdery-Corvan et al.
2008/0224133 A1 9/2008 Park et al.
2008/0238833 A1 10/2008 Hioki et al.
2008/0254569 A1 10/2008 Hoffman et al.
2008/0258139 A1 10/2008 Ito et al.
2008/0258140 A1 10/2008 Lee et al.
2008/0258141 A1 10/2008 Park et al.
2008/0258143 A1 10/2008 Kim et al.
2008/0296568 A1 12/2008 Ryu et al.
2009/0068773 A1 3/2009 Lai et al.
2009/0073325 A1 3/2009 Kuwabara et al.
2009/0114910 A1 5/2009 Chang
2009/0134399 A1 5/2009 Sakakura et al.
2009/0152506 A1 6/2009 Umeda et al.
2009/0152541 A1 6/2009 Maekawa et al.
2009/0244049 A1 10/2009 Yamamoto et al.
2009/0278122 A1 11/2009 Hosono et al.
2009/0280600 A1 11/2009 Hosono et al.
2010/0065844 A1 3/2010 Tokunaga
2010/0092800 A1 4/2010 Itagaki et al.
2010/0109002 A1 5/2010 Itagaki et al.
2016/0155370 A1* 6/2016 Kimura ..... G09G 3/3258 345/213

FOREIGN PATENT DOCUMENTS

JP 60-198861 A 10/1985
JP 63-210022 A 8/1988
JP 63-210023 A 8/1988
JP 63-210024 A 8/1988
JP 63-215519 A 9/1988
JP 63-239117 A 10/1988
JP 63-265818 A 11/1988
JP 05-251705 A 9/1993
JP 08-264794 A 10/1996
JP 11-505377 5/1999
JP 2000-044236 A 2/2000
JP 2000-150900 A 5/2000
JP 2002-076356 A 3/2002
JP 2002-289859 A 10/2002
JP 2003-086000 A 3/2003
JP 2003-086808 A 3/2003
JP 2003-195813 7/2003
JP 2004-103957 A 4/2004
JP 2004-273614 A 9/2004
JP 2004-273732 A 9/2004
JP 2008-233933 10/2008
JP 2009-53382 3/2009
WO WO-2004/114391 12/2004

OTHER PUBLICATIONS

Asaoka.Y et al., "29.1:Polarizer-Free Reflective LCD Combined With Ultra Low-Power Driving Technology", SID Digest '09 : SID International Symposium Digest of Technical Papers, May 31, 2009, pp. 395-398.

(56) References Cited

OTHER PUBLICATIONS

Chern.H et al., "An Analytical Model for the Above-Threshold Characteristics of Polycilicon Thin-Film Transistors", IEEE Transactions on Electron Devices, Jul. 1, 1995, vol. 42, No. 7, pp. 1240-1246.
Cho.D et al., "21.2:Al and Sn-Doped Zinc Indium Oxide Thin Film Transistors for AMOLED Back-Plane", SID Digest '09 : SID International Symposium Digest of Technical Papers, May 31, 2009, pp. 280-283.
Clark.S et al., "First Principles Methods Using CASTEP", Zeitschrift fur Kristallographie, 2005, vol. 220, pp. 567-570.
Coates.D et al., "Optical Studies of the Amorphous Liquid-Cholesteric Liquid Crystal Transition:The "Blue Phase"", Physics Letters, Sep. 10, 1973, vol. 45A, No. 2, pp. 115-116.
Costello.M et al., "Electron Microscopy of a Cholesteric Liquid Crystal and Its Blue Phase", Phys. Rev. A (Physical Review. A), May 1, 1984, vol. 29, No. 5, pp. 2957-2959.
Dembo.H et al., "RFCPUS on Glass and Plastic Substrates Fabricated by TFT Transfer Technology", IEDM 05: Technical Digest of International Electron Devices Meeting, Dec. 5, 2005, pp. 1067-1069.
Fortunato.E et al., "Wide-Bandgap High-Mobility ZnO Thin-Film Transistors Produced at Room Temperature", Appl. Phys. Lett. (Applied Physics Letters) , Sep. 27, 2004, vol. 85, No. 13, pp. 2541-2543.
Fung.T et al., "2-D Numerical Simulation of High Performance Amorphous In—Ga—Zn—O TFTs for Flat Panel Displays", AM-FPD '08 Digest of Technical Papers, Jul. 2, 2008, pp. 251-252, The Japan Society of Applied Physics.
Godo.H et al., "P-9:Numerical Analysis on Temperature Dependence of Characteristics of Amorphous In—Ga—Zn-Oxide TFT", SID Digest '09 : SID International Symposium Digest of Technical Papers, May 31, 2009, pp. 1110-1112.
Godo.H et al., "Temperature Dependence of Characteristics and Electronic Structure for Amorphous In—Ga—Zn-Oxide TFT", AM-FPD '09 Digest of Technical Papers, Jul. 1, 2009, pp. 41-44.
Hayashi.R et al., "42.1: Invited Paper: Improved Amorphous In—Ga—Zn—O TFTs", SID Digest '08 : SID International Symposium Digest of Technical Papers, May 20, 2008, vol. 39, pp. 621-624.
Hirao.T et al., "Novel Top-Gate Zinc Oxide Thin-Film Transistors (ZnO TFTs) for AMLCDS", J. Soc. Inf. Display (Journal of the Society for Information Display), 2007, vol. 15, No. 1, pp. 17-22.
Hosono.H et al., "Working hypothesis to explore novel wide band gap electrically conducting amorphous oxides and examples", J. Non-Cryst. Solids (Journal of Non-Crystalline Solids), 1996, vol. 198-200, pp. 165-169.
Hosono.H, "68.3:Invited Paper:Transparent Amorphous Oxide Semiconductors for High Performance TFT", SID Digest '07 : SID International Symposium Digest of Technical Papers, 2007, vol. 38, pp. 1830-1833.
Hsieh.H et al., "P-29:Modeling of Amorphous Oxide Semiconductor Thin Film Transistors and Subgap Density of States", SID Digest '08 : SID International Symposium Digest of Technical Papers, May 20, 2008, vol. 39, pp. 1277-1280.
Ikeda.T et al., "Full-Functional System Liquid Crystal Display Using Cg-Silicon Technology", SID Digest '04 : SID International Symposium Digest of Technical Papers, 2004, vol. 35, pp. 860-863.
Janotti.A et al., "Native Point Defects in ZnO", Phys. Rev. B (Physical Review. B), Oct. 4, 2007, vol. 76, No. 16, pp. 165202-1-165202-22.
Janotti.A et al., "Oxygen Vacancies in ZnO", Appl. Phys. Lett. (Applied Physics Letters) , 2005, vol. 87, pp. 122102-1-122102-3.
Jeong.J et al., "3.1: Distinguished Paper: 12.1-Inch WXGA AMOLED Display Driven by Indium-Gallium-Zinc Oxide TFTs Array", SID Digest '08 : SID International Symposium Digest of Technical Papers, May 20, 2008, vol. 39, No. 1, pp. 1-4.
Jin.D et al., "65.2:Distinguished Paper:World-Largest (6.5") Flexible Full Color Top Emission AMOLED Display on Plastic Film and its Bending Properties", SID Digest '09 : SID International Symposium Digest of Technical Papers, May 31, 2009, pp. 983-985.
Kanno.H et al "White Stacked Electrophosphorecent Organic Light-Emitting Devices Employing MoO3 as a Charge-Generation Layer", Adv. Mater. (Advanced Materials), 2006, vol. 18, No. 3, pp. 339-342.
Kikuchi.H et al., "39.1:Invited Paper:Optically Isotropic Nano-Structured Liquid Crystal Composites for Display Applications", SID Digest '09 : SID International Symposium Digest of Technical Papers, May 31, 2009, pp. 578-581.
Kikuchi.H et al., "62.2:Invited Paper:Fast Electro-Optical Switching in Polymer-Stabilized Liquid Crystalline Blue Phases for Display Application", SID Digest '07 : SID International Symposium Digest of Technical Papers, 2007, vol. 38, pp. 1737-1740.
Kikuchi.H et al., "Polymer-Stabilized Liquid Crystal Blue Phases", Nature Materials, Sep. 2, 2002, vol. 1, pp. 64-68.
Kim.S et al., "High-Performance oxide thin film transistors passivated by various gas plasmas", 214th ECS Meeting, 2008, No. 2317, ECS.
Kimizuka.N et al., "Spinel,YbFe2O4, and Yb2Fe3O7 Types of Structures for Compounds in the In2O3 and Sc2O3—A2O3—Bo Systems [A; Fe, Ga, or Al; B: Mg, Mn, Fe, Nl, Cu,or Zn]at Temperatures over 1000° C.", Journal of Solid State Chemistry, 1985, vol. 60, pp. 382-384.
Kimizuka.N et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3—ZnGa2O4—ZnO System", Journal of Solid State Chemistry, Apr. 1, 1995, vol. 116, No. 1, pp. 170-178.
Kitzerow.H et al., "Observation of Blue Phases in Chiral Networks", Liquid Crystals, 1993, vol. 14, No. 3, pp. 911-916.
Kurokawa.Y et al., "UHF RFCPUS on Flexible and Glass Substrates for Secure RFID Systems", Journal of Solid-State Circuits, 2008, vol. 43, No. 1, pp. 292-299.
Lany.S et al., "Dopability, Intrinsic Conductivity, and Nonstoichiometry of Transparent Conducting Oxides", Phys. Rev. Lett. (Physical Review Letters), Jan. 26, 2007, vol. 98, pp. 045501-1-045501-4.
Lee.H et al., "Current Status of, Challenges to, and Perspective View of AM-OLED", IDW '06 : Proceedings of the 13th International Display Workshops, Dec. 7, 2006, pp. 663-666.
Lee.J et al., "World's Largest (15-Inch) XGA AMLCD Panel Using IGZO Oxide TFT", SID Digest '08 : SID International Symposium Digest of Technical Papers, May 20, 2008, vol. 39, pp. 625-628.
Lee.M et al., "15.4:Excellent Performance of Indium-Oxide-Based Thin-Film Transistors by DC Sputtering", SID Digest '09 : SID International Symposium Digest of Technical Papers, May 31, 2009, pp. 191-193.
Li.C et al., "Modulated Structures of Homologous Compounds InMO3(ZnO)m (M=In,Ga; m=Integer) Described by Four-Dimensional Superspace Group", Journal of Solid State Chemistry, 1998, vol. 139, pp. 347-355.
Masuda.S et al., "Transparent thin film transistors using ZnO as an active channel layer and their electrical properties", J. Appl. Phys. (Journal of Applied Physics), Feb. 1, 2003, vol. 93, No. 3, pp. 1624-1630.
Meiboom.S et al., "Theory of the Blue Phase of Cholesteric Liquid Crystals", Phys. Rev. Lett. (Physical Review Letters), May 4, 1981, vol. 46, No. 18, pp. 1216-1219.
Miyasaka.M, "SUFTLA Flexible Microelectronics on Their Way to Business", SID Digest '07 : SID International Symposium Digest of Technical Papers, 2007, vol. 38, pp. 1673-1676.
Mo.Y et al., "Amorphous Oxide TFT Backplanes for Large Size AMOLED Displays", IDW '08 : Proceedings of the 6th International Display Workshops, Dec. 3, 2008, pp. 581-584.
Nakamura.M et al., "The phase relations in the In2O3—Ga2ZnO4—ZnO system at 1350° C.", Journal of Solid State Chemistry, Aug. 1, 1991, vol. 93, No. 2, pp. 298-315.
Nakamura.M, "Synthesis of Homologous Compound with New Long-Period Structure", NIRIM Newsletter, Mar. 1, 1995, vol. 150, pp. 1-4.
Nomura.K et al., "Amorphous Oxide Semiconductors for High-Performance Flexible Thin-Film Transistors", Jpn. J. Appl. Phys. (Japanese Journal of Applied Physics) , 2006, vol. 45, No. 5B, pp. 4303-4308.

(56) References Cited

OTHER PUBLICATIONS

Nomura.K et al., "Carrier transport in transparent oxide semiconductor with intrinsic structural randomness probed using single-crystalline InGaO3(ZnO)5 films", Appl. Phys. Lett. (Applied Physics Letters) , Sep. 13, 2004, vol. 85, No. 11, pp. 1993-1995.
Nomura.K et al., "Room-Temperature Fabrication of Transparent Flexible Thin-Film Transistors Using Amorphous Oxide Semiconductors", Nature, Nov. 25, 2004, vol. 432, pp. 488-492.
Nomura.K et al., "Thin-Film Transistor Fabricated in Single-Crystalline Transparent Oxide Semiconductor", Science, May 23, 2003, vol. 300, No. 5623, pp. 1269-1272.
Nowatari.H et al., "60.2: Intermediate Connector With Suppressed Voltage Loss for White Tandem OLEDS", SID Digest '09 : SID International Symposium Digest of Technical Papers, May 31, 2009, vol. 40, pp. 899-902.
Oba.F et al., "Defect energetics in ZnO: A hybrid Hartree-Fock density functional study", Phys. Rev. B (Physical Review. B), 2008, vol. 77, pp. 245202-1-245202-6.
Oh.M et al., "Improving the Gate Stability of ZnO Thin-Film Transistors With Aluminum Oxide Dielectric Layers", J. Electrochem. Soc. (Journal of the Electrochemical Society), 2008, vol. 155, No. 12, pp. H1009-H1014.
Ohara.H et al., "21.3:4.0 In. QVGA AMOLED Display Using In—Ga—Zn-Oxide TFTs With a Novel Passication Layer", SID Digest '09 : SID International Symposium Digest of Technical Papers, May 31, 2009, pp. 284-287.
Ohara.H et al., "Amorphous In—Ga—Zn-Oxide TFTs with Suppressed Variation for 4.0 inch QVGA AMOLED Display", AM-FPD '09 Digest of Technical Papers, Jul. 1, 2009, pp. 227-230, The Japan Society of Applied Physics.
Orita.M et al., "Amorphous transparent conductive oxide InGaO3(ZnO)m (m<4):a Zn4s conductor", Philosophical Magazine, 2001, vol. 81, No. 5, pp. 501-515.
Orita.M et al., "Mechanism of Electrical Conductivity of Transparent InGaZnO4", Phys. Rev. B (Physical Review. B), Jan. 15, 2000, vol. 61, No. 3, pp. 1811-1816.
Osada.T et al., "15.2: Development of Driver-Integrated Panel using Amorphous In—Ga—Zn-Oxide TFT", SID Digest '09 : SID International Symposium Digest of Technical Papers, May 31, 2009, pp. 184-187.
Osada.T et al., "Development of Driver-Integrated Panel Using Amorphous In—Ga—Zn-Oxide TFT", AM-FPD '09 Digest of Technical Papers, Jul. 1, 2009, pp. 33-36.
Park.J et al., "Amorphous Indium-Gallium-Zinc Oxide TFTs and Their Application for Large Size AMOLED", AM-FPD '08 Digest of Technical Papers, Jul. 2, 2008, pp. 275-278.
Park.J et al., "Dry etching of ZnO films and plasma-induced damage to optical properties", J. Vac. Sci. Technol. B (Journal of Vacuum Science & Technology B), Mar. 1, 2003, vol. 21, No. 2, pp. 800-803.
Park.J et al., "Electronic Transport Properties of Amorphous Indium-Gallium-Zinc Oxide Semiconductor Upon Exposure to Water", Appl. Phys. Lett. (Applied Physics Letters) , 2008, vol. 92, pp. 072104-1-072104-3.
Park.J et al., "High performance amorphous oxide thin film transistors with self-aligned top-gate structure", IEDM 09: Technical Digest of International Electron Devices Meeting, Dec. 7, 2009, pp. 191-194.
Park.J et al., "Improvements in the Device Characteristics of Amorphous Indium Gallium Zinc-Oxide Thin-Film Transistors by Ar Plasma Treatment", Appl. Phys. Lett. (Applied Physics Letters) , Jun. 26, 2007, vol. 90, No. 26, pp. 262106-1-262106-3.
Park.S et al., "Challenge to Future Displays: Transparent AM-OLED Driven by PEALD Grown ZnO TFT", IMID '07 Digest, 2007, pp. 1249-1252.
Park.Sang-Hee et al., "42.3: Transparent ZnO Thin Film Transistor for the Application of High Aperture Ratio Bottom Emission AM-OLED Display", SID Digest '08 : SID International Symposium Digest of Technical Papers, May 20, 2008, vol. 39, pp. 629-632.
Prins.M et al., "A Ferroelectric Transparent Thin-Film Transistor", Appl. Phys. Lett. (Applied Physics Letters) , Jun. 17, 1996, vol. 68, No. 25, pp. 3650-3652.
Sakata.J et al., "Development of 4.0-In. AMOLED Display With Driver Circuit Using Amorphous In—Ga—Zn-Oxide TFTs", IDW '09 : Proceedings of the 16th International Display Workshops, 2009, pp. 689-692.
Son.K et al., "42.4L: Late-News Paper: 4 Inch QVGA AMOLED Driven by the Threshold Voltage Controlled Amorphous GIZO (Ga2O3—In2O3—ZnO) TFT", SID Digest '08 : SID International Symposium Digest of Technical Papers, May 20, 2008, vol. 39, pp. 633-636.
Takahashi.M et al., "Theoretical Analysis of IGZO Transparent Amorphous Oxide Semiconductor", IDW '08 : Proceedings of the 15th International Display Workshops, Dec. 3, 2008, pp. 1637-1640.
Tsuda.K et al., "Ultra Low Power Consumption Technologies for Mobile TFT-LCDs ", IDW '02 : Proceedings of the 9th International Display Workshops, Dec. 4, 2002, pp. 295-298.
Ueno.K et al., "Field-Effect Transistor on SrTiO3 With Sputtered Al2O3 Gate Insulator", Appl. Phys. Lett. (Applied Physics Letters) , Sep. 1, 2003, vol. 83, No. 9, pp. 1755-1757.
Van de Walle.C, "Hydrogen as a Cause of Doping in Zinc Oxide", Phys. Rev. Lett. (Physical Review Letters), Jul. 31, 2000, vol. 85, No. 5, pp. 1012-1015.
Joon-Sun Y et al., "55-inch OLED TV using Optimal Driving Method for Large-Size Panel based on InGaZnO TFTs," SID Digest '14 : SID International Symposium Digest of Technical Papers, 2014, pp. 849-852.

* cited by examiner

100C

100C

100C

100D

100D

100D

100E

100E

100E

100G

100G

100G

DISPLAY DEVICE AND DRIVING METHOD THEREOF

BACKGROUND OF THE INVENTION

1. Field of the Invention

One embodiment of the present invention relates to a display device and a driving method of the display device.

Note that one embodiment of the present invention is not limited to the above technical field. The technical field of the invention disclosed in this specification and the like relates to an object, a method, or a manufacturing method. In addition, one embodiment of the present invention relates to a process, a machine, manufacture, or a composition of matter. Specific examples of the technical field of one embodiment of the present invention disclosed in this specification include a semiconductor device, a display device, a light-emitting device, a power storage device, an imaging device, a memory device, a method for driving any of them, and a method for manufacturing any of them.

2. Description of the Related Art

In recent years, display devices have been used for various electronic devices such as television receivers, personal computers, and smart phones, and higher performance of the display devices in various aspects such as higher definition and lower power consumption has been achieved.

As such display devices, active matrix display devices in each of which a plurality of pixels is arranged in a matrix and is controlled by transistors provided in the pixels have been often used. In the active matrix display device, each pixel is controlled by a transistor, so that variation in transistor characteristics among pixels or deterioration in transistor characteristics causes variation in display among the pixels. Thus, display unevenness and image burn-in may be caused.

In an active matrix display device in which a light-emitting element is used as a display element, a driving transistor which controls current to be supplied to the light-emitting element in accordance with a video signal is provided. If at least one of the threshold voltage, the mobility, the channel length, the channel width, and the like of the driving transistor varies among pixels, luminance of a light-emitting element varies among the pixels.

As a method for preventing such variation in luminance of light-emitting elements, a method for correcting variation in the threshold voltages of driving transistors in pixels (hereinafter referred to as internal correction) has been suggested (Patent Document 1).

Furthermore, a method has been suggested in which the threshold voltage of a driving transistor is read out to the outside of a pixel and a signal for correcting variation in the threshold voltage is input (hereinafter also referred to as external correction) (Patent Document 2).

PATENT DOCUMENT

[Patent Document 1] Japanese Published Patent Application No. 2008-233933

[Patent Document 2] Japanese Published Patent Application No. 2003-195813

SUMMARY OF THE INVENTION

In the case of performing external correction, there is a case where current flowing through a transistor is output to the outside of a pixel. Alternatively, there is a case where a potential of a terminal of a transistor is output to the outside of a pixel. Accordingly, when the external correction is performed while display operation is performed, current supplied to a light-emitting element often changes. Thus, when the external correction is performed while the display operation is performed, display changes unintentionally. For this reason, it is difficult to perform the external correction in parallel with the display operation of a display device. Furthermore, in the case where the external correction is performed in a period where the display operation of the display device is not performed, there has been a problem in that a period for the correction is increased because the correcting operation needs to be performed for a considerable number of pixels.

An object of one embodiment of the present is to provide a novel display device, a novel semiconductor device, a driving method of the novel display device, a driving method of the novel semiconductor device, or the like.

An object of one embodiment of the present invention is to provide a display device or the like which can perform external correction in parallel with display operation. An object of one embodiment of the present invention is to provide a driving method of the display device or the like which can perform external correction in parallel with display operation. An object of one embodiment of the present invention is to provide a display device in which display unevenness is suppressed, and a driving method thereof. An object of one embodiment of the present invention is to provide a display device capable of high definition display, and a driving method thereof. An object of one embodiment of the present invention is to provide a semiconductor device which can reduce adverse effects due to variation in transistor characteristics, and a driving method thereof. An object of one embodiment of the present invention is to provide a semiconductor device which can reduce adverse effects due to variation in the threshold voltages of transistors, and a driving method thereof. An object of one embodiment of the present invention is to provide a semiconductor device which can reduce adverse effects due to variation in the motilities of transistors, and a driving method thereof.

Note that the objects of the present, invention are not limited to the above objects. The objects described above do not disturb the existence of other objects. The other objects are the ones that are not described above and will be described below. The other objects will be apparent from and can be derived from the description of the specification, the drawings, and the like by those skilled in the art. One embodiment of the present invention is to solve at least one of the aforementioned objects and the other objects.

One embodiment of the present invention is a display device including a pixel. The pixel includes a transistor and a display element. One frame period includes an address period and a blanking period. In the address period, a video signal is input to the pixel, and in the blanking period, current is output from the transistor.

Another embodiment of the present invention is a display device including a pixel. The pixel includes a transistor and a display element. One frame period includes an address period and a blanking period. In the address period, a video signal is input to the pixel, and in the blanking period, a potential of a terminal of the transistor is output from the pixel.

Another embodiment of the present invention is the display device having any of the above structures, in which the video signal is a signal which brings the display element into a non-display state.

Another embodiment of the present invention is a display device including a pixel. The pixel includes a transistor and a display element. One frame period includes an address period and a blanking period. In the address period, a first signal is input to the pixel. In the blanking period, a second signal is input to the pixel. In the blanking period, current is output from the transistor. The first signal is a signal which brings the display element into a non-display state. The amount of the current depends on the second signal.

Another embodiment of the present invention is a display device including a first pixel and a second pixel. The first pixel includes a first transistor and a first display element. The second pixel includes a second transistor and a second display element. The first pixel is electrically connected to a first wiring. The second pixel is electrically connected to the first wiring. In a first period, the first display element is in a display state, the second display element is in a non-display state, and current is output from the second transistor to the first wiring.

Another embodiment of the present invention is the display device having any of the above structures, in which in a second period, a first signal is input to the first pixel; a second signal is input to the second pixel; the first signal is a signal which brings the first display element into a display state; the second signal is a signal which brings the second display element into a non-display state; a third signal is input to the second pixel; and the amount of the current depends on the third signal.

Another embodiment of the present invention is a display device including a plurality of first wirings, a plurality of second wirings, a plurality of third wirings, a plurality of fourth wirings, a plurality of fifth wirings, a plurality of pixels arranged in a matrix, and a plurality of reading circuits. Each of the plurality of pixels includes a light-emitting element, a first transistor, a second transistor, and a third transistor. Each of the plurality of first wirings extends in a row direction. Each of the plurality of second wirings extends in a column direction. Each of the plurality of fourth wirings extends in a row direction. Each of the plurality of fifth wirings extends in a column direction. A gate of the first transistor is electrically connected to one of the plurality of first wirings. One of a source and a drain of the first transistor is electrically connected to one of the plurality of second wirings. The other of the source and the drain of the first transistor is electrically connected to a gate of the second transistor. One of a source and a drain of the second transistor is electrically connected to one of the plurality of third wirings. The other of the source and the drain of the second transistor is electrically connected to one of a source and a drain of the third transistor. A gate of the third transistor is electrically connected to one of the plurality of fourth wirings. The other of the source and the drain of the third transistor is electrically connected to one of the plurality of fifth wirings. The light-emitting element is electrically connected to the other of the source and the drain of the second transistor. One of the plurality of reading circuits is electrically connected to one of the plurality of fifth wirings. In a blanking period of the display device, in each of the pixels in a row in which all the pixels are displayed in black, the first transistor is turned on by one of the plurality of first wirings and the third transistor is turned on by one of the plurality of fourth wirings; the second transistor is turned on by one of the plurality of second wirings; data on current characteristics of the second transistor is read out by one of the plurality of reading circuits; and the pixels in the row are displayed in black via one of the plurality of second wirings.

Another embodiment of the present invention is a display device including a plurality of first wirings, a plurality of second wirings, a plurality of third wirings, a plurality of fourth wirings, a plurality of fifth wirings, a plurality of pixels arranged in a matrix, and a plurality of reading circuits. Each of the plurality of pixels includes a light-emitting element, a first transistor, a second transistor, and a third transistor. Each of the plurality of first wirings extends in a row direction. Each of the plurality of second wirings extends in a column direction. Each of the plurality of fourth wirings extends in a row direction. A gate of the first transistor is electrically connected to the first wiring. One of a source and a drain of the first transistor is electrically connected to the second wiring. The other of the source and the drain of the first transistor is electrically connected to the light-emitting element. A gate of the second transistor is electrically connected to one of a source and a drain of the third transistor. One of a source and a drain of the second transistor is electrically connected to one of the plurality of third wirings. The other of the source and the drain of the second transistor is electrically connected to the light-emitting element. A gate of the third transistor is electrically connected to one of the plurality of fourth wirings. The other of the source and the drain of the third transistor is electrically connected to one of the plurality of fifth wirings. One of the plurality of reading circuits is electrically connected to one of the plurality of second wirings. In a blanking period of the display device, in each of the pixels in a row in which all the pixels are displayed in black, the first transistor is turned on by one of the plurality of first wirings and the third transistor is turned on by one of the plurality of fourth wirings; the second transistor is turned on by one of the plurality of second wirings; data on current characteristics of the second transistor is read out by one of the plurality of reading circuits; and the pixels in the row are displayed in black via one of the plurality of second wirings.

Another embodiment of the present invention is a display device including a plurality of first wirings, a plurality of second wirings, a plurality of third wirings, a plurality of fourth wirings, a plurality of fifth wirings, a plurality of pixels arranged in a matrix, and a plurality of reading circuits. Each of the plurality of pixels includes a light-emitting element, a first transistor, a p-channel second transistor, and a third transistor. Each of the plurality of first wirings extends in a row direction. Each of the plurality of second wirings extends in a column direction. Each of the plurality of fourth wirings extends in a row direction. Each of the plurality of fifth wirings extends in a column direction. A gate of the first transistor is electrically connected to one of the plurality of first wirings. One of a source and a drain of the first transistor is electrically connected to one of the plurality of second wirings. The other of the source and the drain of the first transistor is electrically connected to a gate of the second transistor. One of a source and a drain of the second transistor is electrically connected to one of a source and a drain of the third transistor. The other of the source and the drain of the second transistor is electrically connected to the third wiring. A gate of the third transistor is electrically connected to one of the plurality of fourth wirings. The other of the source and the drain of the third transistor is electrically connected to one of the plurality of fifth wirings. The light-emitting element is electrically connected to the one of the source and the drain of the second transistor. One of the plurality of reading circuits is electrically connected to one of the plurality of second wirings. In a blanking period of the display device, in each of the pixels in a row in which all the pixels are displayed in black, the first transistor is turned on by one of the plurality of first wirings and the third transistor is turned on by one of the plurality of fourth wirings; the second transistor is turned on by one of the plurality of second wirings; data on current characteristics of the second transistor is read out by one of the plurality of reading circuits; and the pixels in the row are displayed in black via one of the plurality of second wirings.

In the above structures, in the period where the data on the current characteristics of the second transistor is read out by one of the plurality of reading circuits, it is preferable that forward bias not be applied to the light-emitting element in the row in which all the pixels are displayed in black. In the above structures, it is preferable that a capacitor be provided between the gate of the second transistor and the other of the source and the drain of the second transistor. In the above structures, a current value of the second transistor may be read out as the data on the current characteristics of the second transistor.

Another embodiment of the present invention is a driving method of a display device, in which the display device includes a plurality of pixels arranged in a matrix and a plurality of reading circuits provided outside the pixels, and each of the pixels includes a light-emitting element and a transistor which supplies current to the light-emitting element. The driving method includes the steps of, in a blanking period of the display device, selecting a row in which all the pixels are displayed in black, inputting a reading signal to the row, performing the step of reading data on current characteristics of transistors included in the pixels in the selected row and the step of performing display in pixels in rows other than the selected row at the same time, and inputting a signal for black display in the selected row so that the pixels in the row are displayed in black.

In the above structures, it is preferable that forward bias not be applied to the light-emitting element in the selected row while the data on the current characteristics of the transistors included in the pixels in the selected row is read out by the reading circuits. In the above structures, the current value of the transistor may be read out as the data on the current characteristics of the transistor.

Note that other embodiments of the present invention will be described in the following embodiments with reference to the drawings.

According to one embodiment of the present invention, a novel display device, a novel semiconductor device, a driving method of the novel display device, a driving method of the novel semiconductor device, or the like can be provided.

According to one embodiment of the present invention, a display device or the like which can perform external correction in parallel with display operation, can be provided. According to one embodiment of the present invention, a driving method of the display device or the like which can perform external correction in parallel with display operation, can be provided. According to one embodiment of the present invention, a display device in which display unevenness is suppressed and a driving method thereof can be provided. According to one embodiment of the present invention, a display device capable of high definition display and a driving method thereof can be provided. According to one embodiment of the present invention, a semiconductor device which can reduce adverse effects due to variation in transistor characteristics and a driving method thereof can be provided. According to one embodiment of the present invention, a semiconductor device which can reduce adverse effects due to variation in the threshold voltages of transistors and a driving method thereof can be provided. According to one embodiment of the present invention, a semiconductor device which can reduce adverse effects due to variation in the mobility of transistors and a driving method thereof can be provided.

Note that the effects of the present invention are not limited to the above effects. The effects described above do not disturb the existence of other effects. The other effects are the ones that are not described above and will be described below. The other effects will be apparent from and can be derived from the description of the specification, the drawings, and the like by those skilled in the art. One embodiment of the present invention is to have at least one of the aforementioned effects and the other effects. Accordingly, one embodiment of the present invention does not have the aforementioned effects in some cases.

DETAILED DESCRIPTION OF THE INVENTION

Figure 1A:
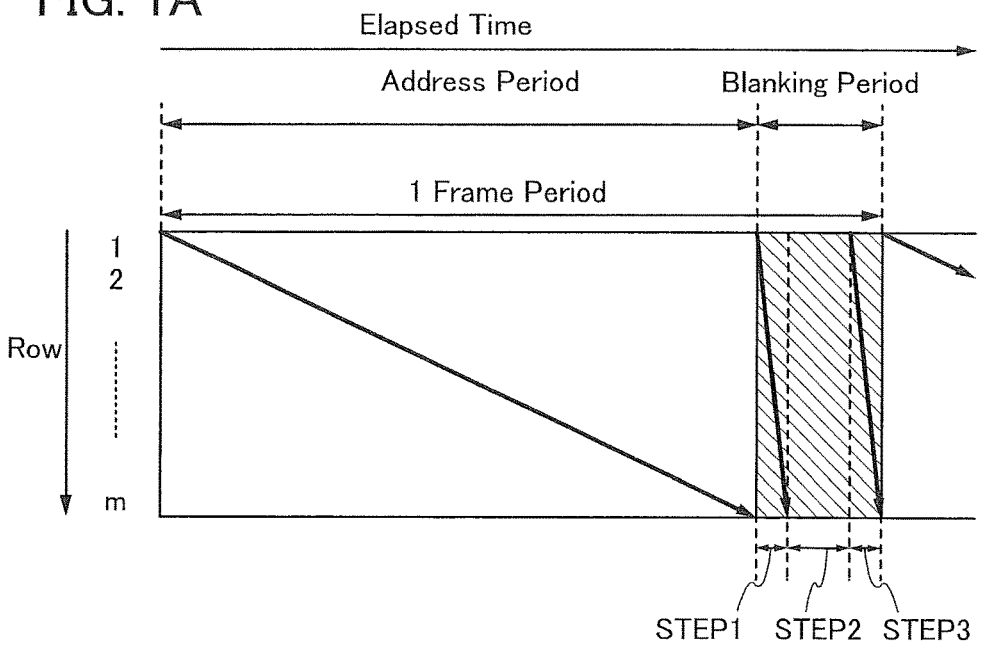
FIGS. 1A and 1B are a timing chart and a flow chart illustrating one embodiment of the present invention.

Hereinafter, embodiments will be described with reference to drawings. However, the embodiments can be implemented with various modes. It will be readily appreciated by those skilled in the art that modes and details can be changed in various ways without departing from the spirit and scope of the present invention. Thus, the present invention should not be interpreted as being limited to the following description of the embodiments.

In this specification and the like, ordinal numbers such as first, second, and third are used in order to avoid confusion among components. Thus, the terms do not limit the number or order of components. In the present specification and the like, a "first" component in one embodiment can be referred to as a "second" component in other embodiments or claims. Alternatively, in the present specification and the like, a "first" component in one embodiment can be referred to without the ordinal number in other embodiments or claims.

In the drawings, the same components, components having similar functions, components formed of the same material, or components formed at the same time are denoted by the same reference numerals in some cases, and description thereof is not repeated in some cases.

Embodiment 1

In this embodiment, a structure of a display device according to one embodiment of the disclosed invention and a driving method thereof will be described with reference to FIGS. 1A and 1B, FIG. 2, FIG. 3, FIG. 4, FIG. 5, FIG. 6, FIG. 7, FIGS. 8A and 8B, FIGS. 9A to 9C, FIG. 10, and FIGS. 11A and 11B.

<External Correction Method of Display Device>

FIG. 1A is a timing chart illustrating a driving method of a display device according to one embodiment of the disclosed invention. In the timing chart in FIG. 1A, the horizontal direction indicates elapsed time and the vertical direction indicates the row on which scanning is performed.

The display device of this embodiment includes a plurality of pixels arranged in a matrix with in rows and n columns (m and n are each an integer greater than or equal to 2). Furthermore, each pixel includes a light-emitting element and a transistor which supplies current to the light-emitting element (hereinafter also referred to as a driving transistor). Furthermore, the display device includes a circuit (also referred to as a reading circuit) which is configured to read data on current characteristics of the driving transistor to the outside of a pixel portion provided with the pixels. Examples of the current characteristics include a current value at the time when a predetermined voltage is supplied to the driving transistor, the threshold voltage of the driving transistor, and a voltage corresponding to the threshold voltage. Note that the reading circuit may be provided in a display device, a flexible printed circuit (FPC) connected to a display device, or a display module.

As shown in FIG. 1A, in the display device of this embodiment, an image is displayed by sequentially scanning pixels row by row from the first row to the m-th row and repeating this scanning operation. The period of time from the start of the scanning in the first row through the scanning of the m-th row and time up to but not including the next scanning is referred to as one frame period. In the one frame period, there is a period called a blanking period in which scanning for displaying an image is not performed, which starts after the scanning of the m-th row and ends before the next scanning of the first row. The period of time for scanning from the first row to the m-th row is sometimes called an address period or a signal writing period. That is, the one frame period includes the address period and the blanking period. However, the one frame period may include a plurality of sub-frame periods. In that case, each sub-frame period may include an address period. Furthermore, a period from an input of a video signal to a selected row until an input of a new signal to the row in the next frame period may be referred to as a display period. That is, in a pixel, a period during which one gray scale level is substantially displayed may be referred to as a display period. Note that the length of the display period is the same in all the rows; however, timing of the start and the end of the display period may varies depending to the row.

When current characteristics of the driving transistor is read out while scanning for displaying an image is performed, display of the image may be disturbed by an input of a signal for reading data. However, in the case of reading current characteristics by selecting a row in which all the pixel are displayed in black in the blanking period, the current characteristics can be read out without disturbance of the black display in that row. Specifically, for example, in the case where all the pixels in one row are displayed in black, current characteristics can be easily read out from that row. Note that a black display state may be referred to as a non-display state. Alternatively, the black display state may be referred to as a display state of a zero gray level. The state where display is performed with any gray levels except black may be referred to as a display state. Alternatively, the state where display is performed with any gray levels except black may be referred to as a state where a gray level is higher than zero. The state where display is performed with the highest gray level may be referred to as a white display state. Alternatively, the state where display is performed with the highest gray level may be referred to as a state where display is performed with the highest gray level.

In this embodiment, as an example, description is made on a driving method of a display device, in which variation in current characteristics of driving transistors is corrected by reading data on the current characteristics of the driving transistors in one row in which all the pixels are displayed in black in a blanking period.

Figure 1B:
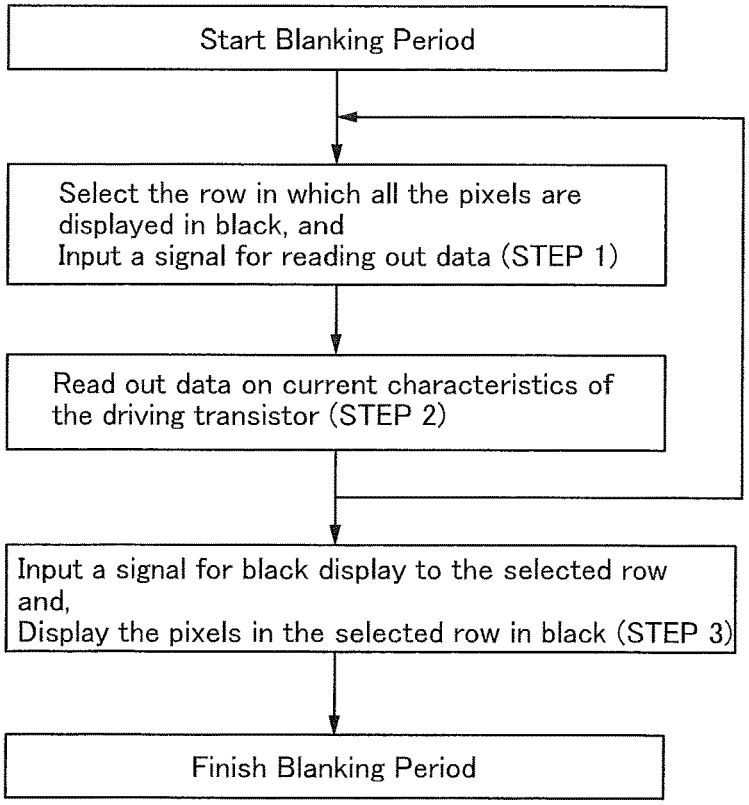

FIG. 1B shows a flow chart of a driving method of the display device described in this embodiment. STEP 1 to STEP 3 of the driving method of the display device are separately described with reference to FIG. 1B.

As shown in FIG. 1B, in the display device of this embodiment, when the blanking period starts, the row in which all the pixels are displayed in black is selected, and a signal for reading out data on the current characteristics (hereinafter also referred to as a reading signal) is input to the selected row (STEP 1). As shown in FIG. 1A, also in STEP 1 in the blanking period, for example, in the case where a gate line driver circuit includes a shift register circuit, scanning is sequentially performed from the first row to the m-th row. Then, only the row in black display is selected. That is, the rows other than the row in black display are not selected. In other words, row-by-row sequential scanning from the first row to the m-th row is only performed in the gate line driver circuit, and a selection signal is not supplied to all pixels from the gate line driver circuit. The selection signal is supplied only to the row in black display. Thus, a signal stored in pixels in the rows other than the row in black display is kept. Note that in the case where a decoder circuit or the like is used as the gate line driver circuit, an arbitrary row can be selected in an arbitrary order. Thus, in that case, the row-by-row sequential scanning from the first row to the m-th row is not necessarily performed in the gate line driver circuit in the blanking period. Without the scanning, only a predetermined row (the row in black display) may be instantly selected, and a reading signal may be input to the pixels. Note that the selected row is desirably only one row, so that signals can be prevented from being mixed.

Reverse bias is preferably applied to the light-emitting element so that a light-emitting element in a selected pixel can maintain black display when a reading signal is input. Furthermore, in order to maintain the black display state at least until STEP 3, even if forward bias is applied, a potential difference is suppressed to extremely small. The extremely small potential difference is preferably approximately several volts, for example, 2 volts or lower, further preferably 1 volt or lower.

Here, a non-selection signal is supplied to the rows other than the selected row so that the reading signal is not input to those rows. Thus, a video signal input in the address period is maintained in the pixels.

Next, in the display device of this embodiment, data on current characteristics of the driving transistors of the selected row is read out by the reading circuit (STEP 2). In that case, for example, in the selected pixels, switches or transistors for reading the current characteristics of the transistors are turned on.

Here, as the data on current characteristics that is read out in STEP 2, any data as long as it is data on variation in current characteristics of the driving transistors is available. For example, it may be data on current values of the driving transistors, or may be data on the threshold voltages of the driving transistors. By reading out the current values, how at least one of the threshold voltages, the motilities, the channel lengths, and the channel widths vary or deteriorate can be known from the current values. For example, in the case where current values are read out as the data, the amount of current depends on the reading signal that is input in STEP 1.

Note that in STEP 2, the predetermined row may be kept selected and the reading signal may be kept input to the selected row. Alternatively, if the reading signal is held in the pixels, it is not necessary that the reading signal be kept input to the predetermined row in STEP 2.

Next, in the display device of this embodiment, a signal for black display is input to the selected row so that the pixels in the selected row are displayed in black (STEP3). The reading signal that is input in STEP 1 is a signal for turning on the driving transistors. If this signal is kept input, light emission occurs in a row in which black display is supposed to be performed. To prevent this, in STEP 3, a signal for black display is input to the selected row that is selected again.

As in STEP1, for example, in the case where the gate line driver circuit includes a shift register circuit in STEP 3, scanning is sequentially performed from the first row to the m-th row. Then, only the row in black display is selected. That is, the rows other than the row in black display are not selected. That is, row-by-row sequential scanning from the first row to the m-th row is only performed in the gate line driver circuit, and a selection signal is not supplied to all pixels from the gate line driver circuit. The selection signal is supplied only to the row in black display. Thus, a signal stored in the pixels in the rows other than the row in black display is kept. Note that in the case where a decoder circuit or the like is used as the gate line driver circuit, an arbitrary row can be selected in an arbitrary order. Thus, in that case, sequential scanning for each row from the first row to the m-th row is not necessarily performed in the gate line driver circuit. Without the scanning, only a predetermined row (the row in black display) may be instantly selected, and a signal for black display may be input to the pixels.

In the case where the predetermined row is kept selected in STEP 2, the predetermined row may be kept selected also in STEP 3. Then, after the signal for black display is input to the selected row, the selected row may be changed to a non-selection state.

Note that in the rows other than the row in black display, display operation is performed even in the blanking period.

As shown in FIG. 1A, when STEP 3 is finished, in the display device of this embodiment, one frame period terminates and the next frame period starts. Here, in accordance with the data on the current characteristics that is read out in STEP 2, a signal for correcting variation in the current characteristics is produced and is input to the pixels.

Note that when STEP 3 is finished, for example, in the selected pixels, a switch or a transistor for reading the current characteristics of the transistor is turned off.

Accordingly, external correction can be performed in parallel with display operation. A display device in which display unevenness is suppressed can be obtained. A display device capable of high definition display can be obtained. A semiconductor device capable of reducing adverse effects due to variation in transistor characteristics can be obtained. A semiconductor device capable of reducing adverse effects due to variation in the threshold voltages of transistors can be provided. A semiconductor device capable of reducing adverse effects due to variation in the mobility of transistors can be provided.

Note that as shown in FIG. 1B, STEP 1 and STEP 2 may be repeated a plurality of times and then STEP 3 may be performed in the blanking period. For example, in the case where there are a plurality of rows in each of which all the pixels are displayed in black in the blanking period, STEP 1 and STEP 2 may be repeatedly performed. Alternatively, in one frame period, STEP 1 to STEP 3 may be performed on only one of the rows as a target. For the other rows, STEP 1 to STEP 3 may be performed in the next or later frame period.

As for a row in which all the pixels have never been displayed in black since display of an image was started, for example, it is preferable that data on the current characteristics of the driving transistors in that row be read out on at least one of the following occasions: when the power of the display device is turned off; just after the power of the display device is input; when the display device is not used in a predetermined period; at late-night; at early-morning; and the like.

The variation in current characteristics of the driving transistors among pixels of the display device can be corrected by the above-described driving method. In this driving method, the variation in current characteristics of the driving transistors can be corrected in parallel with the display operation of the display device.

Accordingly, in a product including the display device according to one embodiment of the disclosed invention, variation in luminance of pixels of the product can be corrected while display inspection of the product is performed in pre-shipment inspection. Thus, the period of the pre-shipment inspection of the product can be shortened, resulting in cost reduction of the product.

With regard also to a product that has been shipped, the above-described driving method of the display device is performed each time the power is turned on and an image is displayed. Thus, variation in luminance due to deterioration over time and the like after the shipment of the product can be automatically corrected. This enables a longer product lifetime.

Note that in the above-described driving method of the display device, data on the current characteristics is read out in the blanking period; however, the driving method of the display device of this embodiment is not necessarily limited thereto. For example, the data on the current characteristics may be read out when the display screen becomes dark and all the pixels are displayed in black, or when a black picture is inserted so as to improve moving characteristics.

<Structure of Display Device>

Figure 2:
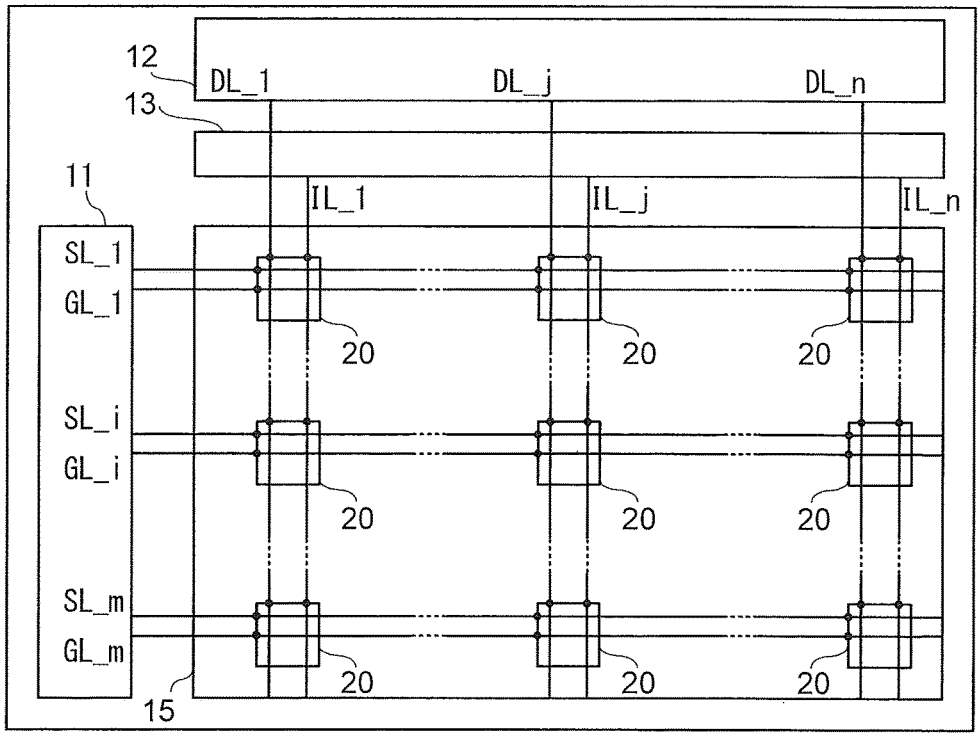
FIG. 2 is a block diagram illustrating one embodiment of the present invention.

Next, a specific structure example of the display device according to one embodiment of the disclosed invention is described with reference to the block diagram in FIG. 2 and the circuit diagram in FIG. 3. FIG. 2 is an example of a block diagram of a pixel portion 15 including (m×n) pixels 20 and peripheral circuits.

The display device in FIG. 2 includes a driver circuit 11, a driver circuit 12, a circuit portion 13, the pixel portion 15 including (m×n) pixels 20 (m rows and n columns) arranged in a matrix, wirings SL_1 to SL_m (m is an integer greater than or equal to 2) which extend in the row direction, wirings GL_1 to GL_m which extend in the row direction, wirings DL_1 to DL_n (n is an integer greater than or equal to 2) which extend in the column direction, and wirings IL_1 to IL_n which extend in the column direction.

The driver circuit 11 is electrically connected to the wirings SL_1 to SL_m and the wirings GL_1 to GL_m. The driver circuit 11 is configured to select a pixel or a row. The driver circuit 11 is configured to sequentially select a pixel or a row, row by row. The driver circuit 11 is configured to select a specific pixel or a specific row. The driver circuit 11 is configured to output a selection signal or a non-selection signal to a pixel. Thus, the driver circuit 11 has a function as a gate line driver circuit or a scan line driver circuit.

The driver circuit 12 is electrically connected to the wirings DL_1 to DL_n. The driver circuit 12 is configured to supply a video signal to a pixel or a column. The driver circuit 12 is configured to supply a reading signal to a pixel or a column. Thus, the driver circuit 12 has a function as a source line driver circuit, a data line driver circuit, or a video signal line driver circuit.

The circuit portion 13 (hereinafter also referred as a reading circuit portion) is electrically connected to the wirings IL_1 to IL_n. Furthermore, the circuit portion 13 is electrically connected to the wiring DL_1 to DL_n. The circuit portion 13 is configured to read data that is output from a pixel. Specifically, the circuit portion 13 is configured to read a potential of a terminal in a pixel.

Figure 4:
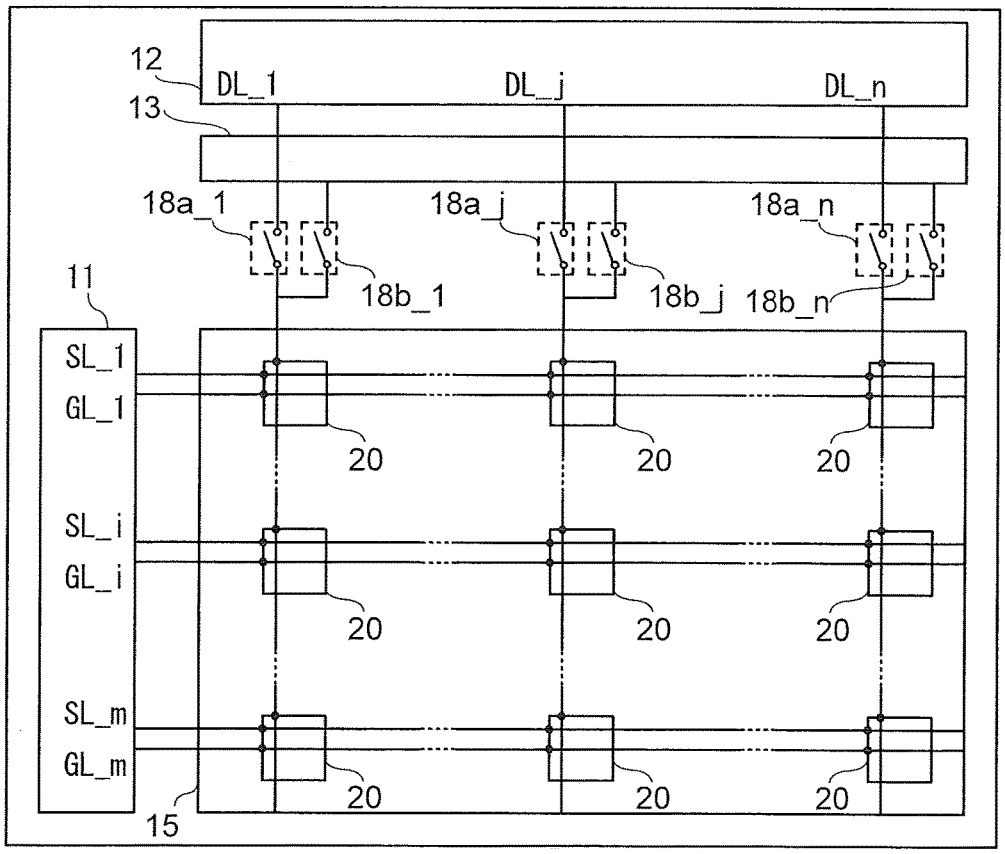
FIG. 4 is a block diagram illustrating one embodiment of the present invention.

Note that when the wirings DL_to DL_n are connected to the circuit portion 13 and the driver circuit 12, as shown in FIG. 4, switches 18*a*_1 to 18*a*_n and switches 18*b*_1 to 18*b*_n are provided. By switching the switches, the wirings DL_1 to DL_n may be brought into electrical contact with one of the circuit portion 13 and the driver circuit 12.

Note that the driver circuit 12 and the circuit portion 13 may be integrally formed as one circuit.

Figure 3:
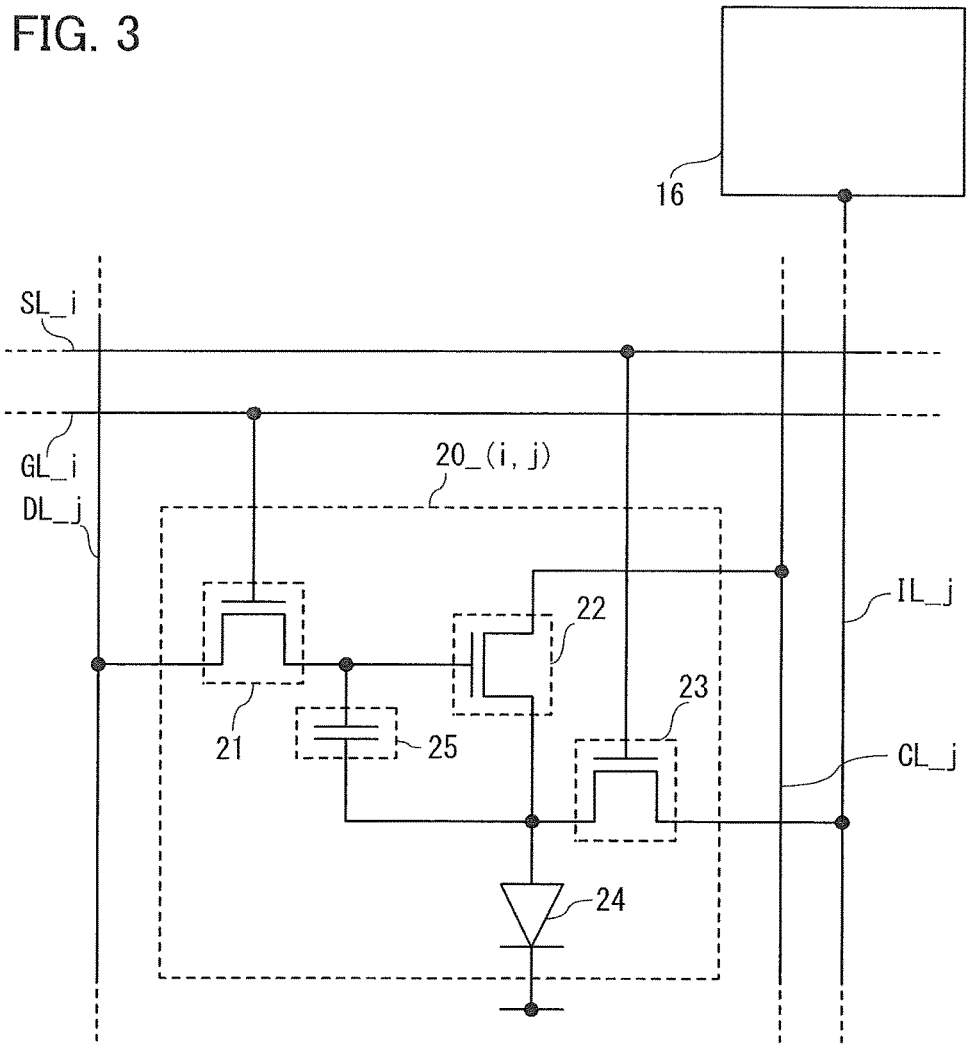
FIG. 3 is a circuit diagram illustrating one embodiment of the present invention.

FIG. 3 shows a structure of a pixel 20_(*i*,*j*) in the i-th row and the j-th column (i is an integer greater than or equal to 1 and less than or equal to m, and j is an integer greater than or equal to 1 and less than or equal to n). The pixel 20_(*i*,*j*) includes a transistor 21, a transistor 22, a transistor 23, a light-emitting element 24, and a capacitor 25. Note that each of the transistors may have a multi-gate structure, that is, a structure in which a plurality transistors are connected in series. Note that each of the transistors may have a structure in which gate electrodes are formed above and below a channel. These elements included in the pixel 20_(*i*,*j*) are electrically connected to the wirings GL_i, SL_i, DL_j, CL_j, and IL_j. Wirings CL_1 to CL_n are not shown in FIG. 2; however, they are provided so as to extend in the column direction. The wiring CL extends in the column direction in FIG. 3; however, the present invention is not limited thereto, and the direction in which the wiring CL extends may be changed as appropriate. For example, the wiring CL may be formed by connection of a wiring provided in the column direction and a wiring provided in the row direction.

A specific connection relation in the pixel 20_(*i*,*j*) is as follows. A gate electrode of the transistor 21 is electrically connected to the wiring GL_i, one of a source electrode and a drain electrode thereof is electrically connected to the wiring DL_j, the other of the source electrode and the drain electrode thereof is electrically connected to a gate electrode of the transistor 22. One of a source electrode and a drain electrode of the transistor 22 is electrically connected to the wiring CL_j, and the other of the source electrode and the drain electrode thereof is electrically connected to one of a source electrode and a drain electrode of the transistor 23 and one of electrodes (hereinafter also referred to as a pixel electrode) of the light-emitting element 24. A gate electrode of the transistor 23 is electrically connected to the wiring SL_i and the other of the source electrode and the drain electrode thereof is electrically connected to the wiring IL_j. A common potential is supplied to the other of the electrodes (hereinafter also referred to as a common electrode).

Figure 5:
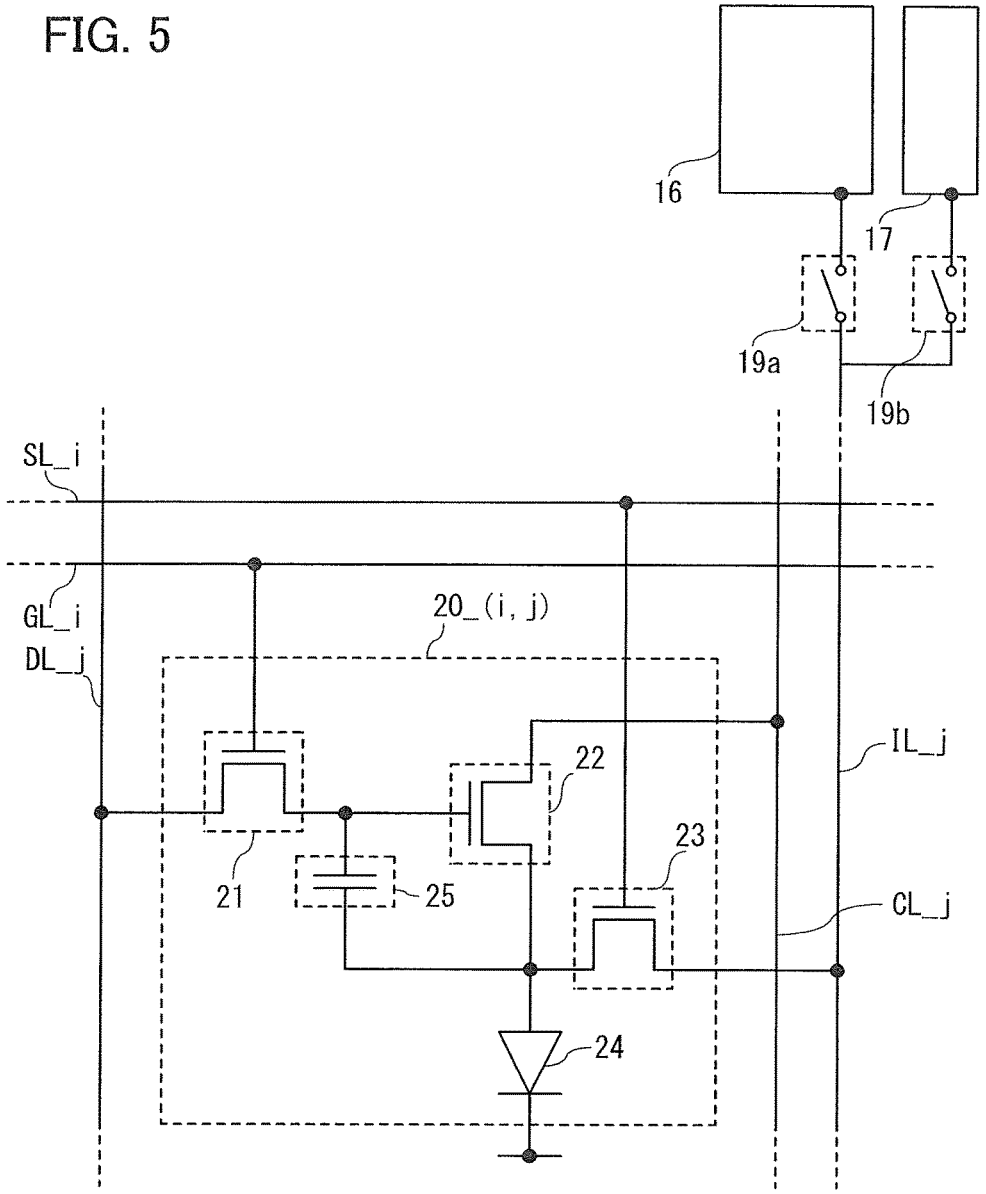
FIG. 5 is a circuit diagram illustrating one embodiment of the present invention.

The wiring IL_j is electrically connected to a reading circuit 16 included in the circuit portion 13. The wiring IL_j may be connected to another circuit, for example, a circuit having a function of supplying a certain potential in the case where reading operation is not performed or in the address period. For example, the wiring IL_j may be connected to a wiring which supplies a certain potential. Note that in the case where the wiring IL_j is connected to the reading circuit 16 and another circuit 17 as shown in FIG. 5, a switch 19*a* and a switch 19*b* may be provided between the wiring IL_j and the reading circuit 16 and between the wiring IL_j and the circuit 17, respectively. By switching the switches, the wiring IL_j and one of the reading circuit 16 and the circuit 17 may be brought into electrical contact with each other.

One of electrodes of the capacitor 25 is electrically connected to the other of the source electrode and the drain electrode of the transistor 21 and the gate electrode of the transistor 22, and the other electrode thereof is electrically connected to the other of the source electrode and the drain electrode of the transistor 22 and the one of the source electrode and the drain electrode of the transistor 23, and the pixel electrode of the light-emitting element 24. With the capacitor 25 provided as described above, more charge can be held in the gate electrode of the transistor 22, and a holding period of image data can be made longer.

Note that the capacitor 25 is not necessarily provided. For example, a high parasitic capacitance of the transistor 22 can be an alternative to the capacitor 25.

The driver circuit 11 can control the on/off states of the transistor 21 by the wiring GL, and the on/off states of the transistor 23 by the wiring SL.

The driver circuit 12 can supply a video signal or a reading signal to the gate electrode of the transistor 22 via the wiring DL.

The circuit portion 13 includes a plurality of reading circuits 16 corresponding to the plurality of wirings IL_1 to IL_n. By the reading circuit 16, data on current characteristics can be read out from the transistor 22 of each pixel 20.

The wiring CL has a function as a high potential power supply line which supplies current to the light-emitting element 24.

However, the structures of the driver circuit 11, the driver circuit 12, and the circuit portion 13 are not limited to that described above. The positions of the driver circuit 11, the driver circuit 12, and the circuit portion 13 may be changed; alternatively, functions of the plurality of driver circuits may be combined into one driver circuit. For example, in FIG. 2, the driver circuit 11 is provided on only one side of the pixel portion 15; however, the driver circuit 11 may be divided and provided on both sides of the pixel portion 15. Furthermore, in FIG. 2, the driver circuit 12 and the pixel portion 13 are separately provided; however, they may be combined as one driver circuit portion.

Figure 6:
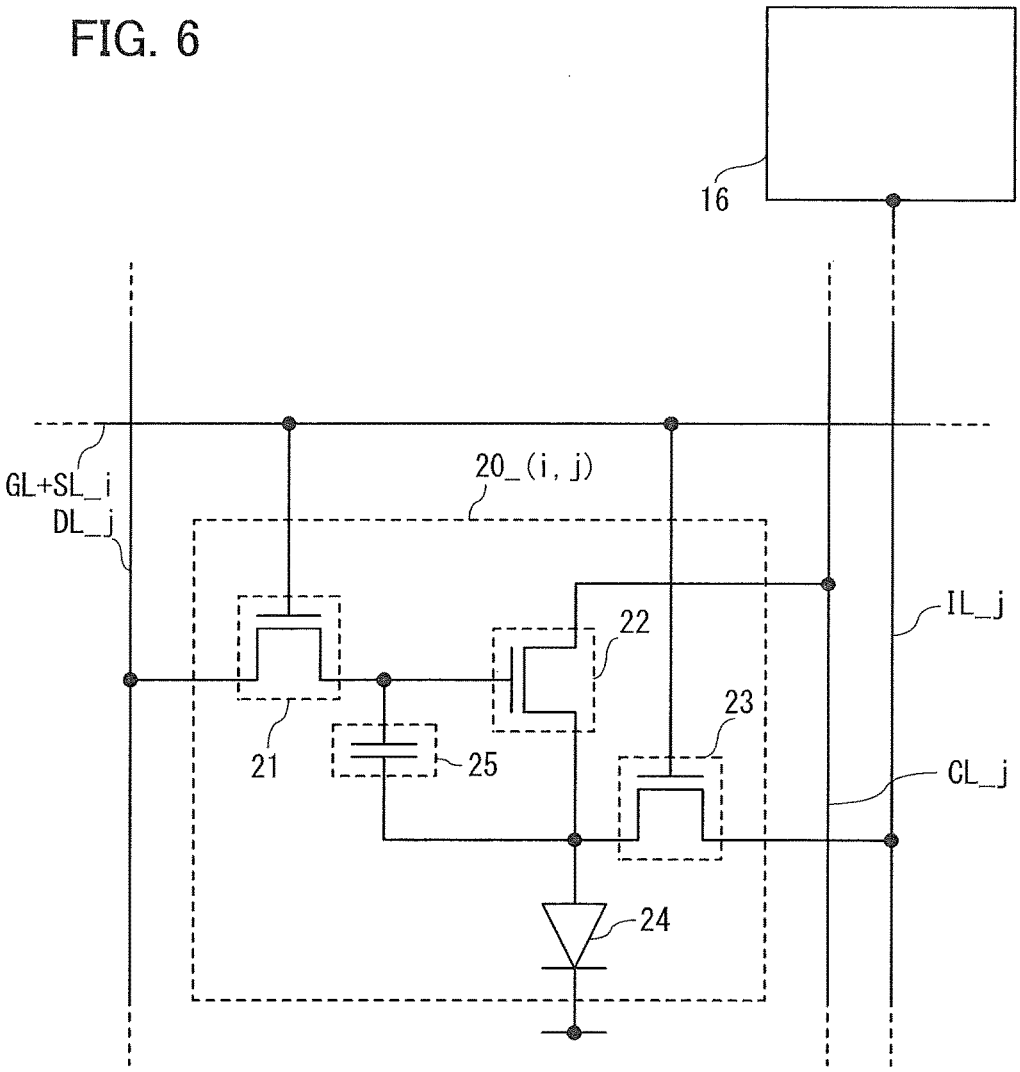
FIG. 6 is a circuit diagram illustrating one embodiment of the present invention.

The directions in which the wiring GL, the wiring SL, the wiring DL, the wiring IL, and the wiring CL extend, the number of the wirings, and the like can be appropriately changed in accordance with changes in the positions, structures, and the like of the driver circuit 11, the driver circuit 12, and the circuit portion 13. For example, the wiring IL may extend in the row direction. Alternatively, for example, the wiring GL and the wiring SL may be combined into one wiring. FIG. 6 shows a circuit diagram in that case. In the case where the wiring GL and the wiring SL are combined into one wiring, the wiring acts similarly to the case where the wiring GL and the wiring SL are turned on/off at the same time. Thus, in the case where a driving method in which the wiring GL and the wiring SL are turned on/off at the same time is employed, the wiring GL and the wiring SL can be combined into one wiring.

The amount of current flowing through the light-emitting element 24 is controlled by the transistor 22 that is controlled in accordance with a video signal input to the pixel 20. The luminance of the light emitting element 24 depends on the amount of current flowing between the pixel electrode and the common electrode. For example, in the case where an OLED (an organic light-emitting diode) is used as the light-emitting element 24, one of an anode and a cathode serves as the pixel electrode and the other thereof serves as the common electrode. FIG. 3 illustrates a configuration of the pixel 20 in which the anode of the light-emitting element 24 is used as the pixel electrode and the cathode of the light-emitting element 24 is used as the common electrode.

Figure 7:
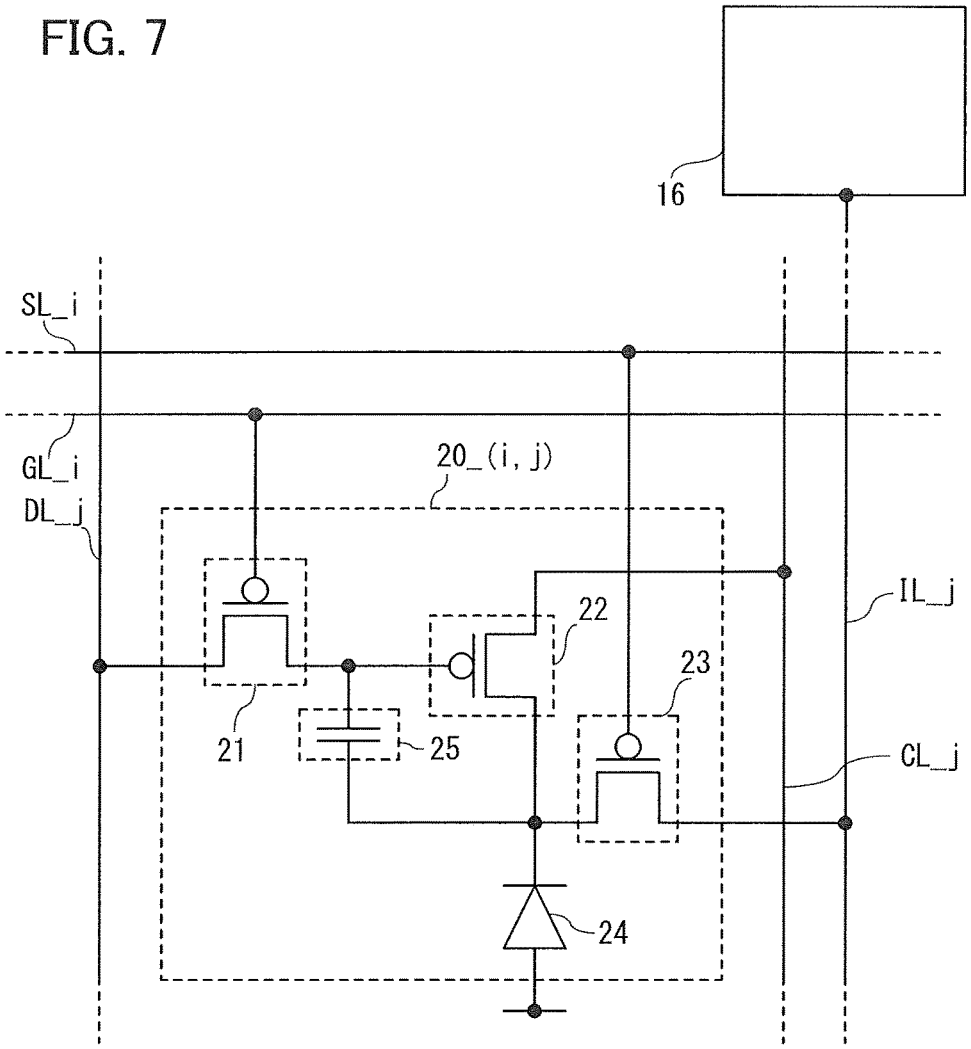
FIG. 7 is a circuit diagram illustrating one embodiment of the present invention.

Operation can be performed with a circuit configuration in which the polarity of the transistors, the orientation of the light-emitting element, the potential of the wirings, the potential of the signals, or the like is changed. FIG. 7 illustrates a variation example of the structure in FIG. 3. In FIG. 7, the transistors 21 to 23 are p-channel transistors, and the direction of the light-emitting element 24 is opposite to that in FIG. 12. Without limitation to the pixel circuit in FIG. 3, a circuit can be similarly formed.

In at least one of the transistors 21 to 23 and another transistor included in the pixel 20, an oxide semiconductor can be used. Alternatively, an amorphous, microcrystalline, polycrystalline, or single crystal semiconductor can be used. As a material of such a semiconductor, silicon, germanium, or the like can be used. Specifically, when the transistor 21 includes an oxide semiconductor in a channel formation region, the off-state current of the transistor 21 can be extremely low. Furthermore, when the transistor 21 having the above-described structure are used in the pixels 20, leakage of electric charge accumulated in the gate of the transistor 22 or the capacitor 25 can be prevented effectively as compared with the case where a transistor including a normal semiconductor such as silicon or germanium is used as the transistor 21.

Accordingly, for example, in the case where video signals each having the same image information are written to the pixel portion 15 for some consecutive frame periods, like a still image, display of an image can be maintained even when driving frequency is low, in other words, the number of writing operations of a video signal to the pixel portion 15 for a certain period is reduced. For example, a purified oxide semiconductor in which impurities serving as electron donors (donors), such as moisture or hydrogen, are reduced and oxygen vacancies are reduced is used for a semiconductor film of the transistor 21, whereby the interval between the operations of writing video signals can be set to 10 seconds or longer, preferably 30 seconds or longer, or further preferably one minute or longer. As the interval between writings of video signals is made longer, power consumption can be further reduced.

In addition, since the potential of the video signal can be held for a longer period, the quality of an image to be displayed can be prevented from being lowered even when the capacitor 25 for holding the potential of the gate of the transistor 22 is not provided in the pixel 20.

The transistors each have the gate on at least one side of a semiconductor film; alternatively, the transistors may each have a pair of gates with a semiconductor film positioned therebetween.

FIG. 3 illustrates the case where the transistors are all n-channel transistors. When the transistors in the pixel 20 have the same channel type, it is possible to omit some of steps for fabricating the transistors, for example, a step of adding an impurity element imparting one conductivity type to the semiconductor film. Note that in the display device, not all the transistors in the pixel 20 are necessarily n-channel transistors. For example, the transistor 21 and the transistor 23 may be p-channel transistors.

Instead of the transistors 21 and 23, an electrical switch, a mechanical switch, a MEMS element, or the like can be used.

<Driving Method of Display Device>

Next, an example of a driving method of the display device shown in FIG. 2 and FIG. 3 is described with reference to FIGS. 1A and 1B. Specifically, explanation is made focusing on the pixel 20_(*i,j*) in the i-th row and the j-th column in FIG. 3. Note that explanation is made in the case where all the pixels 20 in the i-th row are in black display.

First, when an address period of one frame period starts, as shown in FIG. 1A, pixels are sequentially scanned row by row from the first row to the m-th row. When the pixels in the i-th row is selected, a selection signal is input to the wiring SL_i and the transistor 23 is turned on. When the transistor 23 is turned on, the wiring IL_j and the other of the source electrode and the drain electrode of the transistor 22 (hereinafter also referred to as the source electrode of the transistor 22) are brought into electrical contact with each other, and the potential of the wiring IL_j is supplied to the source electrode of the transistor 22. Note that the potential of the wiring IL_j is a potential at which the light-emitting element 24 does not emit light. For example, the potential of the wiring IL_j is the same potential as the potential of the common electrode of the light-emitting element 24.

After that, or at the same time, the selection signal is input to the wiring GL_i, whereby the transistor 21 is turned on. When the transistor 21 is turned on, the wiring DL_j is brought into electrical contact with the gate electrode of the transistor 22. Here, a video signal of the pixel 20_(*i, j*) is supplied to the wiring DL_j, so that a potential corresponding to the video signal of the pixel 20_(*i,j*) is supplied to the gate electrode of the transistor 22. That is, a voltage between the potential of the wiring DL_j and the potential of the wiring IL_j is supplied between the gate and the source of the transistor 22.

Accordingly, a potential difference between the gate and the source of the transistor 22 is stabilized, and current corresponding to the video signal held in the gate electrode of the transistor 22 or the capacitor 25 can be supplied to the light-emitting element 24 via the wiring CL_j.

In the case where the wiring GL_i and the wiring CL_j are combined into one wiring, the wiring operates similarly to the case when the wiring GL_i and the wiring CL_j are selected at the same time.

When pixels in the (i+1)th row are selected, the selection signal that has been input is not supplied to the wiring GL_i and the wiring SL_i, and a non-selection signal is supplied to the wiring GL_i and the wiring SL_i. As a result, the transistor 21 and the transistor 23 are turned off. Thus, a potential difference between the gate and the source of the transistor 22 is held, and a light-emitting state or a non-light-emitting state of the light-emitting element 24 is maintained until the pixel 20_(*i, j*) is selected in the next frame. As a result, current corresponding to the voltage between the gate and the source of the transistor 22 is supplied to the light-emitting element 24 from the transistor 22. Thus, an image corresponding to the video signal can be displayed. In the case where the video signal supplied from the wiring DL_j is a signal for black display, no current flows into the transistor 22; also, no current flows into the light-emitting element 24. As a result, the light-emitting element 24 is in black display or a non-display state.

Next, a driving method of the display device in the blanking period in the first frame period is described. When the blanking period starts, as shown in FIG. 1A, scanning is sequentially performed row by row from the first row to the m-th row. Note that pixels in the rows other than a target row are not selected. That is, the selection signal is not supplied to the rows other than the target row, and the non-selection signal is supplied thereto.

First, STEP 1 in which the row in which all the pixels are displayed in black is selected and a reading signal is input thereto is described. When the pixels in the i-th row are selected, a selection signal is input to the wiring SL_i, and the transistor 23 is turned on. When the transistor 23 is turned on, the wiring IL_j and the source electrode of the transistor 22 are brought into electrical contact with each other, and the potential of the wiring IL_j is supplied to the source electrode of the transistor 22. Note that the potential of the wiring IL_j can be set by the reading circuit 16.

At that time, the potential of the wiring IL_j is preferably lower than the common potential, or at the same level as that of the common potential. The potential of the wiring IL_j is set as described above, so that reverse bias is applied to the light-emitting element 24 or bias is not applied to the light-emitting element 24. Thus, the black display state of the pixels in the i-th row can be maintained. Furthermore, even if forward bias is applied to the light-emitting element 24 so that the black display state of the pixels in the i-th row can be maintained at least until STEP 3, the potential difference between the wiring IL_j and the common potential can be suppressed to extremely small. The extremely small potential difference is preferably a potential difference of approximately several volts or lower, for example, 2 volts or lower, further preferably 1 volt or lower. The current flowing into the transistor 22 does not flow into the light-emitting element 24, and becomes ready to flow into the wiring IL_j.

After or at the same time as the input of the selection signal into the wiring SL_i, the selection signal is input to the wiring GL_i, and the transistor 21 is turned on. When the transistor 21 is turned on, the wiring DL_j and the gate electrode of the transistor 22 are brought into electrical contact with each other. The transistor 22 can be turned on since the wiring DL_j is supplied with the reading signal.

The signal with which the transistor 21 is kept in an off state is input to the wiring GL so that the reading signal is not input to the rows other than the i-th row.

Next, STEP 2 in which data on current characteristics of the transistor 22 (driving transistor) is read out is described. After STEP1, since scanning shifts from the i-th row to the (i+1)th row, the supply of the selection signal that has been input to the wiring GL_i is stopped, and the transistor 21 is turned off. Thus, the reading signal that has been input to the gate electrode of the transistor 22 in STEP1 is maintained.

In contrast, the transistor 23 needs to be turned on during STEP 2. Thus, similarly to STEP 1, the signal which makes the transistor 23 in an on state needs to be continuously input to the wiring SL_i also in STEP 2. For example, a latch circuit is connected to the wiring SL so that the input signal at the time of STEP 1 is held also in STEP 2.

In the case where a decoder circuit and the like is used in the gate line driver circuit, the selection signal can be continued to be supplied to the wiring SL_i, even without connection of a latch circuit and the like to the wiring SL, by controlling a signal input to the decoder circuit.

The transistor 21 is turned off, and the transistors 22 and 23 are turned on in such a manner, whereby the wiring CL_j and the reading circuit 16 are brought into electrical contact with each other via the transistor 22 and the transistor 23. In accordance with the voltage of the reading signal supplied to the transistor 22, current flows into the wiring IL_j and the reading circuit 16 from the transistor 22. Thus, data on the current characteristics of the transistor 22 in the pixel 20_(*i*,*j*) can be read out by the reading circuit 16.

Furthermore, during STEP 2, the transistor 21 may remain in an on state, and the reading signal may continue to be supplied to the wiring DL_j. In that case, for example, the potential which makes the transistor 22 turn on is once supplied to the wiring IL_j. After that, the wiring IL_j may be in a floating state. Consequently, the potential of the wiring IL_j is gradually increased. When the potential is set to the level at which the transistor 22 is turned off, that is, when the gate-source voltage of the transistor 22 is close to the threshold voltage of the transistor 22, the transistor 22 is turned off. As a result, a rise of the potential of the wiring IL_j is stopped. The potential of the wiring IL_j at that time, that is the potential of a source terminal of the transistor 22 may be read out by the reading circuit 16. Consequently, the threshold voltage of the transistor 22 can be read out. Note that in the case where the potential of the source terminal of the transistor 22 is read out, the potential just before the transistor 22 is turned off may be read out.

As the data on the current characteristics of the transistor 22, any data on variation in the current characteristics of the transistors 22 among pixels may be taken. For example, it may be the current value of the transistor 22, or may be the threshold voltage of the transistor 22.

Next, STEP 3 in which a signal for black display is input to the selected row so as to obtain black display is described. The reading signal input in STEP1 is a signal that turns on the transistor 22. When the transistor 23 is turned off with this signal input, forward bias is applied to the light-emitting element 24, which causes a light-emitting state of the light-emitting element 24.

To prevent this, scanning is sequentially performed row by row from the first row to the m-th row again. However, the pixels in the rows other than the target row are not selected. That is, the selection signal is not supplied to the rows other than the target row, and the non-selection signal is supplied thereto. The selection signal is input to the wiring GL_i that is the target row, and the transistor 21 is turned on. Since the signal for black display, which turns off the transistor 22, is input to the wiring DL_j, the signal is applied to the gate electrode of the transistor 22, and the transistor 22 is turned off.

Note that at that time, the selection signal to turn on the transistor 23 is supplied to the wiring SL_i. As a result, a voltage which makes the transistor 22 turn off can be supplied between the gate and the source of the transistor 22.

After that, a non-selection signal to turn off the transistor 23 is supplied to the wiring SL_i to turn off the transistor 23. Similarly, a non-selection signal to turn off the transistor 21 is supplied to the wiring GL_i so that the transistor 21 is turned off. As described above, the non-light-emitting states of the pixels 20 in the i-th row can be maintained from STEP 3 to scanning of pixels in the next frame.

As shown in FIG. 1A, after STEP 3, the display device in FIG. 2 terminates one frame period and starts display of the next frame. Here, in accordance with the data on the current characteristics of the transistor 22 that has been read out in STEP 2, a video signal for correcting the variation in the current characteristics of the transistors 22 can be produced and input to a corresponding pixel. As a result, variation in transistors or adverse effects due to deterioration can be reduced.

Note that in the case where there are a plurality of rows in each of which all the pixels are displayed in black, other than the i-th row, STEP 1 and STEP 2 may be repeatedly performed in the blanking period. Alternatively, in one frame period, STEP 1 to STEP 3 may be performed on only one of the rows as a target. For the other rows, STEP 1 to STEP 3 may be performed in the next or later frame period.

As for a row in which all the pixels have never been displayed in black since display of an image was started, for example, it is preferable that data on the current characteristics of the driving transistors 22 in that row be read out on the occasion of turning off the power of the display device.

The variation in current characteristics of the driving transistors among pixels of the display device of this embodiment can be corrected by the above-described driving method. In this driving method, the variation in current characteristics of the driving transistors can be corrected in parallel with the display operation of the display device.

Accordingly, in a product including the display device according to one embodiment of the disclosed invention, variation in luminance of pixels of the product can be corrected while display inspection of the product is performed in pre-shipment inspection. Thus, the period of the pre-shipment inspection of the product can be shortened, resulting in cost reduction of the product.

With regard also to a product that has been shipped, the above-described driving method of the display device is performed each time the power is turned on and an image is displayed. Thus, variation in luminance due to deterioration over time and the like after the shipment of the product can be automatically corrected. This enables a longer product lifetime.

Figure 8A:
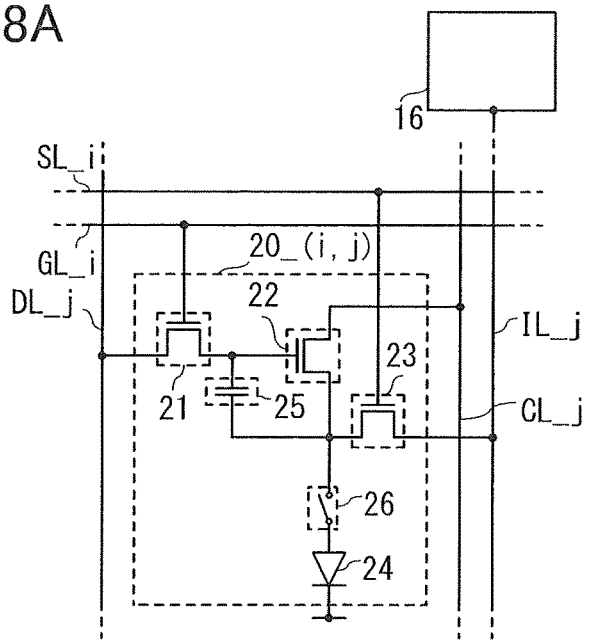
FIGS. 8A and 8B are circuit diagrams each illustrating one embodiment of the present invention.
Figure 8B:
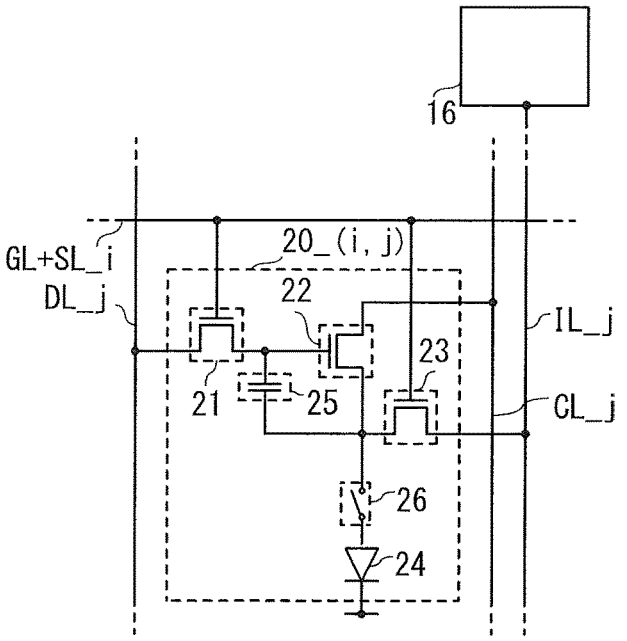

The pixel structure of the display device of this embodiment is not limited to that shown in FIG. 3. For example, in the pixel 20_(*i*,*j*), a switch 26 may be provided between the light-emitting element 24 and the transistor 22. FIGS. 8A and 8B show circuit diagrams in that case. FIG. 8A shows the case where the switch 26 is provided in the structure of FIG. 3, and FIG. 8B shows the case where the switch 26 is provided in the structure of FIG. 6. The switch 26 is turned off during STEP 1 and STEP 2, so that the non-light-emitting state of the light-emitting element 24 can be surely maintained in STEP 1 and STEP 2.

<Structural Example of Reading Circuit>

Next, specific structure examples of the reading circuit 16 is described with reference to the circuit diagrams in FIGS. 9A to 9C.

Figure 9A:
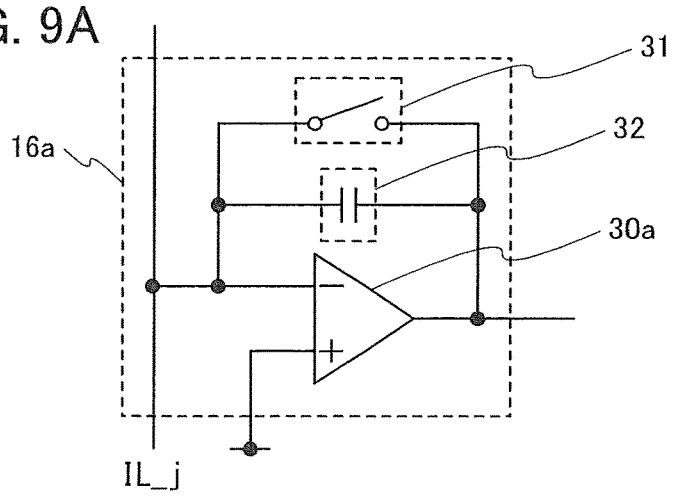
FIGS. 9A to 9C are circuit diagrams each illustrating one embodiment of the present invention.

A reading circuit 16*a* in FIG. 9A includes an operational amplifier 30*a*, a capacitor 32, and a switch 31. In the operational amplifier 30*a*, a reference potential is input to a plus input terminal; a minus input terminal is electrically connected to the wiring IL_j, one terminal of the switch 31, and one electrode of the capacitor 32; and an output terminal is electrically connected to the other terminal of the switch 31 and the other electrode of the capacitor 32. The operational amplifier 30*a* operates so that the potential of the plus input terminal and the potential of the minus input terminal are equal to each other. Thus, the potential of the wiring IL_j can be controlled by the potential of the plus input terminal. Thus, it can be said that the reading circuit 16*a* is configured to control the potential of the wiring IL_j. Therefore, also in the address period, the potential of the wiring IL_j may be controlled by the reading circuit 16*a*.

With such a structure, a current integral value of the wiring IL_j can be read out by the reading circuit 16*a*.

Figure 9B:
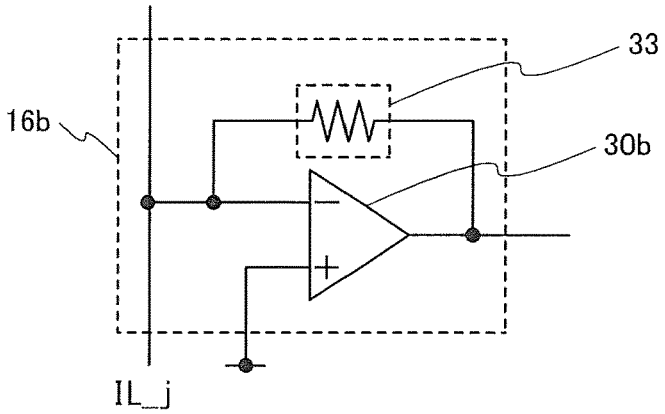

A reading circuit 16*b* in FIG. 9B includes an operational amplifier 30*b* and a resistor 33. In the operational amplifier 30*b*, a reference potential is input to a plus input terminal; a minus input terminal is electrically connected to the wiring IL_j and one electrode of the resistor 33; and an output terminal is connected to the other electrode of the resistor 33. The operational amplifier 30*b* operates so that the potential of the plus input terminal and the potential of the minus input terminal are equal to each other. Thus, the potential of the wiring IL_j can be controlled by the potential of the plus input terminal. Thus, it can be said that the reading circuit 16*b* is configured to control the potential of the wiring IL_j. Therefore, also in the address period, the potential of the wiring IL_j may be controlled by the reading circuit 16*b*.

With such a structure, the reading circuit 16*b* converts the current value of the wiring IL_j into a voltage value to be read out.

Figure 9C:
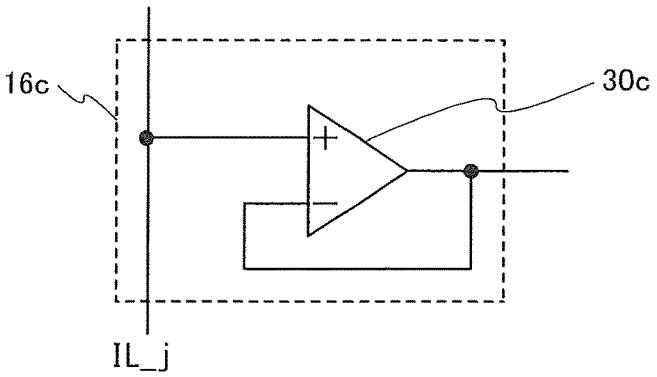

A reading circuit 16*c* in FIG. 9C includes an operational amplifier 30*c*. In the operational amplifier 30*c*, a plus input terminal is electrically connected to the wiring IL_j and a minus input terminal is electrically connected to an output terminal of the operational amplifier 30*c*. The operational amplifier 30*c* operates so that the potential of the plus input terminal and the potential of the minus input terminal are equal to each other. Thus, the potential of the wiring IL_j can be output from the operation amplifier 30*c* as the potential of the minus input terminal; i.e., the potential of the output terminal. Note that the reading circuit 16*c* does not have a function of controlling the potential of the wiring IL_j. Thus, as shown in FIG. 5, the potential of the wiring IL_j may be controlled by using another circuit.

With such a structure, the threshold voltage of the transistor 22 that is electrically connected to the wiring IL_j can be read out by the reading circuit 16*c*.

<Structure Example for Reading Current Characteristics from Pixels with Specific Hue>

In the driving method of a display device shown in FIG. 2 and FIG. 3, data on the current characteristics of all the pixels in a selected row are collectively read out; however, the driving method of a display device of this embodiment is not limited thereto, and data on current characteristics can be read out from a specific pixel in the selected row. For example, data on the current characteristics can be read out from a pixel in the same row and in a specific column, or a pixel displaying a specific hue in the same column.

Figure 10:
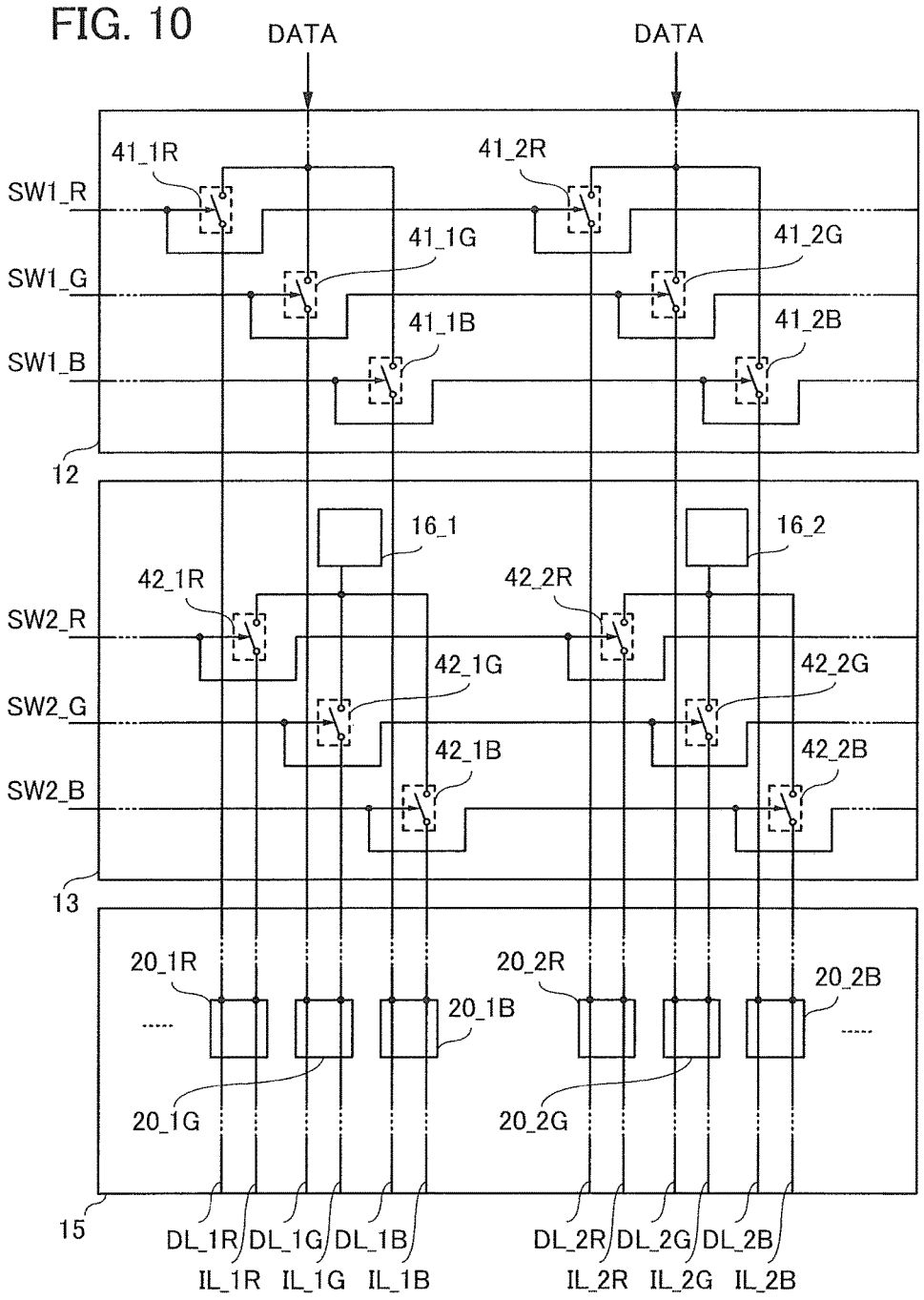
FIG. 10 is a circuit diagram illustrating one embodiment of the present invention.

FIG. 10 illustrates an example of a structure of the driving circuit 12, the circuit portion 13, and the pixel portion 15, in which data on current characteristics can be read out from pixels displaying a specific hue in the same column. FIG. 10 illustrates an example in which each of the wiring DL and the wiring IL is divided into three columns; however, one embodiment of the present invention is not limited thereto. Those wirings may be divided for more columns.

The display device in FIG. 10 has a structure in which a pixel exhibiting red, a pixel exhibiting green, and a pixel exhibiting blue are provided in the same row in the pixel portion 15 to form one pixel unit that exhibits one color. In the driver circuit 12, a kind of a video signal or a reading signal for one unit is supplied, and is divided into signals corresponding to the pixels of red, green, and blue. In the circuit portion 13, one reading circuit 16 is provided for one unit.

To a pixel 20_1R exhibiting red, a signal is input from the driver circuit 12 via a wiring DL_1R and a switch IL_1R, and the pixel 20_1R is electrically connected to a reading circuit 16_1 via a wiring IL_1R and a switch 42_1R. Similarly, to a pixel 20_1G exhibiting green, a signal is input from the driver circuit 12 via a wiring DL_1G and a switch 41_1G, and the pixel 20_1G is electrically connected to the reading circuit 16_1 via a wiring IL_1G and a switch 42_1G. Similarly, to a pixel 20_1B exhibiting blue, a signal is input from the driver circuit 12 via a wiring DL_1B and a switch 41_1B, and the pixel 20_1B is electrically connected to the reading circuit 16_1 via a wiring IL_1B and a switch 42_B.

Pixels 20_2R to 20_2B provided in the adjacent column of the pixels 20_1R to 20_1B have structures similar to those of the pixels 20_1R to 20_1B.

The switch 41_1R and a switch 41_2R are controlled by a wiring SW1_R which extends in the row direction. The switch 41_1G and a switch 41_2G are controlled by a wiring SW1_G which extends in the row direction. The switch 41_1B and a switch 41_2B are controlled by a wiring SW1_B which extends in the row direction. The switch 42_1R and a switch 42_2R are controlled by a wiring SW2_R which extends in the row direction. The switch 42_1G and a switch 42_2G are controlled by a wiring SW2_G which extends in the row direction. The switch 42_1B and a switch 42_2B are controlled by a wiring SW2_B which extends in the row direction.

Use of the display device with such a structure enables data on the current characteristics to be read out from the pixels displaying a specific hue in the same row. For example, a reading signal is input only to pixels exhibiting red in the same row (the pixels 20_1R and 20_2R in FIG. 10), and data on the current characteristics can be read out only from the pixels exhibiting red in the same row.

With such a structure, a circuit which has been provided in one to one correspondence (e.g., a reading circuit or the like) with a pixel may be provided for one unit including three pixels, so that an occupation area of the circuit can be reduced. In FIG. 10, one unit includes three pixels; however, one embodiment of the present invention is not limited thereto. One unit may include more pixels.

Note that in the display device in FIG. 10, the switches are provided for both of the driver circuit 12 and the circuit portion 13 so that processing can be separately performed per pixel with a specific hue; however, the display device of this embodiment is not limited thereto. The switch may be provided for only one of the driver circuit 12 and the circuit portion 13. Furthermore, the wirings which are electrically connected to the same pixel, such as the wiring SW1_R or the wiring SW2_R, may be electrically connected, or its wiring signals may be synchronized.

<Configuration Example of Output Control Circuit>

Figure 11A:
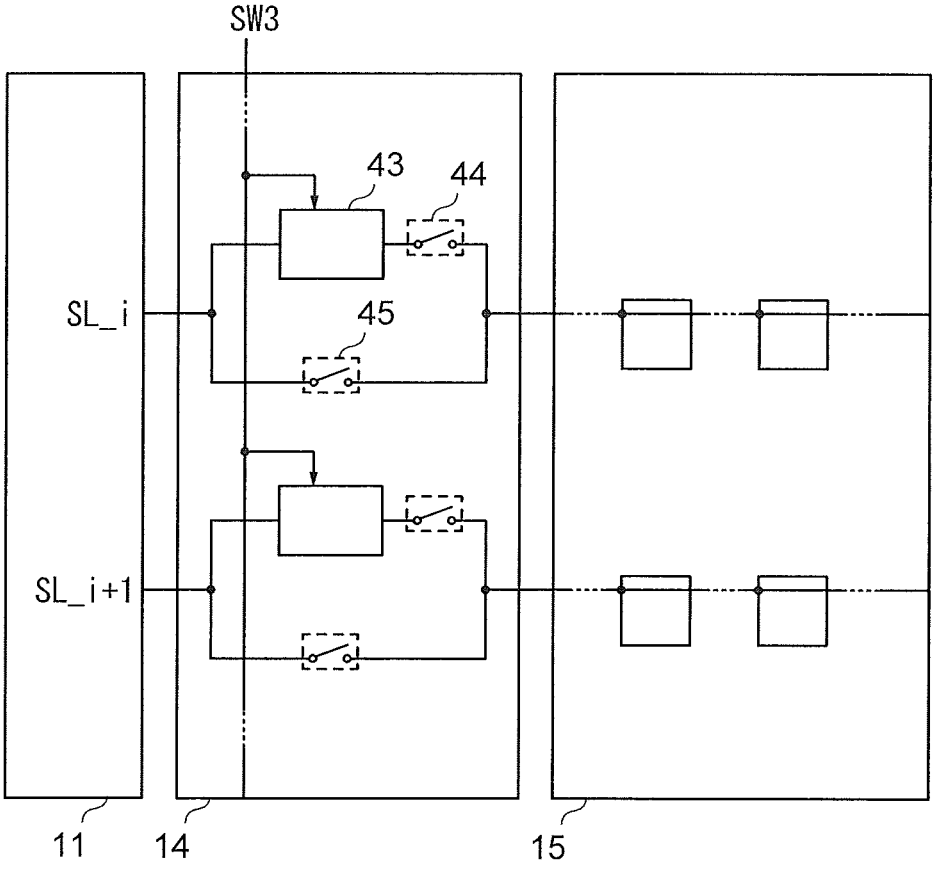
FIGS. 11A and 11B are circuit diagrams illustrating one embodiment of the present invention.
Figure 11B:
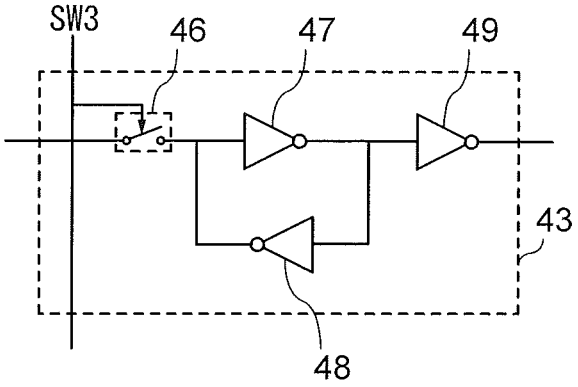

In the driving method of the display device shown in FIG. 2 and FIG. 3, data on the current characteristics is read out by sequentially performing scanning from the first row and selecting a row in which all the pixels are displayed in black. When such a driving method is employed, an output control circuit which controls a signal output from the driver circuit 11 is preferably provided. An example of a structure of the output control circuit is described with reference to FIGS. 11A and 11B. FIG. 11A shows the driver circuit 11, an output control circuit 14, and the pixel portion 15 of the display device. FIG. 11B shows an example of a structure of a latch circuit 43 shown in FIG. 11A.

The display device in FIG. 11A includes the output control circuit 14 between the driver circuit 11 and the pixel portion 15. The wiring SL_i electrically connected to the driver circuit 11 is branched into two circuits in the output control circuit 14, and one extends in the row direction via the latch circuit 43 and a switch 44, and the other extends in the row direction via a switch 45. The branched wirings SL_i are joined via the switch 44 and the switch 45, and extends to the pixel portion 15 in the row direction.

As shown in FIG. 11B, the latch circuit 43 includes a switch 46, an inverter 47, an inverter 48, and an inverter 49. One terminal of the switch 46 is electrically connected to the wiring SL_i and the other terminal is electrically connected to an input terminal of the inverter 47 and an output terminal of the inverter 48. An output terminal of the inverter 47 is electrically connected to an input terminal of the inverter 48 and an input terminal of the inverter 49. An output terminal of the inverter 49 is electrically connected to one terminal of the switch 44. The switch 46 is controlled by the wiring SW3 which extends in the column direction.

In a normal display mode, the switch 44 is turned off and the switch 45 is turned on, so that a signal is output from the driver circuit 11. When a row in which all the pixels are displayed in black is selected, the switch 44 is turned on and the switch 45 is turned off, whereby a signal is output from the driver circuit 11.

Furthermore, when the row in which all the pixels are displayed in black is selected in the blanking period, the switch 46 is turned on by the wiring SW3. Accordingly, in STEP1, a signal input to the wiring SL_i can be held in the latch circuit 43. Thus, when the wiring SL_i+1 is selected and the signal input to the wiring SL_i from the driver circuit 11 is stopped, the transistor 23 can be kept turned on by the signal held in the latch circuit 43 via the wiring SL_i.

In the display device in FIG. 11A, an example is illustrated in which a signal is output from the wiring SL via the output control circuit 14; however, the display device of this embodiment is not limited thereto. For example, a signal may be output from the wiring GL, in addition to the wiring SL, via the output control circuit 14.

In the display device of this embodiment, in the case of using the wiring GL, the above driving method can be used without holding a signal using the latch circuit 43; thus, a structure without the latch circuit 43 may be employed.

In the display device of this embodiment, the output control circuit 14 is not necessarily provided. For example, in the case where a signal of the driver circuit 11 can be selectively output to an arbitrary row by using a decoder or the like, the output control circuit 14 is not necessarily provided.

This embodiment shows an example of a basic principle. Thus, part or the whole of this embodiment can be freely combined with, applied to, or replaced with part or the whole of another embodiment.

Embodiment 2

<Modification Example 1 of Display Device>

In this embodiment, a structure of a display device and a driving method thereof which are different from those described in Embodiment 1 are described with reference to FIG. 12 and FIGS. 13A to 13C.

Figure 12:
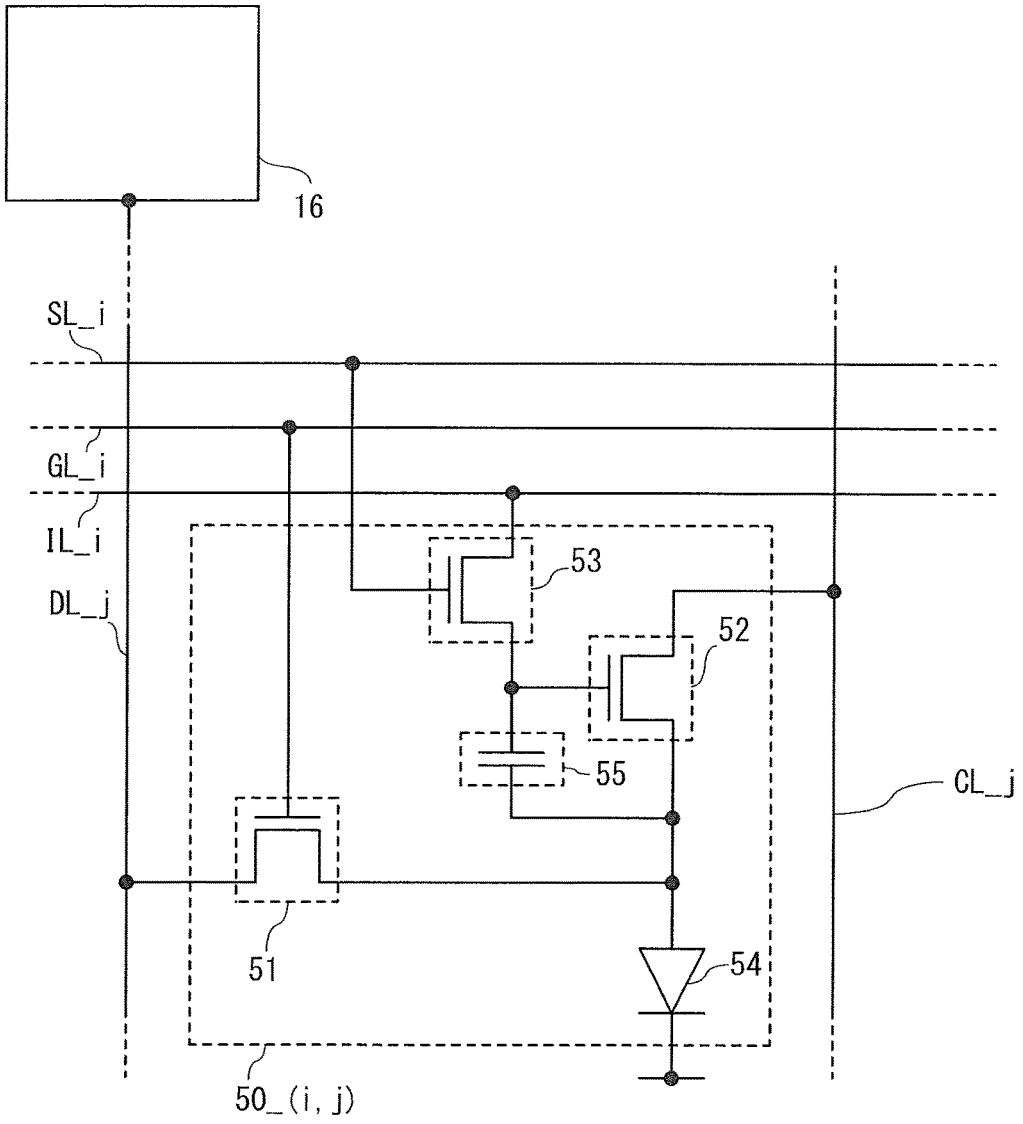
FIG. 12 is a circuit diagram illustrating one embodiment of the present invention.

FIG. 12 shows a pixel structure of the display device of this embodiment. The display device of this embodiment includes, as in the display device in FIG. 2, the pixel portion 15 including (m×n) pixels 50, a variety of peripheral circuits, and a variety of wirings. The same numerals and symbols are used for the peripheral circuits and the wirings.

Because the pixel structure is different from that in Embodiment 1, the structures of the peripheral circuit and the wiring are partly different from those in FIG. 2. Specifically, the different points are that the wiring IL extends in the row direction and the circuit portion 13 is electrically connected to the wiring DL. In that case, as shown in FIG. 4, switches may be provided so that the circuit portion 13 and the driver circuit 12 are brought into electrical contact with the wiring DL by switching the switches.

FIG. 12 shows a structure of a pixel 50_(*i*,*j*) in the i-th row and the j-th column (i is an integer greater than or equal to 1 and less than or equal to m, and j is an integer greater than or equal to 1 and less than or equal to n). The pixel 50_(*i*,*j*) includes a transistor 51, a transistor 52, a transistor 53, a light-emitting element 54, and a capacitor 55. Note that these elements included in the pixel 50_(*i*,*j*) are electrically connected to the wiring GL_i, the wiring SL_i, the wiring DL_j, the wiring CL_j, and a wiring IL_i. Note that in FIG. 12, the wiring CL extends in the column direction and the wiring IL extends in the column direction; however the embodiment of the this invention is not limited to this, and the directions of the wirings may be changed as appropriate.

A specific connection relation in the pixel 50_(*i*, *j*) is as follows. A gate electrode of the transistor 51 is electrically connected to the wiring GL_i, one of a source electrode and a drain electrode thereof is electrically connected to the wiring DL_j, the other of the source electrode and the drain electrode thereof is electrically connected to one electrode of the light-emitting element 54 (hereinafter also referred to as a pixel electrode). A gate electrode of the transistor 52 is electrically connected to one of a source electrode and a drain electrode of the transistor 53; one of a source electrode and a drain electrode thereof is electrically connected to the wiring CL_j; the other of the source electrode and the drain electrode thereof (hereinafter also referred to as a source electrode of the transistor 52) is electrically connected to one of electrodes of the light-emitting element 54. A gate electrode of the transistor 53 is electrically connected to the wiring SL_i and the other of the source electrode and the drain electrode thereof is electrically connected to the wiring IL_i. A common potential is supplied to the other of the electrodes (hereinafter also referred to as a common electrode) of the light-emitting element 54.

The wiring DL_j is electrically connected to the reading circuit 16 included in the circuit portion 13.

One of electrodes of the capacitor 55 is electrically connected to the one of the source electrode and the drain electrode of the transistor 53 and the gate electrode of the transistor 52, and the other electrode thereof is electrically connected to the other of the source electrode and the drain electrode of the transistor 52 and the other of the source electrode and the drain electrode of the transistor 51, and the pixel electrode of the light-emitting element 54. With the capacitor 55 provided as described above, more charge can be held in the gate electrode of the transistor 52, and a holding period of image data can be made longer.

Note that the capacitor 55 is not necessarily provided. For example, a high parasitic capacitance of the transistor 52 can be an alternative to the capacitor 55.

The wiring CL functions as a high potential power supply line which supplies current to the light-emitting element 54. Furthermore, the potential of the wiring IL may be changed in an analog manner.

Figure 14:
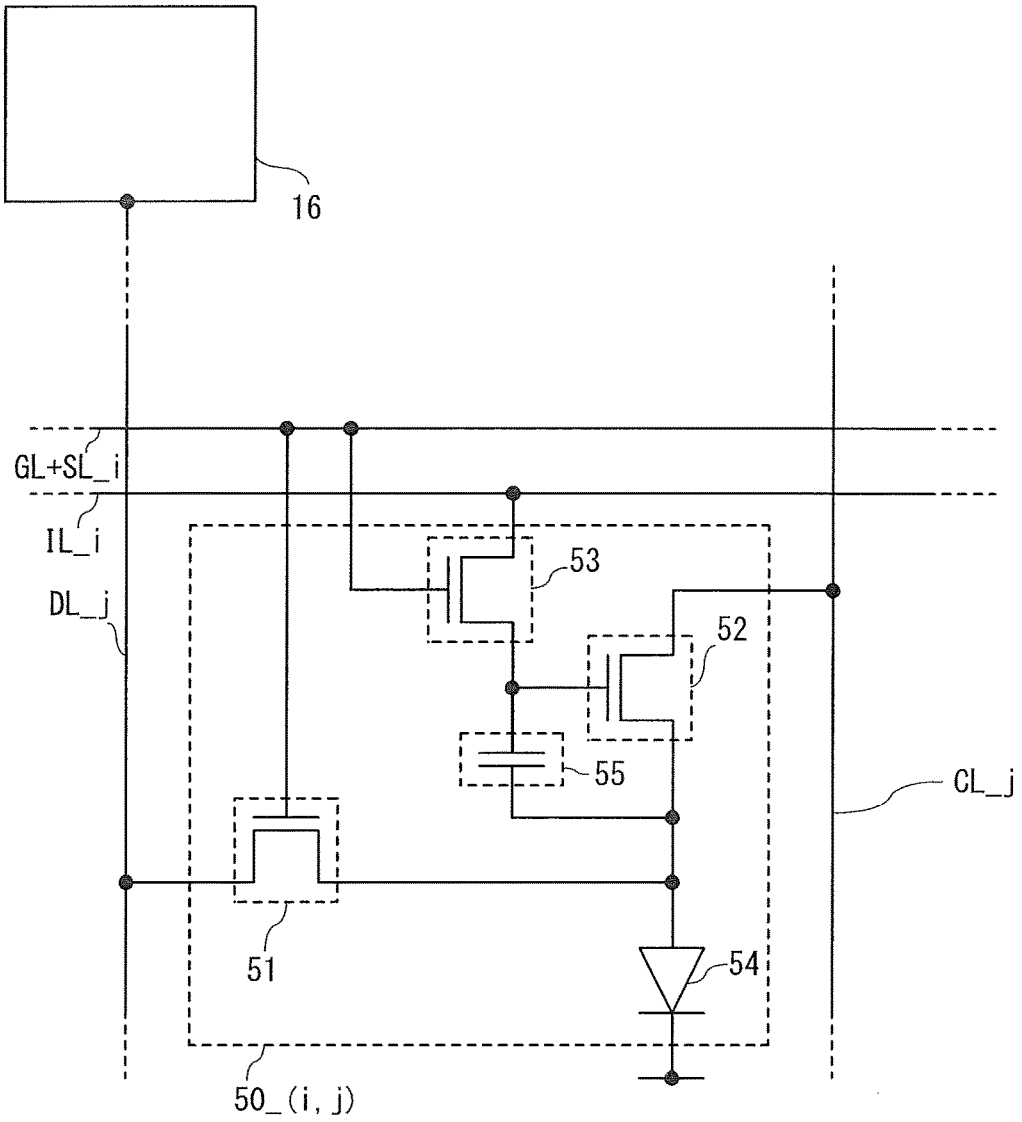
FIG. 14 is a circuit diagram illustrating one embodiment of the present invention.

Note that the wiring GL and the wiring SL may be combined into one wiring. FIG. 14 shows a circuit diagram in that case. In the case where the wiring GL and the wiring SL are combined into one wiring, the wiring acts similarly to the case where the wiring GL and the wiring SL are turned on/off at the same time. Thus, in the case where a driving method in which the wiring GL and the wiring SL are turned on/off at the same time is employed, the wiring GL and the wiring SL can be combined into one wiring.

Note that the description on the transistors 21 to 23 can be referred to for the structures of the transistors 51 to 53. Furthermore, the description on the light-emitting element 24 can be referred to for the structure of the light-emitting element 54.

In this embodiment, the wiring DL is electrically connected to the reading circuit 16 and the driver circuit 12. A connection relation of the wiring DL_j, the reading circuit 16, and the driver circuit 12 is described with reference to FIG. 13A.

Figure 13A:
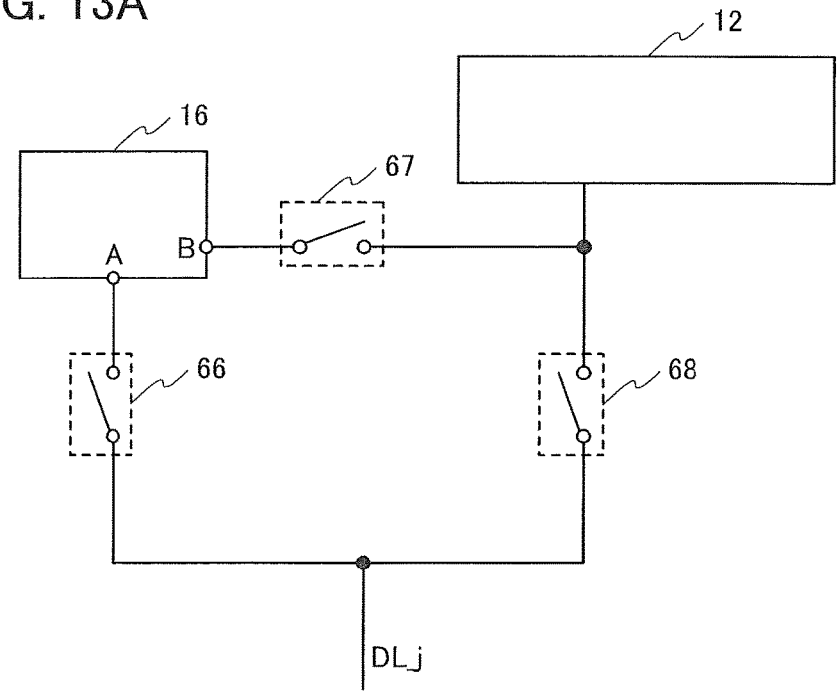
FIGS. 13A to 13C are circuit diagrams illustrating one embodiment of the present invention.

As shown in FIG. 13A, the wiring DL_j is electrically connected to a terminal A of the reading circuit 16 via the switch 66 and is electrically connected to the driver circuit 12 via the switch 68. Furthermore, a terminal B of the reading circuit 16 is electrically connected to the driver circuit 12 via the switch 67.

In a normal display mode, the switch 68 is turned on and the switches 66 and 67 are turned off, whereby a video signal is output from the driver circuit 12 to the wiring DL_j.

In the blanking period, the switches 66 and 67 are turned on and the switch 68 is turned off, whereby a reading signal is output from the driver circuit 12 to the wiring DL_j via the reading circuit 16.

Figure 13B:
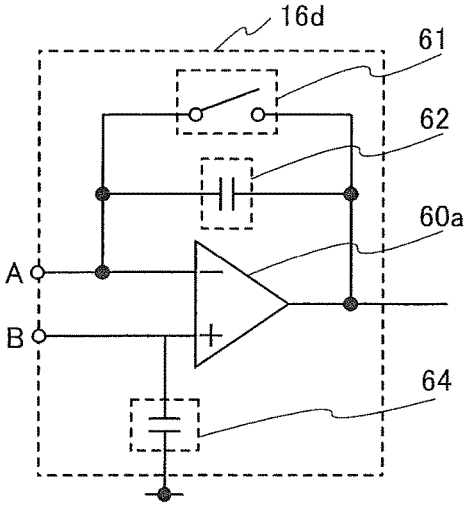

Next, a specific structure example of the reading circuit 16 is described with reference to the circuit diagrams in FIGS. 13B and 13C A reading circuit 16*d* in FIG. 13B includes an operational amplifier 60*a*, a switch 61, and capacitors 62 and 64. A plus input terminal of the operational amplifier 60*a* is electrically connected to one electrode of the capacitor 64, a minus input terminal thereof is electrically connected to one terminal of the switch 61 and one electrode of the capacitor 62, and an output terminal thereof is electrically connected to the other terminal of the switch 61 and the other electrode of the capacitor 62. The minus input terminal of the operational amplifier 60*a* functions as a terminal A of the reading circuit 16*d*, and the plus input terminal of the operational amplifier 60*a* functions as a terminal B of the reading circuit 16*d*. A constant potential such as a ground potential or a low voltage power supply potential is supplied to the other electrode of the capacitor 64. The operational amplifier 60*a* operates so that the potential of the plus input terminal and the potential of the minus input terminal are equal to each other. Thus, the potential of the minus input terminal of the operational amplifier 60*a*; that is, the potential of the wiring DL_j can be controlled by the potential of the plus input terminal of the operational amplifier 60*a*.

In the blanking period, the reading signal output from the driver circuit 12 is output to the wiring DL_j via the operational amplifier 60*a*. The reading signal can be held with the switch 67 turned off since the capacitor 64 is provided. Note that the switch 67 and the capacitor 64 are not necessarily provided. For example, if the reading signal continues to be output from the driver circuit 12, the switch 67 and the capacitor 64 are not necessarily provided.

With such a structure, a current integral value of the wiring DL_j can be read out by the reading circuit 16*d*.

Figure 13C:
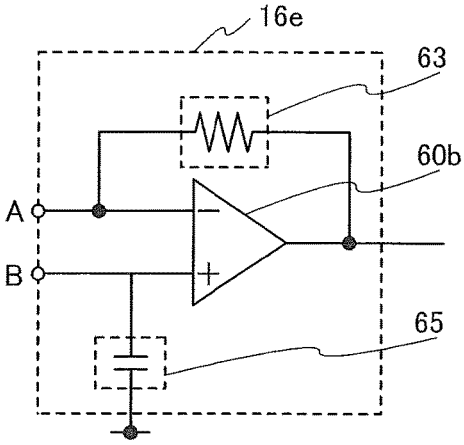

A reading circuit 16*e* in FIG. 13C includes an operational amplifier 60*b*, a resistor 63, and a capacitor 65. A plus input terminal of the operational amplifier 60*b* is electrically connected to one electrode of the capacitor 65, a minus input terminal thereof is electrically connected to one electrode of the resistor 63, and an output terminal thereof is electrically connected to the other electrode of the resistor 63. The minus input terminal of the operational amplifier 60*b* functions as a terminal A of the reading circuit 16*e*, and the plus input terminal of the operational amplifier 60*a* functions as a terminal B of the reading circuit 16*e*. A constant potential such as a ground potential or a low voltage power supply potential is supplied to the other electrode of the capacitor 65. The operational amplifier 60*b* operates so that the potential of the plus input terminal and the potential of the minus input terminal are equal to each other. Thus, the potential of the minus input terminal of the operational amplifier 60*a*; that is, the potential of the wiring DL_j can be controlled by the potential of the plus input terminal.

The reading signal output from the driver circuit 12 in the blanking period is output to the wiring DL_j via the operational amplifier 60*b*. The reading signal can be held with the switch 67 turned off since the capacitor 65 is provided. Note that the switch 67 and the capacitor 65 are not necessarily provided. For example, if the reading signal continues to be output from the driver circuit 12, the switch 67 and the capacitor 65 are not necessarily provided.

With such a structure, the reading circuit 16*e* converts the current value of the wiring DL_j into a voltage value to be read out.

As an example of the driving method of the display device having the pixel structure shown in FIG. 12, operation of the display device in the address period is described with reference to FIGS. 1A and 1B.

First, the wiring GL_i and the wiring SL_i are selected, so that a voltage between the wiring IL_i and the wiring DL_j is input to the capacitor 55, i.e., between the gate and the source of the transistor 52. At this time, the potential of the wiring DL_j changes in accordance with a video signal.

At that time, the wiring DL_j has a potential such that the light-emitting element 54 does not emit light regardless of the video signal. For example, the potential of the wiring DL_j is equal to the potential of the cathode of the light-emitting element 54 even in the case of the highest potential.

The potential of the wiring IL_i becomes lower since the potential of the wiring DL_j is low. For example, the potential of the wiring IL_i is lower than that of the wiring CL_j.

Note that it is not necessary that the wiring GL_i and the wiring SL_i be selected at the same time.

The wiring GL_i and the wiring SL_i are not selected, so that current corresponding to the voltage between the gate and the source of the transistor 52 is supplied from the transistor 52 to the light-emitting element 54, and display operation is performed.

Note that that it is not necessary that the wiring GL_i and the wiring SL_i be not selected at the same time.

Such operation is sequentially performed while each row is selected and scanned. Thus, operation of the address period is terminated.

As an example of the driving method of the display device having the pixel structure shown in FIG. 12, a method for correcting variation in current characteristics in the blanking period is described with reference to FIGS. 1A and 1B. Note that explanation is made on the case where all the pixels 50 in the i-th row are displayed in black.

When the blanking period starts, as shown in FIG. 1A, scanning is sequentially performed row by row from the first row to the m-th row. However, the pixels in the rows other than the target row are not selected. That is, the selection signal is not supplied to the rows other than the target row, and the non-selection signal is supplied thereto.

First, STEP 1 in which the row in which all the pixels are displayed in black is selected and a reading signal is input thereto is described. When the pixels in the i-th row are selected, a selection signal is input to the wiring SL_i, and the transistor 53 is turned on. When the transistor 53 is turned on, the wiring IL_i and the gate electrode of the transistor 52 are brought into electrical contact with each other, and the potential of the wiring IL_i is supplied to the gate electrode of the transistor 52.

After that, or at the same time, the selection signal is input to the wiring GL_i, and the transistor 51 is turned on. When the transistor 51 is turned on, the wiring DL_j and the source electrode of the transistor 52 are brought into electrical contact with each other. Here, the reading signal is supplied to the wiring DL_j, so that the potential difference between the gate and the source of the transistor 52 is larger than the threshold voltage of the transistor 52, and the transistor 52 can be turned on.

At that time, the potential of the wiring DL_j is preferably lower than the common potential, or at the same level as the common potential. The potential of the wiring DL_j is set as described above, so that reverse bias is applied to the light-emitting element 54 or bias is not applied to the light-emitting element 54. Thus, the black display state of the pixels in the i-th row can be maintained. Furthermore, even if forward bias is applied to the light-emitting element 54 so that the black display state of the pixels in the i-th row can be maintained at least until STEP 3, the potential difference between the wiring DL_j and the common potential can be suppressed to extremely small. The extremely small potential difference is preferably approximately several volts, for example, 2 volts or lower, further preferably 1 volt or lower. The current flowing into the transistor 52 does not flow into the light-emitting element 54, and becomes ready to flow into the wiring DL_j.

The signal with which the transistor 51 is kept turned off is input to the wiring GL so that the reading signal is not input to the rows other than the i-th row.

Next, STEP 2 in which data on current characteristics of the transistor 52 (driving transistor) is read out described. After STEP1, scanning shifts from the i-th row to the (i+1)th row, and the supply of the selection signal that has been input to the wiring SL_i is stopped, and the transistor 53 is turned off. Thus, the potential that has been input to the gate electrode of the transistor 52 in STEP1 is maintained.

In contrast, the transistor 51 needs to be turned on during STEP 2. Thus, similarly to STEP 1, the signal which makes the transistor 51 in an on state needs to be continuously input to the wiring GL_i also in STEP 2. For example, a latch circuit is connected to the wiring GL so that the input signal at the time of STEP 1 is held also in STEP 2.

In the case where a decoder circuit and the like is used in the gate line driver circuit, the selection signal can be continued to be supplied to the wiring GL_i, even without connection of a latch circuit and the like to the wiring GL, by controlling a signal input to the decoder circuit.

The transistor 53 is turned off, and the transistors 51 and 52 are turned on in such a manner, so that the wiring CL_j and the reading circuit 16 are brought into electrical contact with each other via the transistor 52 and the transistor 51. In accordance with the voltage of the reading signal supplied to the transistor 52, current flows into the wiring DL_j and the reading circuit 16 from the transistor 52. Thus, data on the current characteristics of the transistor 52 in the pixel 50_(*i*, *j*) can be read out by the reading circuit 16.

Also during STEP 2, the transistor 53 may remain in an on state. In that case, for example, the potential which makes the transistor 52 turn on is once supplied to the wiring DL_j. After that, the wiring DL_j may be in a floating state. Consequently, the potential of the wiring DL_j is gradually increased. Then, when the potential is set to the level at which the transistor 52 is turned off, that is, when the gate-source voltage of the transistor 52 is close to the threshold voltage of the transistor 52, the transistor 52 is turned off. As a result, a rise of the potential of the wiring DL_j is stopped. The potential of the wiring IL_i at that time, that is the potential of a source terminal of the transistor 52 may be read out by the reading circuit 16. Consequently, the threshold voltage of the transistor 52 can be read out. Note that in the case where the potential of the source terminal of the transistor 52 is read out, the potential just before the transistor 52 is turned off may be read out.

As the data on the current characteristics of the transistor 52, any data on variation in the current characteristics of the transistors 52 among pixels may be taken. For example, it may be the current value of the transistor 52, or may be the threshold voltage of the transistor 52.

Next, STEP 3 in which a signal for black display is input to the selected row so as to obtain black display is described. The reading signal input in STEP1 is a signal that turns on the transistor 52. When the transistor 51 is turned off with this signal input, forward bias is applied to the light-emitting element 54, which causes a light-emitting state of the light-emitting element 54.

To prevent this, scanning is sequentially performed row by row from the first row to the m-th row. However, the pixels in the rows other than the target row are not selected. That is, the selection signal is not supplied to the pixels in the rows other than the target row, and the non-selection signal is supplied thereto. When the wiring GL_i that is the target row is selected, the signal for black display, which makes the transistor turned off is input to the wiring DL_j. The signal is supplied to the source electrode of the transistor 52, so that the potential difference between the gate and the source of the transistor 52 is smaller than the threshold voltage of the transistor 52, and the transistor 52 can be turned off.

Note that at that time, a selection signal to turn on the transistor 53 is supplied to the wiring SL_i. As a result, a voltage which makes the transistor 52 turn off can be supplied between the gate and the source of the transistor 52.

As described above, the non-light-emitting state of the pixels 50 in the i-th row from STEP 3 to scanning of pixels in the next frame can be maintained.

As shown in FIG. 1A, after STEP 3, the display device in FIG. 2 terminates one frame period and starts display of the next frame. Here, in accordance with the data on the current characteristics of the transistors 52 that has been read out in STEP 2, a video signal for correcting the variation in the current characteristics of the transistors 52 can be produced and input to a corresponding pixel. As a result, variation in transistors or adverse effects of deterioration can be reduced.

Note that in the case where there are a plurality of rows in each of which all the pixels are displayed in black, other than the i-th row, as shown in FIG. 1B, STEP 1 and STEP 2 may be repeatedly performed in the blanking period. Alternatively, in one frame period, STEP 1 to STEP 3 may be performed on only one of the rows as a target. For the other rows, STEP 1 to STEP 3 may be performed in the next or later frame period.

As for a row in which all the pixels have never been displayed in black since the display of image was started, for example, it is preferable that data on the current characteristics of the driving transistors 52 in that row be read out on the occasion of turning off the power of the display device.

The variation in current characteristics of the driving transistors among pixels of the display device of this embodiment can be corrected by the above-described driving method. In this driving method, the variation in current characteristics of the driving transistors can be corrected in parallel with the display operation of the display device.

Figure 15A:
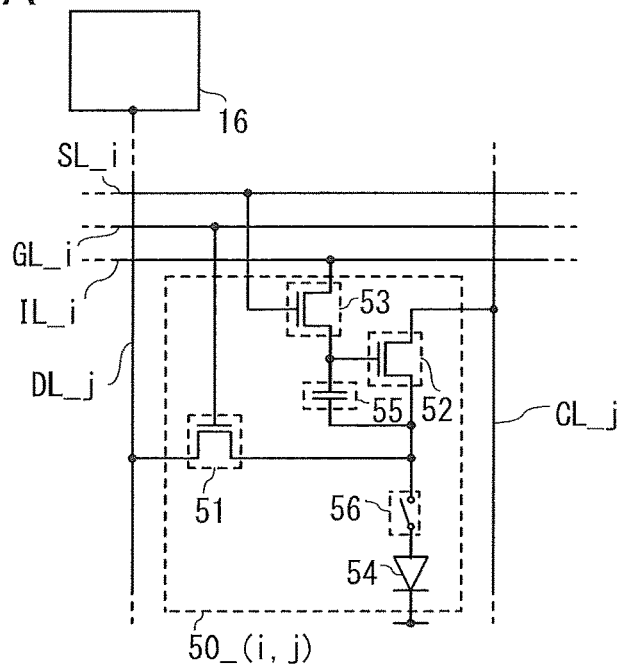
FIGS. 15A and 15B are circuit diagrams each illustrating one embodiment of the present invention.
Figure 15B:
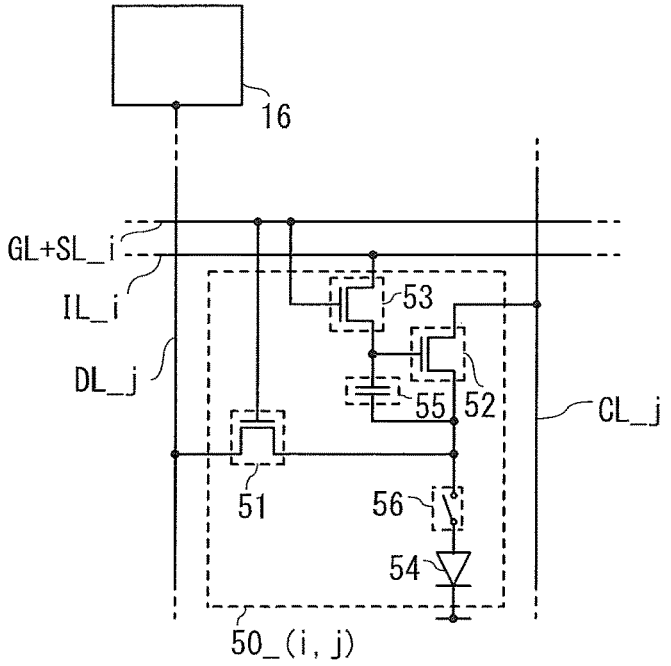

The pixel structure of the display device of this embodiment is not limited to that shown in FIG. 12. For example, in the pixel 50_(*i*,*j*) in FIG. 12, a switch 56 may be provided between the light-emitting element 54 and the transistor 52. FIGS. 15A and 15B show circuit diagrams in that case. FIG. 15A shows the case where the switch 56 is provided in the structure of FIG. 12, and FIG. 15B shows the case where the switch 56 is provided in the structure of FIG. 14. The switch 56 is turned off during STEP 1 and STEP 2, so that the non-light-emitting state of the light-emitting element 54 can be surely maintained in STEP 1 and STEP 2.

This embodiment is obtained by performing change, addition, modification, removal, application, superordinate conceptualization, or subordinate conceptualization on part or the whole of another embodiment. Thus, part or the whole of this embodiment can be freely combined with, applied to, or replaced with part or the whole of another embodiment.

Embodiment 3

<Modification Example 2 of Display Device>

In this embodiment, a structure of a display device and a driving method thereof which are different from those described in Embodiment 1 are described with reference to FIG. 16 and FIG. 17.

Figure 16:
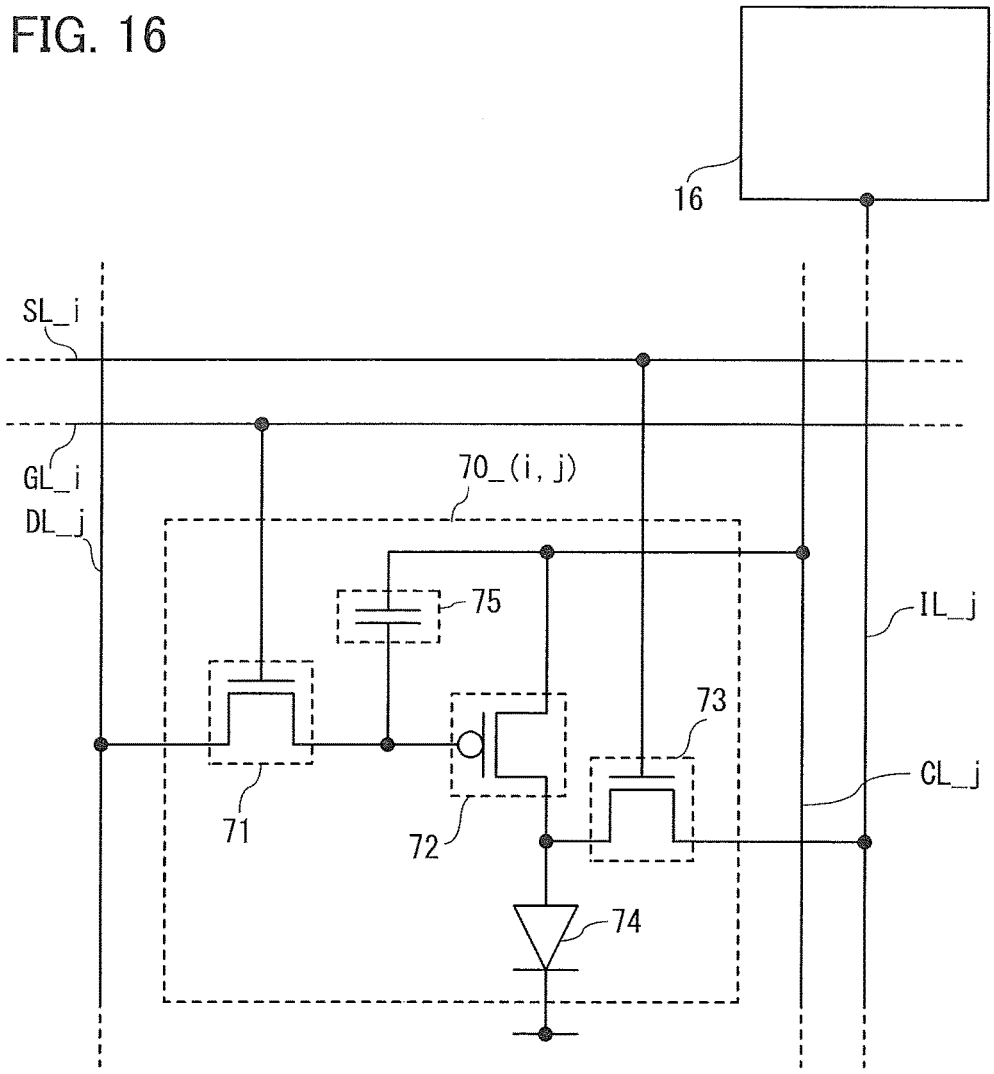
FIG. 16 is a circuit diagram illustrating one embodiment of the present invention.

FIG. 16 shows a pixel structure of the display device of this embodiment. The display device of this embodiment includes, as in the display device in FIG. 2, the pixel portion 15 including (m×n) pixels 70, a variety of peripheral circuits, and a variety of wirings. The same numerals and symbols are used for the peripheral circuits and the wirings.

FIG. 16 shows a structure of a pixel 70_(*i*,*j*) in the i-th row and the j-th column (i is an integer greater than or equal to 1 and less than or equal to m and j is an integer greater than or equal to 1 and less than or equal to n). The pixel 70_(*i*, *j*) includes a transistor 71, a p-channel transistor 72, a transistor 73, a light-emitting element 74, and a capacitor 75. Note that these elements included in the pixel 70_(*i*,*j*) are electrically connected to the wiring GL_i, the wiring SL_i, the wiring DL_j, the wiring CL_j, and the wiring IL_j.

A specific connection relation in the pixel 70_(*i*, *j*) is as follows. A gate electrode of the transistor 71 is electrically connected to the wiring GL_i, one of a source electrode and a drain electrode thereof is electrically connected to the wiring DL_j, the other of the source electrode and the drain electrode thereof is electrically connected to a gate electrode of the transistor 72. One of a source electrode and a drain electrode of the transistor 72 is electrically connected to one of a source electrode and a drain electrode of the transistor 73 and one electrode of the light-emitting element 74 (hereinafter also referred to as a pixel electrode), and the other of the source electrode and the drain electrode thereof (hereinafter also referred to as a source electrode of the transistor 72) is electrically connected to the wiring CL_j. A gate electrode of the transistor 73 is electrically connected to the wiring SL_i, and the other of the source electrode and the drain electrode thereof is electrically connected to the wiring IL_j. A common potential is supplied to the other electrode (also referred to as a common electrode) of the light-emitting element 74.

The wiring IL_j is electrically connected to the reading circuit 16 included in the circuit portion 13.

One of electrodes of the capacitor 75 is electrically connected to the one of the source electrode and the drain electrode of the transistor 71 and the gate electrode of the transistor 72, and the other electrode thereof is electrically connected to the other of the source electrode and the drain electrode of the transistor 72. With the capacitor 75 provided as described above, more charge can be held in the gate electrode of the transistor 72, and a holding period of image data can be made longer.

Note that the capacitor 75 is not necessarily provided. For example, a high parasitic capacitance of the transistor 72 can be an alternative to the capacitor 75.

Note that the description on the transistors 21 to 23 can be referred to for the structures of the transistors 71 to 73. Furthermore, the description on the light-emitting element 24 can be referred to for the structure of the light-emitting element 74.

The pixel structure in FIG. 16 is different from the pixel structure in FIG. 3 in the use of a p-channel transistor for the transistor 72 and accordingly in a connection relation of the capacitor 75. The driving method of the display device described in Embodiment 1 can be referred to for the driving method of the display device in FIG. 16, considering a potential of the transistor 72 which is opposite to a potential of the transistor 22.

Figure 17:
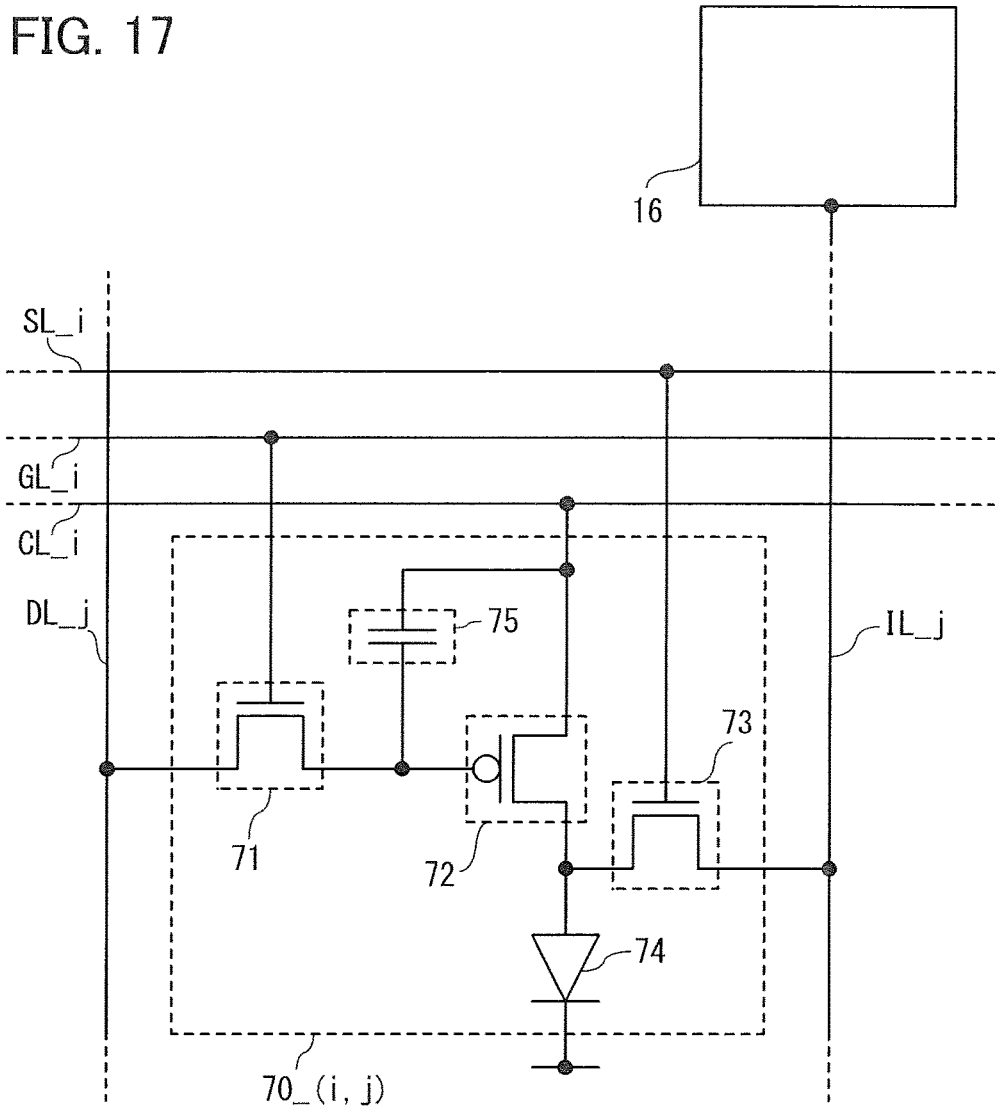
FIG. 17 is a circuit diagram illustrating one embodiment of the present invention.

FIG. 17 shows a pixel structure that is different from that in FIG. 16. The pixel structure in FIG. 17 is different from that in FIG. 16 in that the wiring CL extends in the row direction, and other structures are similar.

Here, the potential of the wiring CL may be changed in an analog manner, so that the potential of the wiring CL can be adjusted in accordance with the changes in the potentials of the wiring GL and the wiring SL. For example, in STEP 1 and STEP 2 in FIG. 1B, the potential of the wiring CL_j can be lower than the common potential, or at the same level as the common potential. The potential of the wiring CL_j is set as described above, so that reverse bias is applied to the light-emitting element 74 or bias is not applied to the light-emitting element 74. Thus, the black display state of the pixels in the i-th row can be maintained. Furthermore, even if forward bias is applied to the light-emitting element 74 so that the black display state of the pixels in the i-th row can be maintained at least until STEP 3, the potential difference between the wiring CL_j and the common potential can be suppressed to extremely small. The extremely small potential difference is preferably a potential difference of approximately several volts, for example, 2 volts or lower, further preferably 1 volt or lower.

The variation in current characteristics of the driving transistor among pixels of the display device can be corrected by the above-described driving method. In this driving method, the variation in current characteristics of the driving transistors can be corrected in parallel with the display operation of the display device.

Figure 18:
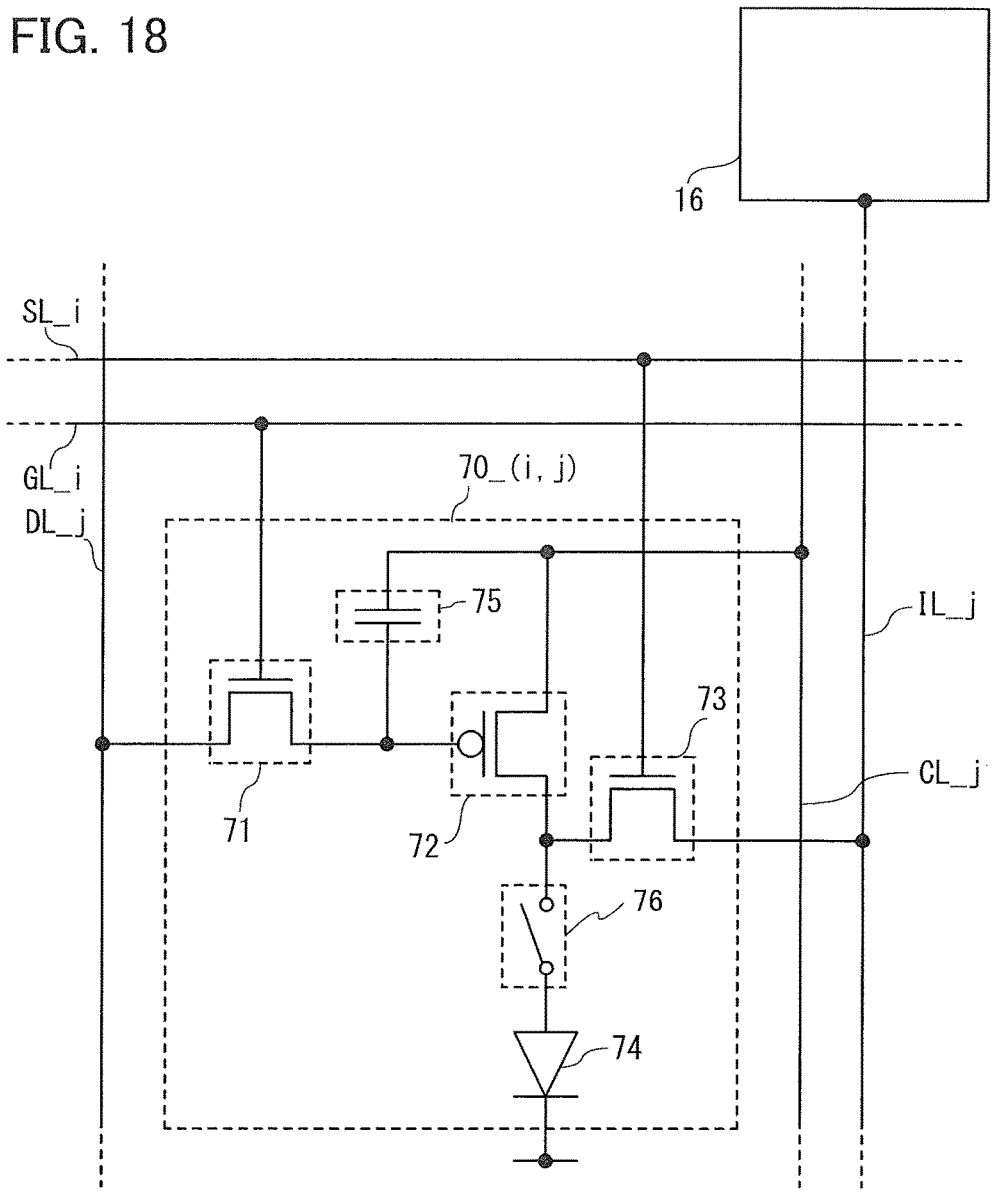
FIG. 18 is a circuit diagram illustrating one embodiment of the present invention.
Figure 19:
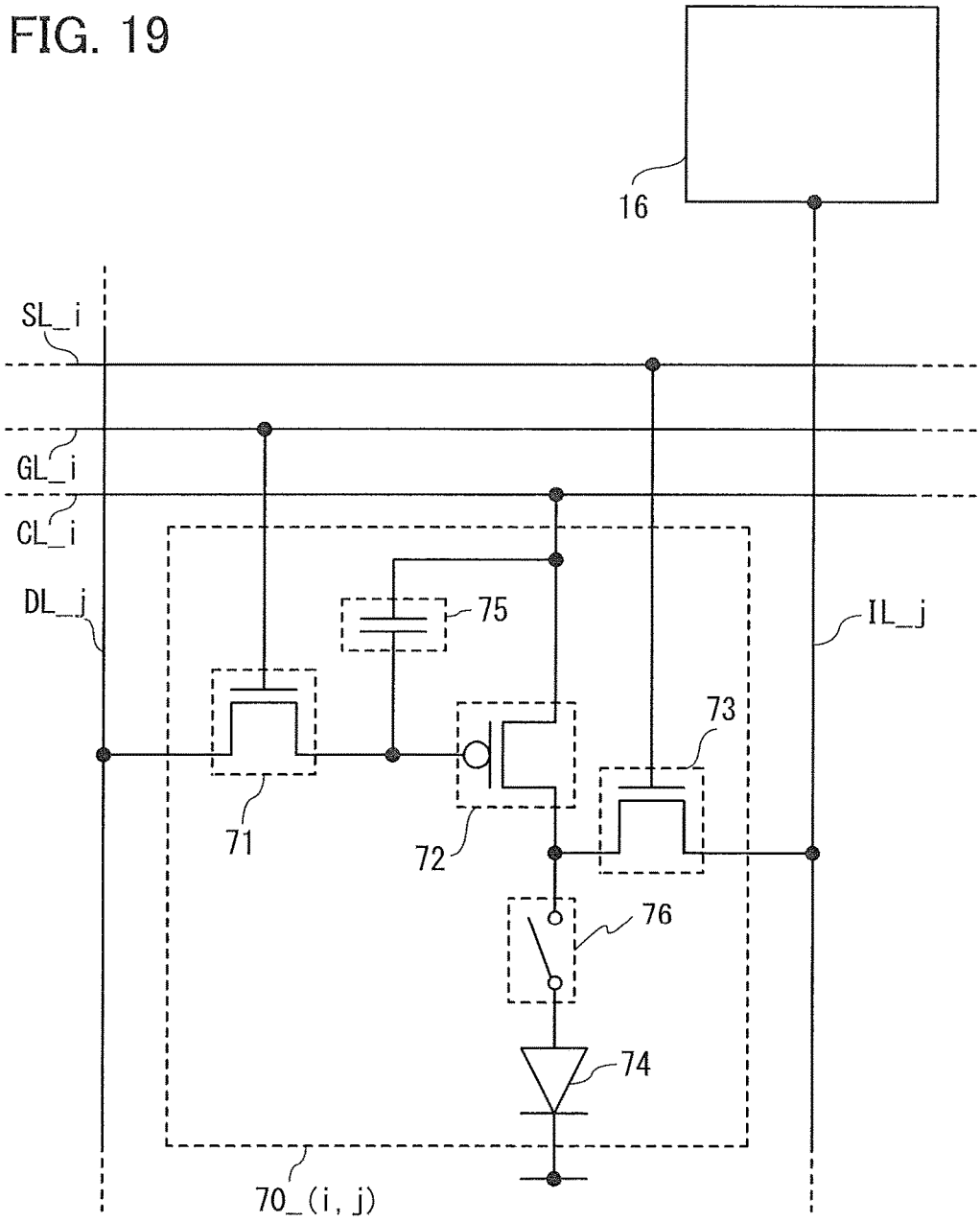
FIG. 19 is a circuit diagram illustrating one embodiment of the present invention.

The pixel structure of the display device of this embodiment is not limited to that shown in FIG. 16 and FIG. 17. For example, in the pixel 70_(*i*,*j*), a switch 76 may be provided between the light-emitting element 74 and the transistor 72. FIG. 18 and FIG. 19 show the circuit diagrams in that case. FIG. 18 shows the case where the switch 76 is provided in the structure of FIG. 16, and FIG. 19 shows the case where the switch 76 is provided in the structure of FIG. 17. The switch 76 is set to be off during STEP 1 and STEP 2, so that the non-light-emitting state of the light-emitting element 74 can be surely maintained in STEP 1 and STEP 2.

This embodiment is obtained by performing change, addition, modification, removal, application, superordinate conceptualization, or subordinate conceptualization on part or the whole of another embodiment. Thus, part or the whole of this embodiment can be freely combined with, applied to, or replaced with part or the whole of another embodiment.

Embodiment 4

<Specific Structure Example of Display Device>

Figure 20:
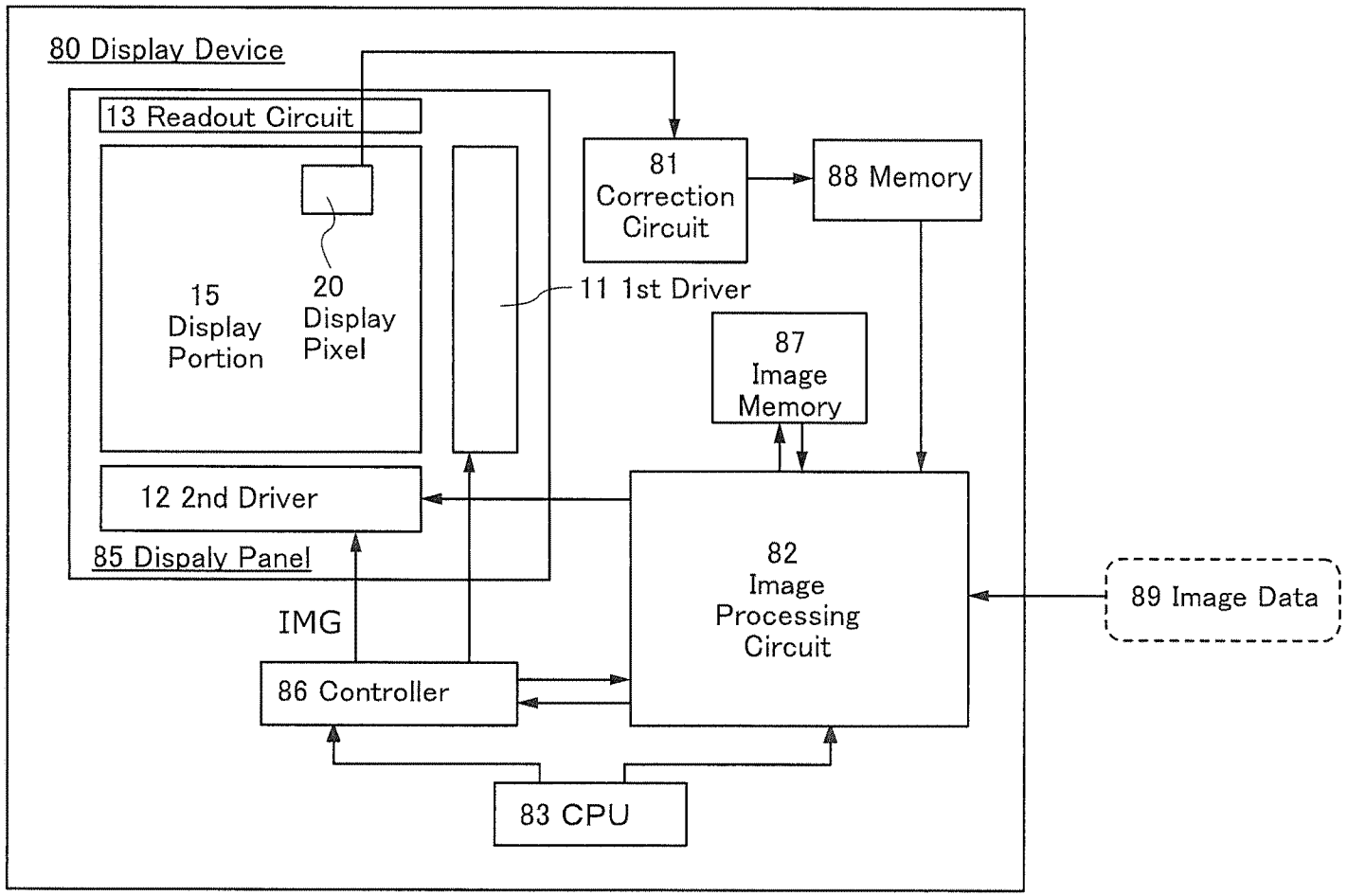
FIG. 20 is a block diagram illustrating one embodiment of the present invention.

An example of a structure of a display device is described. FIG. 20 shows a block diagram of a structure of a display device 80. Although the block diagram shows elements classified according to their functions in independent blocks, it may be practically difficult to separate the elements according to their functions and, in some cases, one element may be involved in a plurality of functions The display device 80 illustrated in FIG. 20 includes a panel 85 including the plurality of pixels 20 in the pixel portion 15, a controller 86, a CPU 83, an image processing circuit 82, an image memory 87, a memory 88, and a correction circuit 81. Furthermore, the panel 85 includes the driver circuit 11, the driver circuit 12, and the circuit portion 13. Note that description in the above embodiments can be referred to for the driver circuit 11, the driver circuit 12, the circuit portion 13, the pixel portion 15, and the pixel 20.

The CPU 83 is configured to decode an instruction input from the outside or an instruction stored in a memory provided in the CPU 83 and executing the instruction by controlling the overall operations of various circuits included in the display device 80.

By the method described in Embodiment 1, the correction circuit 81 generates data for correcting current characteristics on the basis of data on current characteristics of a driving transistor included in each of the display pixel. The memory 88 is configured to store data for correcting current characteristics.

The image memory 87 is configured to store image data 89 which is input to the display device 80. Note that although just one image memory 87 is provided in the display device 80 in FIG. 20, a plurality of image memories 87 may be provided in the display device 80. For example, in the case where the pixel portion 15 displays a full-color image with the use of three pieces of image data 89 corresponding to hues such as red, blue, and green, the image memory 87 corresponding to each of the pieces of image data 89 may be provided.

As the image memory 87, for example, a memory circuit such as a dynamic random access memory (DRAM) or a static random access memory (SRAM) can be used. Alternatively, as the image memories 87, video RAMs (VRAMs) may be used.

The image processing circuit 82 is configured to write and read the image data 89 to and from the image memory 87 in response to an instruction from the CPU 83 and to generate a video signal from the image data 89. In addition, the image processing circuit 82 is configured to read the data stored in the memory 88 in response to an instruction from the CPU 83 and to correct the video signal using the data.

The controller 86 is configured to process the video signal in accordance with the specification of the panel 85 and then to supply the processed video signal to the panel 85.

Note that the controller 86 is configured to supply various driving signals used for driving the driver circuit 12, the driver circuit 11, and the like to the panel 85. The driving signal includes a start pulse signal SSP and a clock signal SCK for controlling operation of the driver circuit 12, a latch signal LP, a start pulse GSP and a clock signal GCK for controlling operation of the driver circuit 11, and the like.

Note that display device 80 may include an input device which is configured to give data or an instruction to the CPU 83 included in the display device 80. As the input device, a keyboard, a pointing device, a touch panel, a sensor, or the like can be used.

<Structure Example 1 of Transistor>

In FIGS. 21A and 21B and FIGS. 26A and 26B, transistors each having a top-gate structure are shown as examples of transistors included in a display device.

Figure 21A:
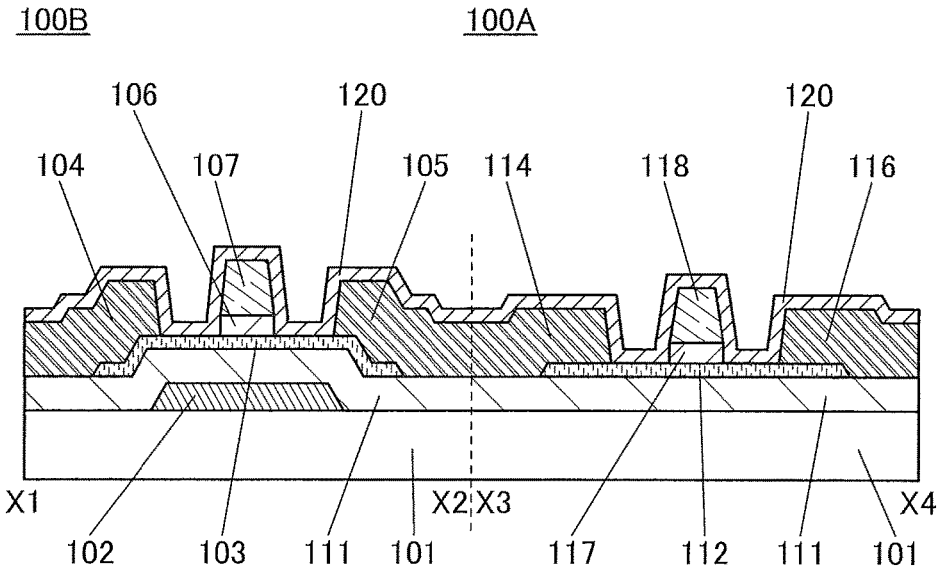
FIGS. 21A and 21B are cross-sectional views illustrating one embodiment of the present invention.
Figure 21B:
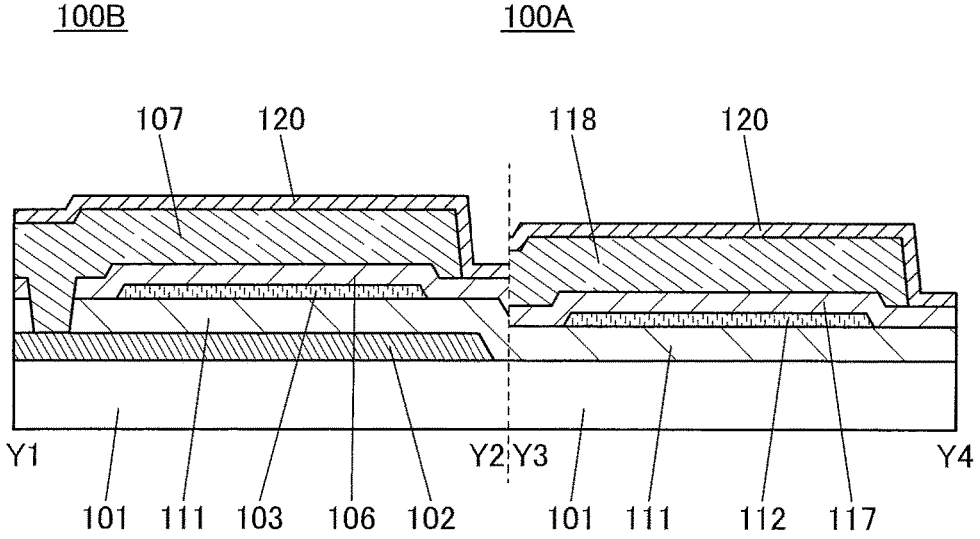
Figure 26A:
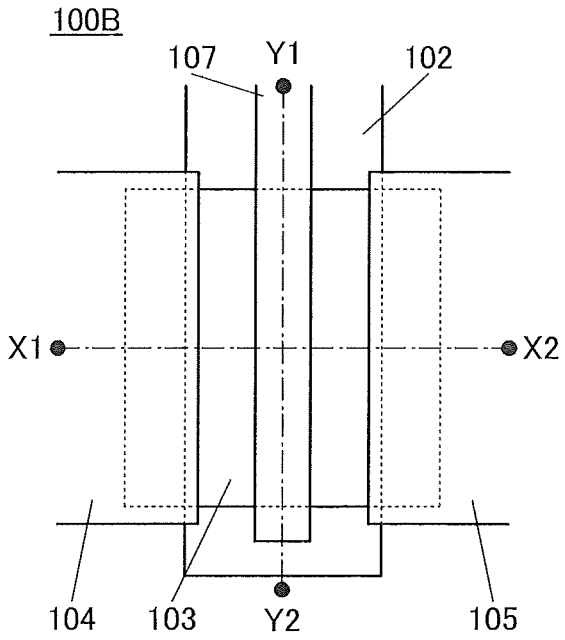
FIGS. 26A and 26B are top views illustrating one embodiment of the present invention.
Figure 26B:
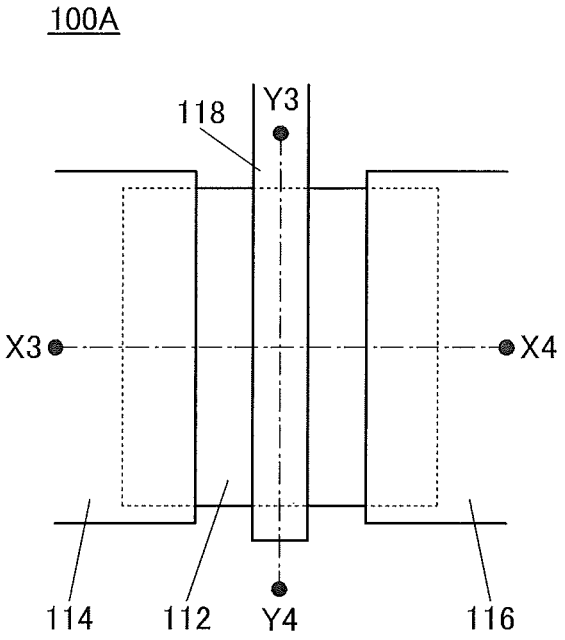

FIGS. 26A and 26B are top views of a transistor 100B provided in the driver circuit and a transistor 100A provided in the pixel portion 15. FIGS. 21A and 21B are cross sectional views of the transistor 100B and the transistor 100A. FIG. 26A is the top view of the transistor 100B and FIG. 26B is the top view of the transistor 100A. FIG. 21A shows a cross section along the dashed-dotted line X1-X2 in FIG. 26A and a cross section along the dashed-dotted line X3-X4 in FIG. 26B. FIG. 21B shows a cross section along the dashed-dotted line Y1-Y2 in FIG. 26A and a cross section along the dashed-dotted line Y3-Y4 in FIG. 26B. FIG. 21A shows a cross-sectional view of the transistors 100A and 100B in a channel length direction, and FIG. 21B shows a cross-sectional view of the transistors 100A and 100B in a channel width direction.

In a manner similar to that of the transistors 100A and 100B, some components are not illustrated in some cases in top views of transistors described below. Furthermore, the directions of the dashed-dotted line X1-X2 and the dashed-dotted line X3-X4 may be called a channel length direction, and the direction of the dashed-dotted line Y1-Y2 and the dashed-dotted line Y3-Y4 may be called a channel width direction.

The transistor 100A illustrated in FIGS. 21A and 21B includes an oxide semiconductor film 112 over an insulating film 111 over a substrate 101; a conductive film 114, a conductive film 116, and an insulating film 117 that are in contact with the oxide semiconductor film 112; and a conductive film 118 that overlaps with the oxide semiconductor film 112 with the insulating film 117 placed therebetween. Note that an insulating film 120 is provided over the transistor 100A.

The transistor 100B illustrated in FIGS. 21A and 21B includes an oxide semiconductor film 103 over the insulating film 111 over the substrate 101; a conductive film 104, a conductive film 105, and an insulating film 106 that are in contact with the oxide semiconductor film 103; and a conductive film 107 that overlaps with the oxide semiconductor film 103 with the insulating film 106 placed therebetween. The insulating film 120 is provided over the transistor 100B.

The transistor 100B includes a conductive film 102 that overlaps with the oxide semiconductor film 103 with the insulating film 111 placed therebetween. That is, the conductive film 102 serves as a gate electrode. Furthermore, the transistor 100B is a transistor having a dual-gate structure. The other components of the transistor 100B are the same as those of the transistor 100A and have similar functions as those in the transistor 100A.

The conductive film 102 and the conductive film 107 are supplied with different potentials, whereby the threshold voltage of the transistor 100B can be controlled. Alternatively, as illustrated in FIG. 21B, the conductive film 102 and the conductive film 107 are supplied with the same potential, whereby an increase in the on-state current, a reduction in variation in initial characteristics, a reduction in deterioration in a negative gate bias temperature (−GBT) stress test, and suppression in changes in the rising voltage of on-state current at different drain voltages are possible.

In the display device, the transistor in the driver circuit portion (e.g., the driver circuit 11, the driver circuit 12, or the like) and the transistor in the pixel portion 15 have different structures. The transistor included in the driver circuit portion has a dual-gate structure. That is, the transistor included in the driver circuit portion has a higher on-state current than that included in the pixel portion 15.

Furthermore, the transistor in the driver circuit portion and the transistor in the pixel portion 15 may have different channel lengths.

Typically, the channel length of the transistor 100B included in the driver circuit portion can be less than 2.5 μm, or greater than or equal to 1.45 μm and less than or equal to 2.2 μm. The channel length of the transistor 100A included in the pixel portion 15 can be greater than or equal to 2.5 μm, or greater than or equal to 2.5 μm and less than or equal to 20 μm.

When the channel length of the transistor 100B included in the driver circuit portion is less than 2.5 μm, preferably greater than or equal to 1.45 μm and less than or equal to 2.2 μm, as compared with the transistor 100A included in the pixel portion 15, the amount of on-state current can be increased. As a result, a driver circuit portion that can operate at high speed can be formed.

In the oxide semiconductor film 112, an element that forms an oxygen vacancy is included in a region that does not overlap with the conductive film 114, the conductive film 116, and the conductive film 118. In the oxide semiconductor film 103, an element that forms an oxygen vacancy is included in a region that does not overlap with the conductive film 104, the conductive film 105, and the conductive film 107. Hereinafter, the elements which form oxygen vacancies are described as impurity elements. Typical examples of the impurity elements are hydrogen, rare gas elements, and the like. Typical examples of rare gas elements are helium, neon, argon, krypton, and xenon. Furthermore, boron, carbon, nitrogen, fluorine, aluminum, silicon, phosphorus, chlorine, or the like may be contained in the oxide semiconductor film 112 and the oxide semiconductor film 103 as an impurity element.

The insulating film 120 is a film containing hydrogen and is typically a nitride insulating film. The insulating film 120 is in contact with the oxide semiconductor film 112 and the oxide semiconductor film 103, whereby hydrogen contained in the insulating film 120 is diffused to the oxide semiconductor film 112 and the oxide semiconductor film 103. Consequently, much hydrogen is contained in the regions of the oxide semiconductor film 112 and the oxide semiconductor film 103 in contact with the insulating film 120.

When a rare gas element is added as an impurity element to the oxide semiconductor film, a bond between a metal element and oxygen in the oxide semiconductor film is cut, whereby an oxygen vacancy is formed. By interaction between hydrogen and the oxygen vacancy included in the oxide semiconductor film, the conductivity of the oxide semiconductor film is increased. Specifically, hydrogen enters into the oxygen vacancies in the oxide semiconductor film, whereby an electron serving as a carrier is produced. As a result, the conductivity is increased.

Figure 22A:
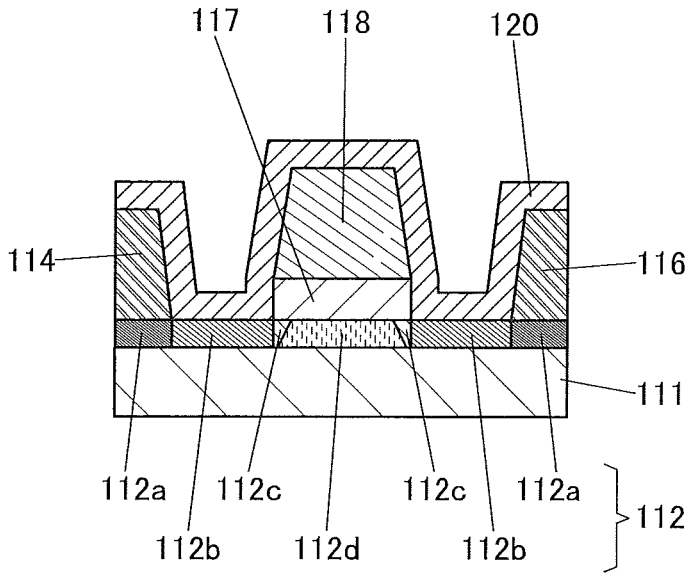
FIGS. 22A and 22B are cross-sectional views illustrating one embodiment of the present invention.
Figure 22B:
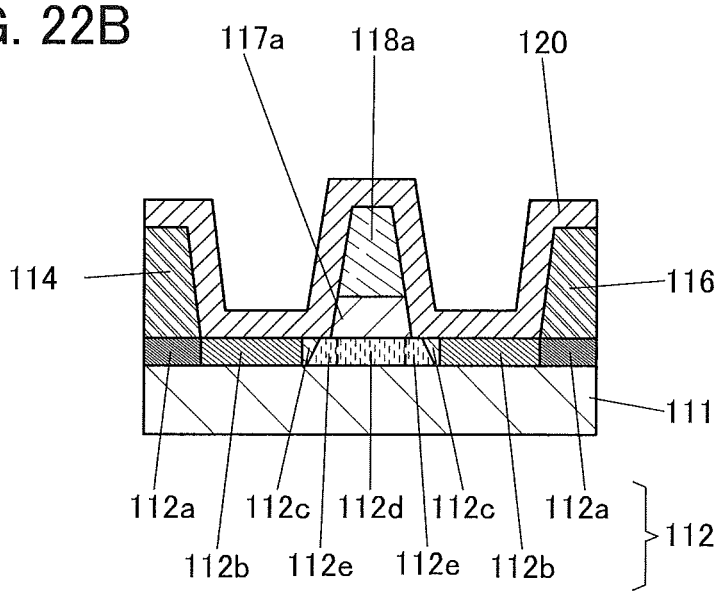

Here, FIGS. 22A and 22B are partial enlarged views of the oxide semiconductor film 112. Note that as typical examples, description is made with reference to the partial enlarged views of the oxide semiconductor film 112 included in the transistor 100A. As shown in FIGS. 22A and 22B, the oxide semiconductor film 112 includes a region 112*a* in contact with the conductive film 114 or the conductive film 116, a region 112*b* in contact with the insulating film 120, and a region 112*d* in contact with the insulating film 117. Note that in the case where the conductive film 118 has a tapered side surface, the oxide semiconductor film 112 may include regions 112*c* overlapping with a tapered portion of the conductive film 118.

The regions 112*a* serve as a source region and a drain region. In the case where the conductive films 114 and 116 are formed using a conductive material which is easily bonded to oxygen, such as tungsten, titanium, aluminum, copper, molybdenum, chromium, tantalum, an alloy of any of these, or the like, oxygen contained in the oxide semiconductor films is bonded to the conductive material contained in the conductive films 114 and 116, and an oxygen vacancy is formed in the oxide semiconductor film. Further, in some cases, part of constituent elements of the conductive material that forms the conductive films 114 and 116 is mixed into the oxide semiconductor film. As a result, the regions 112*a* in contact with the conductive film 114 and the conductive film 116 have higher conductivity and serve as a source region and a drain region.

The regions 112*b* function as low-resistance regions. The regions 112*b* contain at least a rare gas and hydrogen as the impurity elements. Note that in the case where the side surface of the conductive film 118 has a tapered shape, the impurity element is added to the regions 112*c* through the tapered portion of the conductive film 118. Therefore, although the regions 112*c* have a lower concentration of rare gas elements as an example of the impurity element than the regions 112*b*, the impurity element is contained. With the regions 112*c*, source-drain breakdown voltage of the transistor can be increased.

In the case where the oxide semiconductor film 112 is formed by a sputtering method, the regions 112*a* to 112*d* each contain a rare gas element. In addition, the rare gas element concentration of each of the regions 112*b* and 112*c* is higher than that of each of the regions 112*a* and 112*d*. This is because a rare gas is used as a sputtering gas to form the oxide semiconductor film 112 by sputtering and is therefore included in the oxide semiconductor film 112, and because a rare gas is intentionally added to the regions 112*b* and 112*c* to form an oxygen vacancy. Note that a rare gas element different from that added to the regions 112*a* and 112*d* may be added to the regions 112*b* and 112*c*.

Since the region 112*b* is in contact with the insulating film 120, the hydrogen concentration of the region 112*b* is higher than those of the region 112*a* and the region 112*d*. In the case where hydrogen is diffused from the region 112*b* to the region 112*c*, the concentration of hydrogen in the region 112*c* is higher than the concentration of hydrogen in the region 112*a* and the concentration of hydrogen in the region 112*d*. Note that the hydrogen concentration of the region 112*b* is higher than that of the region 112*c*.

In the regions 112*b* and 112*c*, the concentrations of hydrogen measured by secondary ion mass spectrometry (SIMS) can be greater than or equal to $8\times10^{19}$ atoms/cm$^3$, greater than or equal to $1\times10^{2}$ atoms/cm$^3$, or greater than or equal to $5\times10^{20}$ atoms/cm$^3$. Note that in the regions 112*a* and 112*d*, the concentration of hydrogen which is measured by SIMS can be lower than or equal to $5\times10^{9}$ atoms/cm$^3$, lower than or equal to $1\times10^{19}$ atoms/cm$^3$, lower than or equal to $5\times10^{18}$ atoms/cm$^3$, lower than or equal to $1\times10^{18}$ atoms/cm$^3$, lower than or equal to $5\times10^{17}$ atoms/cm$^3$, or lower than or equal to $1\times10^{16}$ atoms/cm$^3$.

In the case where boron, carbon, nitrogen, fluorine, aluminum, silicon, phosphorus, or chlorine is added to the oxide semiconductor film 112 as an impurity element, only the regions 112*b* and 112*c* contain the impurity element. Therefore, the concentrations of the impurity element in the regions 112*b* and 112*c* are higher than those in the regions

112*a* and 112*d*. Note that, in the region 112*b* and the region 112*c*, the impurity element concentration which is measured by SIMS can be higher than or equal to $1\times10^{18}$ atoms/cm$^3$ and lower than or equal to $1\times10^{22}$ atoms/cm$^3$, higher than or equal to $1\times10^{19}$ atoms/cm$^3$ and lower than or equal to $1\times10^{21}$ atoms/cm$^3$, or higher than or equal to $5\times10^{19}$ atoms/cm$^3$ and lower than or equal to $5\times10^{20}$ atoms/cm$^3$.

The regions 112*b* and 112*c* have higher hydrogen concentrations than the region 112*d* and have more oxygen vacancies than the region 112*d* because of addition of impurity elements. Therefore, the regions 112*b* and 112*c* have higher conductivity and serve as low-resistance regions. The resistivity of the regions 112*b* and 112*c* can be typically greater than or equal to $1\times10^{-3}$ Ωcm and less than $1\times10^{4}$ Ωcm, or greater than or equal to $1\times10^{-3}$ Ωcm and less than $1\times10^{-1}$ Ωcm.

Note that in the region 112*b* and the region 112*c*, when the amount of hydrogen is smaller than or equal to the amount of oxygen vacancy, hydrogen is easily captured by the oxygen vacancy and is not easily diffused into the region 112*d* that serves as a channel. As a result, a normally-off transistor can be manufactured.

The region 112*d* serves as a channel.

In addition, after the impurity element is added to the oxide semiconductor film 112 using the conductive films 114, 116, and 118 as masks, the area of the conductive film 118 when seen from the above may be reduced. This can be performed in such a manner that a slimming process is performed on a mask over the conductive film 118 in a step of forming the conductive film 118 so as to obtain a mask with a minuter structure. Then, the conductive film 118 and the insulating film 117 are etched using the mask, so that a conductive film 118*a* and an insulating film 117*a* illustrated in FIG. 22B can be formed. As the slimming process, an ashing process using an oxygen radical or the like can be employed, for example.

As a result, an offset region 112*e* is formed between the region 112*c* and the region 112*d* serving as a channel in the oxide semiconductor film 112. Note that the length of the offset region 112*e* in the channel length direction is set to be less than 0.1 μm, whereby a decrease in the on-state current of the transistor can be suppressed.

The insulating film 117 and the insulating film 106 each function as a gate insulating film.

The conductive film 114 and the conductive film 116 serve as a source electrode and a drain electrode, and the conductive film 104 and the conductive film 105 serve as a source electrode and a drain electrode.

The conductive film 118 and the conductive film 107 each function as a gate electrode.

The transistor 100A and the transistor 100B described in this embodiment each include the region 112*b* and/or the region 112*c* between the region 112*d* functioning as a channel and each of the regions 112*a* functioning as a source region and a drain region. Accordingly, resistance between the channel and each of the source region and the drain region can be reduced, and the transistor 100A and the transistor 100B each have a high on-state current and a high field-effect mobility.

In addition, in the transistor 100A and the transistor 100B, parasitic capacitance between the conductive film 118 and each of the conductive films 114 and 116 can be reduced by forming the conductive film 118 so as not overlap with the conductive films 114 and 116. Moreover, parasitic capacitance between the conductive film 107 and each of the conductive films 104 and 105 can be reduced by forming the conductive film 107 so as not to overlap with the conductive films 104 and 105. As a result, in the case where a large-sized substrate is used as the substrate 101, signal delays in the conductive films 114 and 116 and the conductive film 118, and signal delays in the conductive films 104 and 105 and the conductive film 107 can be reduced.

In the transistor 100A, a region including an oxygen vacancy is formed by adding a rare gas element to the oxide semiconductor film 112 using the conductive films 114, 116, and 118 as masks. In the transistor 100B, the impurity element is added to the oxide semiconductor film 103 using the conductive films 104, 105, and 107 as masks, so that regions having oxygen vacancies are formed. Furthermore, because the region including oxygen vacancies is in contact with the insulating film 120 containing hydrogen, hydrogen contained in the insulating film 120 is diffused into the region including oxygen vacancies, so that a low-resistance region is formed. That is, the low-resistance regions can be formed in a self-aligned manner.

In the transistor 100A and the transistor 100B described in this embodiment, the rare gas is added to the regions 112*b* to form oxygen vacancy, and furthermore, hydrogen is added thereto. Therefore, the conductivity of the region 112*b* can be increased and variation in conductivity of the region 112*b* in each transistor can be reduced. That is, by adding the rare gas and hydrogen to the region 112*b*, the conductivity of the region 112*b* can be controlled.

The structures shown in FIGS. 21A and 21B will be described below in detail.

The type of the substrate 101 is not limited to a certain type, and any of a variety of substrates can be used as the substrate 101. Examples of the substrate include a semiconductor substrate (e.g., a single crystal substrate or a silicon substrate), an SOI substrate, a glass substrate, a quartz substrate, a plastic substrate, a metal substrate, a stainless steel substrate, a substrate including stainless steel foil, a tungsten substrate, a substrate including tungsten foil, a flexible substrate, an attachment film, paper including a fibrous material, and a base material film. Examples of a glass substrate include a barium borosilicate glass substrate, an aluminoborosilicate glass substrate, and a soda lime glass substrate. Examples of a flexible substrate, an attachment film, a base material film, or the like are as follows: plastic typified by polyethylene terephthalate (PET), polyethylene naphthalate (PEN), and polyether sulfone (PES); a synthetic resin such as acrylic; polypropylene; polyester, polyvinyl fluoride; polyvinyl chloride; polyamide; polyimide; aramid; epoxy, an inorganic vapor deposition film; and paper. Specifically, when the transistors are formed using a semiconductor substrate, a single crystal substrate, an SOI substrate, or the like, it is possible to form a transistor with few variations in characteristics, size, shape, or the like, with high current supply capability, and with a small size. By forming a circuit with the use of such a transistor, power consumption of the circuit can be reduced or the circuit can be highly integrated.

Still alternatively, a flexible substrate may be used as the substrate 101, and the transistors may be directly provided on the flexible substrate. Alternatively, a separation layer may be provided between the substrate 101 and each of the transistors. The separation layer can be used when part or the whole of a semiconductor device formed over the separation layer is completed and separated from the substrate 101 and transferred to another substrate. In such a case, the transistors can be transferred to a substrate having low heat resistance or a flexible substrate as well. For the above separation layer, a stack including inorganic films, which are a tungsten film and a silicon oxide film, or an organic resin film of polyimide or the like formed over a substrate can be used, for example.

Examples of a substrate to which the transistors are transferred include, in addition to the above-described substrates over which transistors can be formed, a paper substrate, a cellophane substrate, an aramid film substrate, a polyimide film substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), or the like), a leather substrate, a rubber substrate, and the like. When such a substrate is used, a transistor with excellent properties or a transistor with low power consumption can be formed, a device with high durability, high heat resistance can be provided, or reduction in weight or thickness can be achieved.

The insulating film 111 can be formed with a single layer or a stack using one or more of an oxide insulating film and a nitride insulating film. Note that an oxide insulating film is preferably used as at least a region of the insulating film 111 that is in contact with the oxide semiconductor films 103 and 112, in order to improve characteristics of the interface with the oxide semiconductor films 103 and 112. An oxide insulating film that releases oxygen by being heated is preferably used as the insulating film 111, in which case oxygen contained in the insulating film 111 can be moved to the oxide semiconductor films 103 and 112 by heat treatment.

The thickness of the insulating film 111 can be greater than or equal to 50 nm, greater than or equal to 100 nm and less than or equal to 3000 nm, or greater than or equal to 200 nm and less than or equal to 1000 nm. With the use of the thick insulating film 111, the amount of oxygen released from the insulating film 111 can be increased, and the interface states between the insulating film 111 and each of the oxide semiconductor films 103 and 112 and oxygen vacancies included in the oxide semiconductor film 103 and the region 112*d* of the oxide semiconductor film 112 can be reduced.

The insulating film 111 can be formed with a single layer or a stack using, for example, one or more of silicon oxide, silicon oxynitride, silicon nitride oxide, silicon nitride, aluminum oxide, hafnium oxide, gallium oxide, a Ga—Zn oxide, and the like.

The oxide semiconductor films 112 and 103 are typically formed using a metal oxide such as an In—Ga oxide, an In—Zn oxide, or an In-M-Zn oxide (M is Mg, Al, Ti, Ga, Y, Zr, La, Ce, Nd, or Hf). Note that the oxide semiconductor films 112 and 103 have light-transmitting properties.

Note that in the case of using an In-M-Zn oxide as the oxide semiconductor films 112 and 103, when a summation of In and M is assumed to be 100 atomic %, the proportions of In and Mare preferably set to be greater than or equal to 25 atomic % and less than 75 atomic %, respectively, or greater than or equal to 34 atomic % and less than 66 atomic %, respectively.

The energy gaps of the oxide semiconductor films 112 and 103 are each 2 eV or more, 2.5 eV or more, or 3 eV or more.

The thickness of each of the oxide semiconductor films 112 and 103 can be greater than or equal to 3 nm and less than or equal to 200 nm, greater than or equal to 3 nm and less than or equal to 100 nm, or greater than or equal to 3 nm and less than or equal to 50 nm.

In the case where the oxide semiconductor films 112 and 103 contain an In-M-Zn oxide (M is Mg, Al, Ti, Ga, Y, Zr, La, Ce, Nd, or Hf), it is preferable that the atomic ratio of metal elements of a sputtering target used for forming a film of the In-M-Zn oxide satisfy In≥M and Zn≥M. As the atomic ratio of metal elements of such a sputtering target, In:M:Zn=1:1:1, In:M:Zn=1:1:1.2, In:M:Zn=2:1:1.5, In:M:Zn=2:1:2.3, In:M:Zn=2:1:3, In:M:Zn=3:1:2, or the like is preferable. Note that the atomic ratios of metal elements in the formed oxide semiconductor films 112 and 103 vary from the above atomic ratio of metal elements of the sputtering target within a range of ±40% as an error.

When silicon or carbon that is one of elements belonging to Group 14 is contained in the oxide semiconductor film 112 and the oxide semiconductor film 103, oxygen vacancies are increased in the oxide semiconductor film 112 and the oxide semiconductor film 103, and the oxide semiconductor film 112 and the oxide semiconductor film 103 become n-type films. Thus, the concentration of silicon or carbon (the concentration measured by SIMS) in the oxide semiconductor film 112 and the oxide semiconductor film 103, in particular, the region 112*d*, can be lower than or equal to $2\times10^{18}$ atoms/cm$^3$, or lower than or equal to $2\times10^{17}$ atoms/cm$^3$. As a result, the transistor has positive threshold voltage (normally-off characteristics).

Furthermore, the concentration of alkali metal or alkaline earth metal which is measured by SIMS in the oxide semiconductor film 112 and the oxide semiconductor film 103, in particular, the region 112*d*, can be lower than or equal to $1\times10^{18}$ atoms/cm$^3$, or lower than or equal to $2\times10^{16}$ atoms/cm$^3$. Alkali metal and alkaline earth metal might generate carriers when bonded to an oxide semiconductor, in which case the off-state current of the transistor might be increased. Therefore, it is preferable to reduce the concentration of an alkali metal or an alkaline earth metal in the region 112*d*. As a result, the transistor has positive threshold voltage (normally-off characteristics).

Furthermore, when nitrogen is contained in the oxide semiconductor film 112 and the oxide semiconductor film 103, in particular, the region 112*d*, electrons serving as carriers are generated, carrier density is increased, and the oxide semiconductor films 112 and 103 become n-type films in some cases. Thus, a transistor including an oxide semiconductor film which contains nitrogen is likely to have normally-on characteristics. Therefore, nitrogen is preferably reduced as much as possible in the oxide semiconductor film, particularly the region 112*d*. The nitrogen concentration, which is measured by SIMS, can be set to, for example, lower than or equal to $5\times10^{18}$ atoms/cm$^3$.

By reducing the impurity elements in the oxide semiconductor film 112 and the oxide semiconductor film 103, in particular, the region 112*d*, the carrier density of the oxide semiconductor films can be lowered. In the oxide semiconductor film 112 and the oxide semiconductor film 103, in particular, the region 112*d*, carrier density can be $1\times10^{17}$/cm$^3$ or less, $1\times10^{15}$/cm$^3$ or less, $1\times10^{13}$/cm$^3$ or less, or $1\times10^{1}$/cm$^3$ or less.

An oxide semiconductor film with a low impurity concentration and a low density of defect states can be used for the oxide semiconductor films 112 and 103, in which case the transistors can have more excellent electrical characteristics. Here, the state in which impurity concentration is low and density of defect states is low (the amount of oxygen vacancies is small) is referred to as "highly purified intrinsic" or "substantially highly purified intrinsic". A highly purified intrinsic or substantially highly purified intrinsic oxide semiconductor has few carrier generation sources, and thus has a low carrier density in some cases. Thus, a transistor including the oxide semiconductor film in which a channel region is formed is likely to have positive threshold voltage (normally-off characteristics). A highly purified intrinsic or substantially highly purified intrinsic oxide semiconductor film has a low density of defect states and accordingly has low density of trap states in some cases. Furthermore, a highly purified intrinsic or substantially highly purified intrinsic oxide semiconductor film has an extremely small off-state current; the off-state current can be smaller than or equal to the measurement limit of a semiconductor parameter analyzer, i.e., smaller than or equal to $1\times10^{-13}$ A, at a voltage (drain voltage) between a source electrode and a drain electrode of from 1 V to 10 V. Thus, the transistor whose channel region is formed in the oxide semiconductor film has a small variation in electrical characteristics and high reliability in some cases.

In addition, each of the oxide semiconductor films 112 and 103 may have a non-single-crystal structure, for example. The non-single crystal structure includes a c-axis aligned crystalline oxide semiconductor (CAAC-OS), a polycrystalline structure, a microcrystalline structure, or an amorphous structure, for example. Among the non-single crystal structure, the amorphous structure has the highest density of defect states, whereas CAAC-OS has the lowest density of defect states.

Note that each of the oxide semiconductor films 112 and 103 may be a mixed film including two or more of the following: a region having an amorphous structure, a region having a microcrystalline structure, a region having a polycrystalline structure, a region of CAAC-OS and a region having a single-crystal structure. The mixed film has a single-layer structure including, for example, two or more of a region having an amorphous structure, a region having a microcrystalline structure, a region having a polycrystalline structure, a CAAC-OS region, and a region having a single-crystal structure in some cases. Furthermore, the mixed film has a stacked-layer structure including, for example, two or more of a region having an amorphous structure, a region having a microcrystalline structure, a region having a polycrystalline structure, a CAAC-OS region, and a region having a single-crystal structure in some cases.

Note that in some cases, the regions 112*b* and 112*d* are different in crystallinity in each of the oxide semiconductor films 112 and 103. In addition, in some cases, the regions 112*c* and 112*d* are different in crystallinity in each of the oxide semiconductor films 112 and 103. This is because when an impurity element is added to the region 112*b* or 112*c*, the region 112*b* or 112*c* is damaged and thus has lower crystallinity.

The insulating films 106 and 117 can be formed with a single layer or a stack using one or more of an oxide insulating film and a nitride insulating film. Note that an oxide insulating film is preferably used as at least regions of the insulating films 106 and 117 that are in contact with the oxide semiconductor films 112 and 103, respectively, in order to improve characteristics of the interface with the oxide semiconductor films 112 and 103. The insulating films 106 and 117 can be formed with a single layer or a stack using, for example, one or more of silicon oxide, silicon oxynitride, silicon nitride oxide, silicon nitride, aluminum oxide, hafnium oxide, gallium oxide, a Ga—Zn oxide, and the like.

Furthermore, it is possible to prevent outward diffusion of oxygen from the oxide semiconductor films 112 and 103 and entry of hydrogen, water, or the like into the oxide semiconductor films 112 and 103 from the outside by providing an insulating film having a blocking effect against oxygen, hydrogen, water, and the like as the insulating films 106 and 117. As the insulating film which has an effect of blocking oxygen, hydrogen, water, and the like, an aluminum oxide film, an aluminum oxynitride film, a gallium oxide film, a gallium oxynitride film, an yttrium oxide film, an yttrium oxynitride film, a hafnium oxide film, a hafnium oxynitride film, or the like can be used.

The insulating films 106 and 117 may be formed using a high-k material such as hafnium silicate ($HfSiO_x$), hafnium silicate to which nitrogen is added ($HfSi_xO_yN_z$), hafnium aluminate to which nitrogen is added ($HfAl_xO_yN_z$), hafnium oxide, or yttrium oxide, so that gate leakage current of the transistors can be reduced.

When the insulating films 106 and 117 are formed using an oxide insulating film from which oxygen is released by heating, oxygen contained in the insulating films 106 and 117 can be moved to the oxide semiconductor films 112 and 103 by heat treatment.

In addition, a silicon oxynitride film with few defects can be used as the insulating films 106 and 117. In an ESR spectrum at 100 K or lower of the silicon oxynitride film with few defects, after heat treatment, a first signal that appears at a g-factor of greater than or equal to 2.037 and less than or equal to 2.039, a second signal that appears at a g-factor of greater than or equal to 2.001 and less than or equal to 2.003, and a third signal that appears at a g-factor of greater than or equal to 1.964 and less than or equal to 1.966 are observed. The split width of the first and second signals and the split width of the second and third signals that are obtained by ESR measurement using an X-band are each approximately 5 mT. The sum of the spin densities of the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor of greater than or equal to 1.964 and less than or equal to 1.966 is lower than $1\times10^{18}$ spins/cm$^3$, typically higher than or equal to $1\times10^{17}$ spins/cm$^3$ and lower than $1\times10^{18}$ spins/cm$^3$ In the ESR spectrum at 100 K or lower, the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor of greater than or equal to 1.964 and less than or equal to 1.966 correspond to signals attributed to nitrogen oxide ($NO_x$; x is greater than or equal to 0 and less than or equal to 2, or greater than or equal to 1 and smaller than or equal to 2). Accordingly, the lower the sum of the spin densities of the first signal that appears at a g-factor of greater than or equal to 2.037 and less than or equal to 2.039, the second signal that appears at a g-factor of greater than or equal to 2.001 and less than or equal to 2.003, and the third signal that appears at a g-factor of greater than or equal to 1.964 and less than or equal to 1.966 is, the smaller the amount of nitrogen oxide contained in the silicon oxynitride film is.

In the silicon oxynitride film with few defects, the concentration of nitrogen which is measured by SIMS is lower than or equal to $6\times10^{20}$ atoms/cm$^3$. When the insulating film 117 is formed using the silicon oxynitride film with few defects, nitrogen oxide is unlikely to be generated, so that the carrier traps at the interface between the oxide semiconductor films 112 and 103 and the insulating films can be reduced. Furthermore, a shift of the threshold voltage of the transistor included in the display device can be reduced, which leads to a smaller change in the electrical characteristics of the transistor.

The total thickness of the insulating films 106 and 117 can be greater than or equal to 5 nm and less than or equal to 400 nm, greater than or equal to 5 nm and less than or equal to 300 nm, or greater than or equal to 10 nm and less than or equal to 250 nm.

Each of the conductive film 114, the conductive film 116, the conductive film 118, the conductive film 104, the conductive film 105, the conductive film 102, and the conductive film 107 can be formed using, for example, a metal element selected from aluminum, chromium, copper, tantalum, titanium, molybdenum, nickel, iron, cobalt, and tungsten; an alloy containing any of these metal elements as a component; an alloy containing these metal elements in combination; or the like. Further, one or more metal elements selected from manganese and zirconium may be used. Furthermore, the conductive film 114, the conductive film 116, the conductive film 118, the conductive film 104, the conductive film 105, the conductive film 102, and the conductive film 107 may have a single-layer structure or a stacked-layer structure including two or more layers. For example, any of the following can be used: a single-layer structure of an aluminum film containing silicon; a single-layer structure of a copper film containing manganese; two-layer structure in which a titanium film is stacked over an aluminum film; a two-layer structure in which a titanium film is stacked over a titanium nitride film; a two-layer structure in which a tungsten film is stacked over a titanium nitride film; a two-layer structure in which a tungsten film is stacked over a tantalum nitride film or a tungsten nitride film; a two-layer structure in which a copper film is stacked over a copper film containing manganese; a three-layer structure in which a titanium film, an aluminum film, and a titanium film are stacked in this order; a three-layer structure in which a copper film containing manganese, a copper film, and a copper film containing manganese are stacked in this order, and the like. Alternatively, an alloy film or a nitride film which contains aluminum and one or more elements selected from titanium, tantalum, tungsten, molybdenum, chromium, neodymium, and scandium may be used.

Alternatively, the conductive film 114, the conductive film 116, the conductive film 118, the conductive film 104, the conductive film 105, the conductive film 102, and the conductive film 107 can be formed using a light-transmitting conductive material such as indium tin oxide, indium oxide containing tungsten oxide, indium zinc oxide containing tungsten oxide, indium oxide containing titanium oxide, indium tin oxide containing titanium oxide, indium zinc oxide, or indium tin oxide including silicon oxide. Alternatively, a stacked-layer structure of the above light-transmitting conductive material and a conductive material containing the above metal element may be employed.

The thicknesses of the conductive films 114 and 116, the conductive film 118, the conductive films 104 and 105, the conductive film 102, and the conductive film 107 each can be greater than or equal to 30 nm and less than or equal to 500 nm, or greater than or equal to 100 nm and less than or equal to 400 nm.

The insulating film 120 is a film containing hydrogen and is typically a nitride insulating film. The nitride insulating film can be formed using silicon nitride, aluminum nitride, or the like.

<Structure Example 2 of Transistor>

Next, another structure of the transistor included in the display device is described with reference to FIGS. 23A to 23C. Description is made here using a transistor 100C as a modified example of the transistor 100A provided in the pixel portion 15; however, the structure of the insulating film 111 or the structure of the conductive film 114, 116, or 118 of the transistor 100C can be applied as appropriate to the transistor 100B in the driver circuit portion.

Figure 23A:
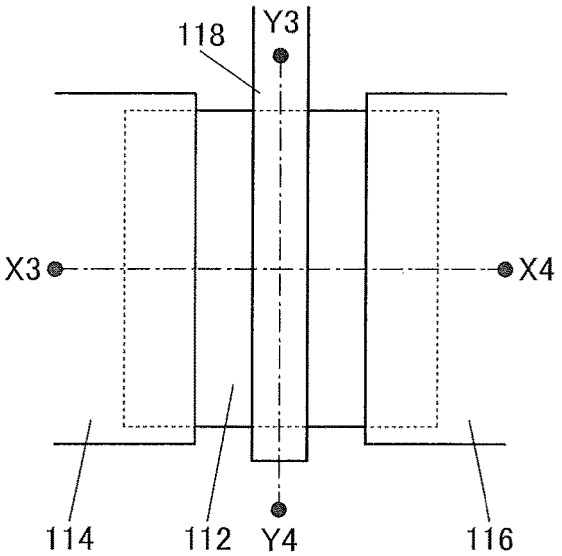
FIGS. 23A to 23C are a top view and cross-sectional views illustrating one embodiment of the present invention.
Figure 23B:
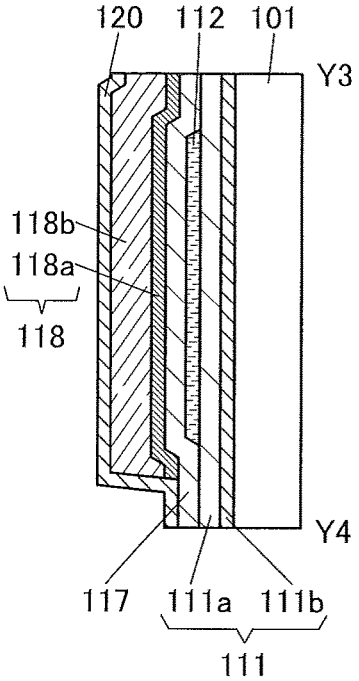
Figure 23C:
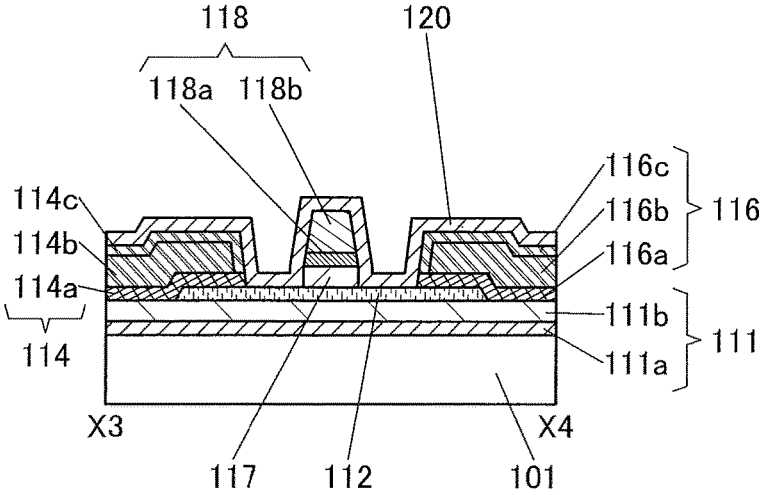

FIGS. 23A to 23C are a top view and cross-sectional views of the transistor 100C included in the display device. FIG. 23A is a top view of the transistor 100C, FIG. 23B is a cross-sectional view taken along dashed-dotted line Y3-Y4 in FIG. 23A, and FIG. 23C is a cross-sectional view taken along dashed-dotted line X3-X4 in FIG. 23A.

The transistor 100C illustrated in FIGS. 23A to 23C has a two- or three-layer structure of the conductive films 114 and 116 and the conductive film 118. In addition, the insulating film 111 has a stacked-layer structure of a nitride insulating film 111*a* and an oxide insulating film 111*b*. The other structures are the same as those of the transistor 100A and the effect similar to that in the case of the transistor 100A can be obtained.

First, the conductive films 114 and 116 and the conductive film 118 are described.

In the conductive film 114, conductive films 114*a*, 114*b*, and 114*c* are stacked in this order and the conductive films 114*a* and 114*c* cover the surfaces of the conductive film 114*b*. That is, the conductive films 114*a* and 114*c* function as protective films of the conductive film 114*b*.

In a manner similar to that of the conductive film 114, in the conductive film 116, conductive films 116*a*, 116*b*, and 116*c* are stacked in this order and the conductive films 116*a* and 116*c* cover the surfaces of the conductive film 116*b*. That is, the conductive films 116*a* and 116*c* function as protective films of the conductive film 116*b*.

In the conductive film 118, conductive films 118*a* and 118*b* are stacked in this order.

The conductive films 114*a* and 116*a* and the conductive film 118*a* are formed using materials that prevent metal elements contained in the conductive films 114*b* and 116*b* and the conductive film 118*b*, respectively, from diffusing to the oxide semiconductor film 112. The conductive films 114*a* and 116*a* and the conductive film 118*a* can be formed using titanium, tantalum, molybdenum, tungsten, an alloy of any of these materials, titanium nitride, tantalum nitride, molybdenum nitride, tungsten nitride, or the like. Alternatively, the conductive films 114*a* and 116*a* and the conductive film 118*a* can be formed using Cu—X alloy (X is Mn, Ni, Cr, Fe, Co, Mo, Ta, or Ti) or the like.

The conductive films 114*b* and 116*b* and the conductive film 118*b* are each formed using a low-resistance material. The conductive films 114*b* and 116*b* and the conductive film 118*b* can be formed using copper, aluminum, gold, silver, an alloy of any of these materials, a compound containing any of these materials as a main component, or the like.

When the conductive films 114*c* and 116*c* are formed using films in which the metal elements contained in the conductive films 114*b* and 116*b*, respectively, are passivated, the metal elements contained in the conductive films 114*b* and 116*b* can be prevented from moving to the oxide semiconductor film 112 in a step of forming the insulating film 128. The conductive films 114*c* and 116*c* can be formed using a metal silicide or a metal silicide nitride, typically, $CuSi_x$ (x>0), $CuSi_xN_y$ (x>0, y>0), or the like.

Here, a method for forming the conductive films 114*c* and 116*c* is described. Note that the conductive films 114*b* and 116*b* are formed using copper. In addition, the conductive films 114*c* and 116*c* are formed using $CuSi_xN_y$ (x>0, y>0).

The conductive films 114*b* and 116*b* are exposed to plasma generated in a reducing atmosphere such as a hydrogen atmosphere, an ammonia atmosphere, or a carbon monoxide atmosphere and the oxide formed on the surfaces of the conductive films 114*b* and 116*b* are reduced.

Next, the conductive films 114*b* and 116*b* are exposed to silane while being heated at a temperature higher than or equal to 200° C. and lower than or equal to 400° C. As a result, copper contained in the conductive films 114*b* and 116*b* acts as a catalyst, and silane is decomposed into Si and $H_2$, and $CuSi_x$ (x>0) is formed on the surfaces of the conductive films 114*b* and 116*b*.

Next, the conductive films 114*b* and 116*b* are exposed to plasma generated in an atmosphere containing nitrogen, such as an ammonia atmosphere or a nitrogen atmosphere, whereby $CuSi_x$ (x>0) formed on the surfaces of the conductive films 114*b* and 116*b* reacts with nitrogen contained in the plasma and accordingly $CuSi_xN_y$ (x>0, y>0) is formed as the conductive films 114*c* and 116*c*.

Note that in the above step, $CuSi_xN_y$ (x>0, y>0) may be formed as the conductive films 114*c* and 116*c* in such a manner that the conductive films 114*b* and 116*b* are exposed to plasma generated in an atmosphere containing nitrogen, such as an ammonia atmosphere or a nitrogen atmosphere, and then exposed to silane while being heated at a temperature higher than or equal to 200° C. and lower than or equal to 400° C.

Next, the insulating film 111 in which the nitride insulating film 111*a* and the oxide insulating film 111*b* are stacked is described.

The nitride insulating film 111*a* can be formed using silicon nitride, silicon nitride oxide, aluminum nitride, or aluminum nitride oxide, for example. The oxide insulating film 111*b* can be formed using silicon oxide, silicon oxynitride, aluminum oxide, or the like, for example. The structure in which the nitride insulating film 111*a* is provided on the substrate 101 side can prevent hydrogen, water, or the like from diffusing to the oxide semiconductor film 112 from the outside.

<Structure Example 3 of Transistor>

Next, another structure of the transistor included in the display device is described with reference to FIGS. 24A to 24C and FIGS. 25A to 25C. Description is made here using a transistor 100D and a transistor 100E as modified examples of the transistor 100A provided in the pixel portion 15; however, the structure of an oxide semiconductor film 112 included in the transistor 100D or the structure of an oxide semiconductor film 112 included in the transistor 100E can be applied as appropriate to the transistor 100B in the driver circuit portion.

Figure 24A:
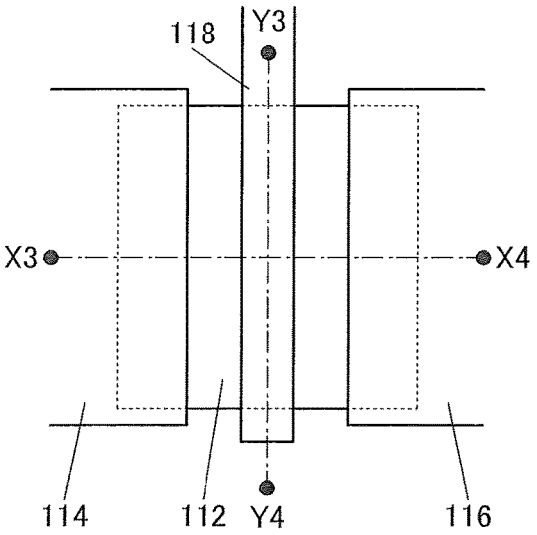
FIGS. 24A to 24C are a top view and cross-sectional views illustrating one embodiment of the present invention.
Figure 24B:
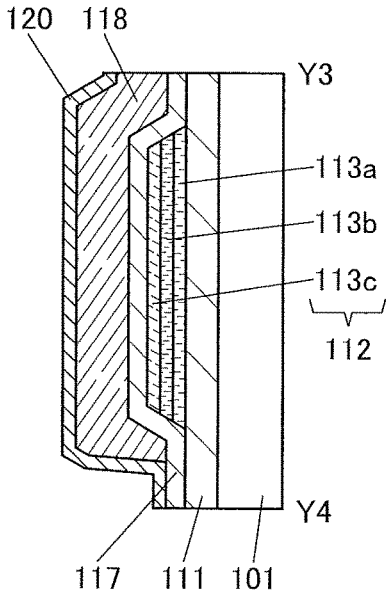
Figure 24C:
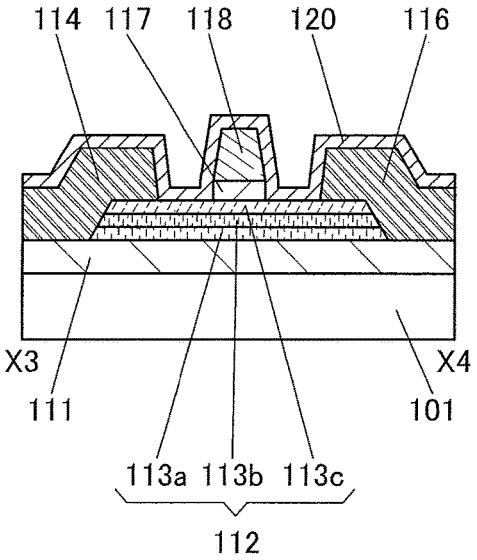

FIGS. 24A to 24C are a top view and cross-sectional views of the transistor 100D included in the display device. FIG. 24A is a top view of the transistor 100D, FIG. 24B is a cross-sectional view taken along dashed-dotted line Y3-Y4 in FIG. 24A, and FIG. 24C is a cross-sectional view taken along dashed-dotted line X3-X4 in FIG. 24A.

The oxide semiconductor film 112 of the transistor 100D illustrated in FIGS. 24A to 24C has a multilayer structure. Specifically, the oxide semiconductor film 112 includes an oxide semiconductor film 113*a* in contact with the insulating film 111, an oxide semiconductor film 113*b* in contact with the oxide semiconductor film 113*a*, and an oxide semiconductor film 113*c* in contact with the oxide semiconductor film 113*b*, the conductive films 114 and 116, and the insulating films 117 and 120. The other structures are the same as those of the transistor 100A and the effect similar to that in the case of the transistor 100A can be obtained.

The oxide semiconductor films 113*a*, 113*b*, and 113*c* are typically formed using a metal oxide such as an In—Ga oxide, an In—Zn oxide, or an In-M-Zn oxide (M is Mg, Al, Ti, Ga, Y, Zr, La, Ce, Nd, or Hf).

The oxide semiconductor films 113*a* and 113*c* are typically each an In—Ga oxide, an In—Zn oxide, an In—Mg oxide, a Zn—Mg oxide, or an In-M-Zn oxide (M is Mg, Al, Ti, Ga, Y, Zr, La, Ce, Nd, or Hf), and has the energy at the bottom of the conduction band closer to a vacuum level than that of the oxide semiconductor film 113*b*. Typically, a difference between the energy at the bottom of the conduction band of the oxide semiconductor film 113*b* and the energy at the bottom of the conduction band of each of the oxide semiconductor films 113*a* and 113*c* is greater than or equal to 0.05 eV, greater than or equal to 0.07 eV, greater than or equal to 0.1 eV, or greater than or equal to 0.2 eV and also less than or equal to 2 eV, less than or equal to 1 eV, less than or equal to 0.5 eV, or less than or equal to 0.4 eV. Note that the difference between the vacuum level and the energy at the bottom of the conduction band is referred to as electron affinity.

In the case where the oxide semiconductor film 113*b* is an In-M-Zn oxide (M is Mg, Al, Ti, Ga, Y, Zr, La, Ce, Nd, or Hf) and a target having the atomic ratio of metal elements of $In:M:Zn=x_1:y_1:z_1$ is used for depositing the oxide semiconductor film 113*b*, $x_1/y_1$ is preferably greater than or equal to ⅓ and less than or equal to 6, or further preferably greater than or equal to 1 and less than or equal to 6, and $z_1/y_1$ is preferably greater than or equal to ⅓ and less than or equal to 6, or further preferably greater than or equal to 1 and less than or equal to 6. Note that when $z_1/y_1$ is greater than or equal to 1 and less than or equal to 6, a CAAC-OS film to be described later as the oxide semiconductor film 113*b* is easily formed. As typical examples of the atomic ratio of metal elements of the target, In:M:Zn=1:1:1, In:M:Zn=1:1:1.2, In:M:Zn=2:1:1.5, In:M:Zn=2:1:2.3, In:M:Zn=2:1:3, In:M:Zn=3:1:2, and the like can be given.

In the case where the oxide semiconductor films 113*a* and 113*c* are each an In-M-Zn oxide (M is Mg, Al, Ti, Ga, Y, Zr, La, Ce, Nd, or Hf) and a target having the atomic ratio of metal elements of $In:M:Zn=x_2:y_2:z_2$ is used for forming the oxide semiconductor films 113*a* and 113*c*, $x_2/y_2$ is preferably less than $x_1/y_1$, and $z_2/y_2$ is preferably greater than or equal to ⅓ and less than or equal to 6, or further preferably greater than or equal to 1 and less than or equal to 6. Note that when $z_2/y_2$ is greater than or equal to 1 and less than or equal to 6, a CAAC-OS film to be described later as the oxide semiconductor films 113*a* and 113*c* is easily formed. As typical examples of the atomic ratio of metal elements of the target, In:M:Zn=1:3:2, In:M:Zn=1:3:4, In:M:Zn=1:3:6, In:M:Zn=1:3:8, In:M:Zn=1:4:3, In:M:Zn=1:4:4, In:M:Zn=1:4:5, In:M:Zn=1:4:6, In:M:Zn=1:6:3, In:M:Zn=1:6:4, In:M:Zn=1:6:5, In:M:Zn=1:6:6, In:M:Zn=1:6:7, In:M:Zn=1:6:8, In:M:Zn=1:6:9, and the like can be given.

Note that a proportion of each atom in the atomic ratio of the oxide semiconductor films 113*a*, 113*b*, and 113*c* varies within a range of ±40% as an error.

The atomic ratio is not limited to the above, and the atomic ratio may be appropriately set in accordance with needed semiconductor characteristics.

The oxide semiconductor film 113*a* and the oxide semiconductor film 113*c* may have the same composition. For example, as the oxide semiconductor film 113*a* and the oxide semiconductor film 113*c*, an In—Ga—Zn oxide in which the atomic ratio of In to Ga and Zn is 1:3:2, 1:3:4, 1:4:5, 1:4:6, 1:4:7, or 1:4:8 may be used.

Alternatively, the oxide semiconductor films 113*a* and 113*c* may have different compositions. For example, an In—Ga—Zn oxide film in which the atomic ratio of In to Ga and Zn is 1:3:2 may be used as the oxide semiconductor film 113*a*, whereas an In—Ga—Zn oxide film in which the atomic ratio of In to Ga and Zn is 1:3:4 or 1:4:5 may be used as the oxide semiconductor film 113*c*.

The thickness of each of the oxide semiconductor films 113*a* and 113*c* is greater than or equal to 3 nm and less than or equal to 100 nm, or preferably greater than or equal to 3 nm and less than or equal to 50 nm. The thickness of the oxide semiconductor film 113*b* is greater than or equal to 3 nm and less than or equal to 200 nm, greater than or equal to 3 nm and less than or equal to 100 nm, or greater than or equal to 3 nm and less than or equal to 50 nm. When the thicknesses of the oxide semiconductor films 113*a* and 113*c* are made smaller than that of the oxide semiconductor film 113*b*, the amount of change in the threshold voltage of the transistor can be reduced.

The interface between the oxide semiconductor film 113*b* and each of the oxide semiconductor films 113*a* and 113*c* can be observed by scanning transmission electron microscopy (STEM) in some cases.

Oxygen vacancies in the oxide semiconductor film 113*b* can be reduced by providing the oxide semiconductor films 113*a* and 113*c* in which oxygen vacancies are less likely to be generated than the oxide semiconductor film 113*b* in contact with the upper surface and the lower surface of the oxide semiconductor film 113*b*. Furthermore, since the oxide semiconductor film 113*b* is in contact with the oxide semiconductor films 113*a* and 113*c* containing one or more metal elements forming the oxide semiconductor film 113*b*, the interface state densities between the oxide semiconductor film 113*a* and the oxide semiconductor film 113*b* and between the oxide semiconductor film 113*b* and the oxide semiconductor film 113*c* are extremely low. Accordingly, oxygen vacancies contained in the oxide semiconductor film 113*b* can be reduced.

In addition, with the oxide semiconductor film 113*a*, variation in the electrical characteristics of the transistor, such as a threshold voltage, can be reduced.

Since the oxide semiconductor film 113*c* containing one or more metal elements forming the oxide semiconductor film 113*b* is provided in contact with the oxide semiconductor film 113*b*, scattering of carriers does not easily occur at an interface between the oxide semiconductor film 113*b* and the oxide semiconductor film 113*c*, and thus the field-effect mobility of the transistor can be increased.

Furthermore, the oxide semiconductor films 113*a* and 113*c* each also serve as a barrier film which suppresses formation of an impurity state due to the entry of the constituent elements of the insulating films 111 and 117 into the oxide semiconductor film 113*b*.

As described above, in the transistors described in this embodiment, variation in the electrical characteristics, such as a threshold voltage, is reduced. The display device described in the any of the above embodiments is formed using transistors in which variation in the threshold voltage is reduced; thus, variation in the threshold voltage can be corrected easily and effectively.

Figure 25A:
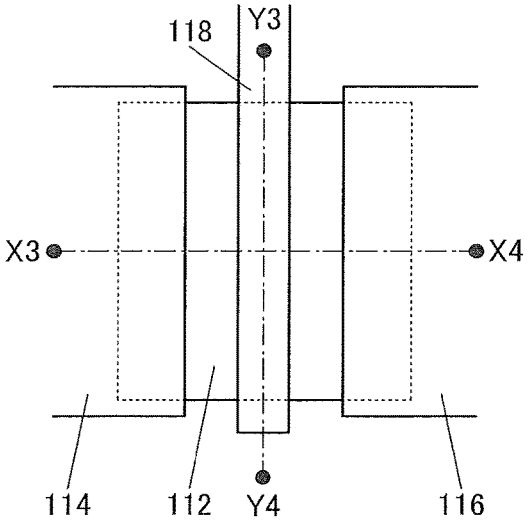
FIGS. 25A to 25C are a top view and cross-sectional views illustrating one embodiment of the present invention.
Figure 25B:
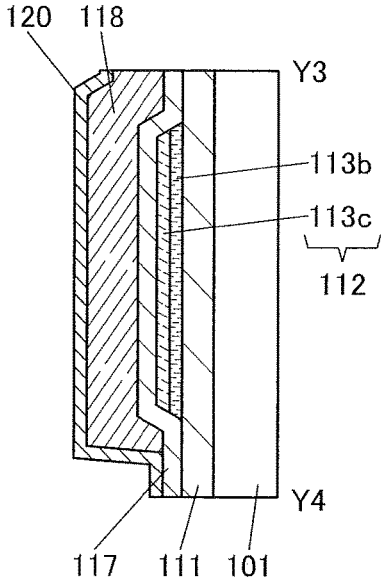
Figure 25C:
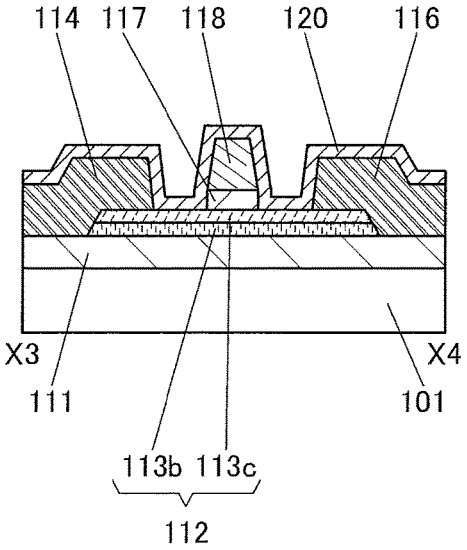

A transistor having a structure different from that in FIGS. 24A to 24C is illustrated in FIGS. 25A to 25C.

FIGS. 25A to 25C are a top view and cross-sectional views of the transistor 100E included in the display device. FIG. 25A is a top view of the transistor 100E, FIG. 25B is a cross-sectional view taken along dashed-dotted line Y3-Y4 in FIG. 25A, and FIG. 25C is a cross-sectional view taken along dashed-dotted line X3-X4 in FIG. 25A. Note that in FIG. 25A, the substrate 101, the insulating films 111, 117, and 120, and the like are omitted for simplicity. FIG. 25B is the cross-sectional view of the transistor 100E in the channel width direction. Moreover, FIG. 25C is the cross-sectional view of the transistor 100E in the channel length direction.

Like the oxide semiconductor film 112 of the transistor 100E illustrated in FIGS. 25A to 25C, the oxide semiconductor film 112 may have a stacked-layer structure of the oxide semiconductor film 113*b* in contact with the insulating film 111 and the oxide semiconductor film 113*c* in contact with the oxide semiconductor film 113*b* and the insulating film 117.

<Band Structure>

Figure 30A:
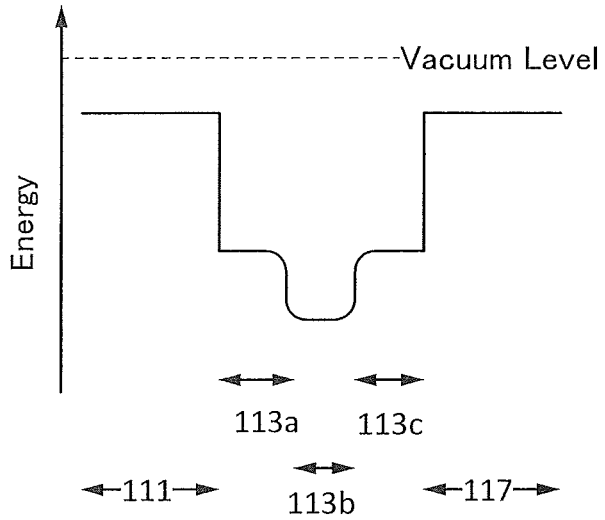
FIGS. 30A and 30B are schematic diagrams of band structures illustrating one embodiment of the present invention.
Figure 30B:
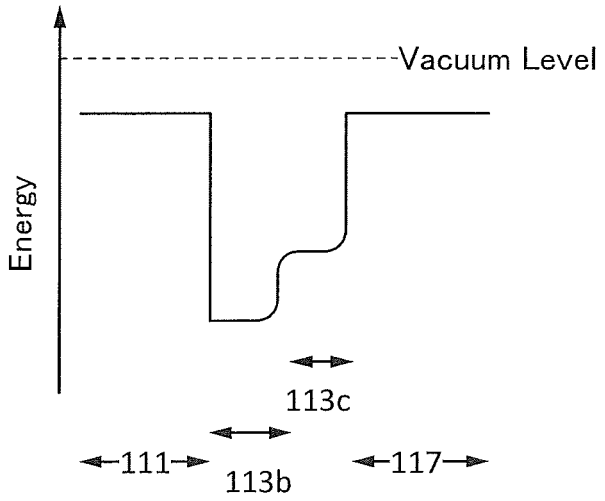

Here, the band structures of the transistor illustrated in FIGS. 24A to 24C and the transistor illustrated in FIGS. 25A to 25C are described. Note that FIG. 30A shows the band structure of the transistor 100D illustrated in FIGS. 24A to 24C, and for easy understanding, the energy (Ec) of the bottom of the conduction band of each of the insulating film 111, the oxide semiconductor films 113*a*, 113*b*, and 113*c*, and the insulating film 117 is shown. FIG. 30B shows the band structure of the transistor 100E illustrated in FIGS. 25A to 25C, and for easy understanding, the energy (Ec) of the bottom of the conduction band of each of the insulating film 111, the oxide semiconductor films 113*b* and 113*c*, and the insulating film 117 is shown.

As illustrated in FIG. 30A, the energies at the bottoms of the conduction bands are changed continuously in the oxide semiconductor films 113*a*, 113*b*, and 113*c*. This can be understood also from the fact that the constituent elements are common among the oxide semiconductor films 113*a*, 113*b*, and 113*c* and oxygen is easily diffused among the oxide semiconductor films 113*a* to 113*c*. Thus, the oxide semiconductor films 113*a*, 113*b*, and 113*c* have a continuous physical property although they are a stack of films having different compositions.

The oxide semiconductor films that are stacked and contain the same main components have not only a simple stacked-layer structure of the layers but also a continuous energy band (here, in particular, a well structure having a U shape in which energies at the bottoms of the conduction bands are changed continuously between layers (U-shaped well)). That is, the stacked-layer structure is formed so that a defect state which serves as a trap center or a recombination center in an oxide semiconductor, or an impurity which inhibits the flow of carriers does not exist at interfaces between the layers. If impurities are mixed between the oxide semiconductor films stacked, the continuity of the energy band is lost and carriers disappear by a trap or recombination.

Note that FIG. 30A illustrates the case where the Ec of the oxide semiconductor film 113*a* and the Ec of the oxide semiconductor film 113*c* are equal to each other, however, they may be different from each other.

As illustrated in FIG. 30A, the oxide semiconductor film 113*b* serves as a well and a channel of the transistor 100D is formed in the oxide semiconductor film 113*b*. Note that since the energies at the bottoms of the conduction bands are changed continuously in the oxide semiconductor films 113*a*, 113*b*, and 113*c*, a channel in the well structure having a U shape can also be referred to as a buried channel.

As illustrated in FIG. 30B, the energies at the bottoms of the conduction bands are changed continuously in the oxide semiconductor films 113*b* and 113*c*.

As illustrated in FIG. 30B, the oxide semiconductor film 113*b* serves as a well and a channel of the transistor 100E is formed in the oxide semiconductor film 113*b*.

The transistor 100D illustrated in FIGS. 24A to 24C includes the oxide semiconductor films 113*a* and 113*c* containing one or more metal elements forming the semiconductor film 113*b*; therefore, interface states are not easily formed at the interface between the oxide semiconductor film 113*a* and the oxide semiconductor film 113*b* and the interface between the oxide semiconductor film 113*c* and the oxide semiconductor film 113*b*. Thus, with the oxide semiconductor films 113*a* and 113*c*, variation or change in the electrical characteristics of the transistor, such as a threshold voltage, can be reduced.

The transistor 100E illustrated in FIGS. 25A to 25C includes the oxide semiconductor film 113*c* containing one or more metal elements forming the semiconductor film 113*b*; therefore, an interface state is not easily formed at the interface between the oxide semiconductor film 113*c* and the oxide semiconductor film 113*b*. Thus, with the oxide semiconductor film 113*c*, variation or change in the electrical characteristics of the transistor, such as a threshold voltage, can be reduced. The display device described in any of the above embodiments is formed using the transistors in which variation in the threshold voltage is reduced; thus, variation in the threshold voltage can be corrected easily and effectively.

<Structure Example 4 of Transistor>

Next, another structure of the transistor included in the light-emitting device is described with reference to FIGS. 27A to 27D.

Figure 27A:
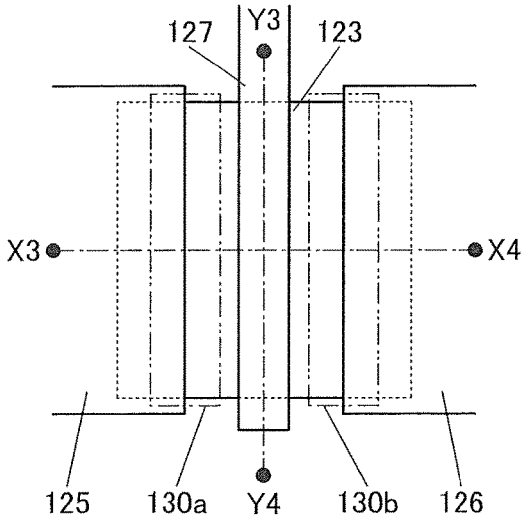
FIGS. 27A to 27D are a top view and cross-sectional views illustrating one embodiment of the present invention.
Figure 27B:
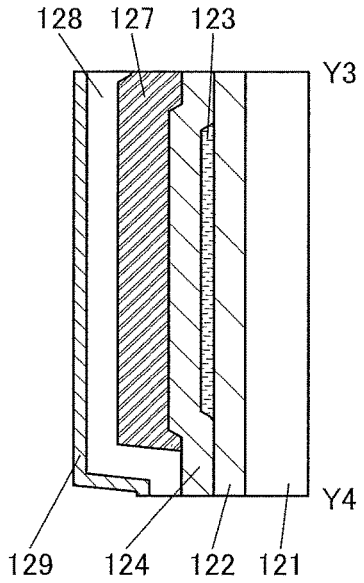
Figure 27C:
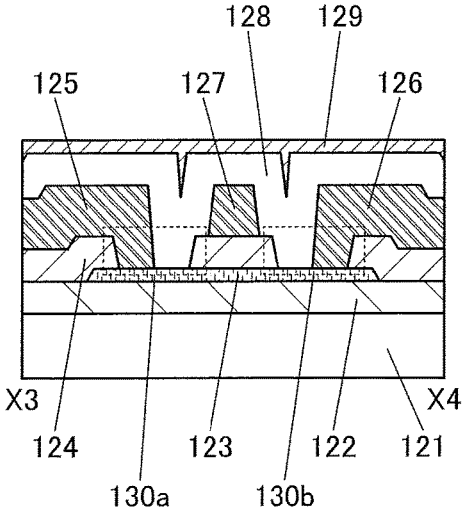

FIGS. 27A to 27C are a top view and cross-sectional views of a transistor 100F included in the display device. FIG. 27A is a top view of the transistor 100F, FIG. 27B is a cross-sectional view taken along dashed-dotted line Y3-Y4 in FIG. 27A, and FIG. 27C is a cross-sectional view taken along dashed-dotted line X3-X4 in FIG. 27A.

The transistor 100F illustrated in FIGS. 27A to 27D includes an oxide semiconductor film 123 over an insulating film 122 formed over a substrate 121, an insulating film 124 in contact with the oxide semiconductor film 123, a conductive film 125 in contact with the oxide semiconductor film 123 in part of an opening 130*a* formed in the insulating film 124, a conductive film 126 in contact with the oxide semiconductor film 123 in part of an opening 130*b* formed in the insulating film 124, and a conductive film 127 overlapping with the oxide semiconductor film 123 with the insulating film 124 provided therebetween. Note that insulating films 128 and 129 may be provided over the transistor 100F.

Regions of the oxide semiconductor film 123 not overlapping with the conductive films 125 and 126 and the conductive film 127 each include an element which forms an oxygen vacancy. An element which forms oxygen vacancy is described below as an impurity element. Typical examples of an impurity element are hydrogen, boron, carbon, nitrogen, fluorine, aluminum, silicon, phosphorus, chlorine, a rare gas element, and the like. Typical examples of a rare gas element are helium, neon, argon, krypton, and xenon.

When the impurity element is added to the oxide semiconductor film, a bond between a metal element and oxygen in the oxide semiconductor film is cut, whereby an oxygen vacancy is formed. When the impurity element is added to the oxide semiconductor film, oxygen bonded to a metal element in the oxide semiconductor film is bonded to the impurity element, whereby oxygen is detached from the metal element and accordingly an oxygen vacancy is formed. As a result, the oxide semiconductor film has a higher carrier density and thus the conductivity thereof becomes higher.

Figure 27D:
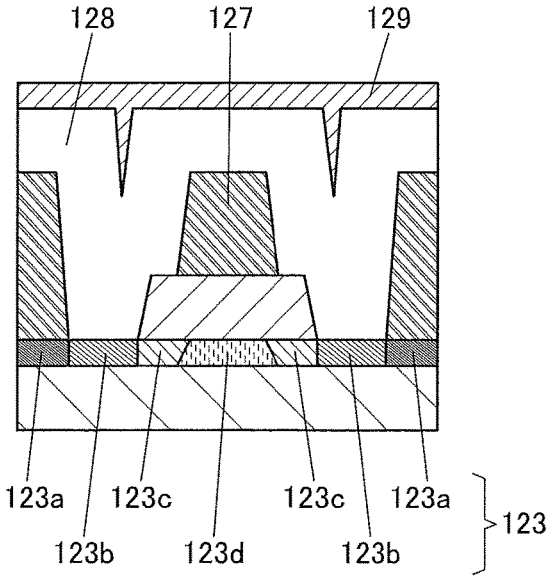

Here, FIG. 27D is a partial enlarged view of the oxide semiconductor film 123. As illustrated in FIG. 27D, the oxide semiconductor film 123 includes regions 123*a* in contact with the conductive films 125 and 126, regions 123*b* in contact with the insulating film 128, and regions 123*c* and a region 123*d* overlapping with the insulating film 124.

The regions 123*a* have high conductivity and function as a source region and a drain region in a manner similar to that of the regions 112*a* illustrated in FIGS. 22A and 22B.

The regions 123*b* and 123*c* function as low-resistance regions. The regions 123*b* and 123*c* contain an impurity element. Note that the concentrations of the impurity element in the regions 123*b* are higher than those in the regions 123*c*. Note that in the case where the conductive film 127 has a tapered side surface, part of the regions 123*c* may overlap with the conductive film 127.

In the case where a rare gas element is used as the impurity element and the oxide semiconductor film 123 is formed by a sputtering method, the regions 123*a* to 123*d* contain the rare gas element, and the concentrations of the rare gas elements in the regions 123*b* and 123*c* are higher than those in the regions 123*a* and 123*d*. This is due to the fact that in the case where the oxide semiconductor film 123 is formed by a sputtering method, the rare gas element is contained in the oxide semiconductor film 123 because the rare gas element is used as a sputtering gas and the rare gas element is intentionally added to the oxide semiconductor film 123 in order to form oxygen vacancies in the regions 123*b* and 123*c*. Note that a rare gas element different from that in the regions 123*a* and 123*d* may be added to the regions 123*b* and 123*c*.

In the case where the impurity element is boron, carbon, nitrogen, fluorine, aluminum, silicon, phosphorus, or chlorine, only the regions 123*b* and 123*c* contain the impurity element. Therefore, the concentrations of the impurity element in the regions 123*b* and 123*c* are higher than those in the regions 123*a* and 123*d*. Note that the concentrations of the impurity element in the regions 123*b* and 123*c* which are measured by SIMS can be greater than or equal to $1\times10^{18}$ atoms/cm$^3$ and less than or equal to $1\times10^{22}$ atoms/cm$^3$, greater than or equal to $1\times10^{19}$ atoms/cm$^3$ and less than or equal to $1\times10^{21}$ atoms/cm$^3$, or greater than or equal to $5\times10^{19}$ atoms/cm$^3$ and less than or equal to $5\times10^{20}$ atoms/cm$^3$.

The concentrations of the impurity element in the regions 123*b* and 123*c* are higher than those in the regions 123*a* and 123*d* in the case where the impurity elements are hydrogen. Note that the concentrations of hydrogen in the regions 123*b* and 123*c* which are measured by SIMS can be greater than or equal to $8\times10^{19}$ atoms/cm$^3$, greater than or equal to $1\times10^{20}$ atoms/cm$^3$, or greater than or equal to $5\times10^{20}$ atoms/cm$^3$.

Since the regions 123*b* and 123*c* contain the impurity elements, oxygen vacancies and carrier densities of the regions 123*b* and 123*c* are increased. As a result, the region 123*b* and the region 123*c* have higher conductivity and serve as low-resistance regions. By provision of the low-resistance regions in such a manner, the resistance between the channel and the source region and the drain region can be reduced, and the transistor 190 and the transistor 194 have high on-state current and high field-effect mobility. Thus, the transistor 100F can be preferably used as the driving transistor (e.g., the transistor 22) described in the above embodiment.

Note that impurity element may be a combination of one or more of hydrogen, boron, carbon, nitrogen, fluorine, aluminum, silicon, phosphorus, and chlorine and one or more of the rare gas elements. In that case, due to interaction between oxygen vacancies formed by the rare gas elements in the regions 123*b* and 123*c* and one or more of hydrogen, boron, carbon, nitrogen, fluorine, aluminum, silicon, phosphorus, and chlorine added to the above regions, the conductivity of the regions 123*b* and 123*c* might be further increased.

The region 123*d* serves as a channel.

A region of the insulating film 124 overlapping with the oxide semiconductor film 123 and the conductive film 127 functions as a gate insulating film. In addition, a region of the insulating film 124 overlapping with the oxide semiconductor film 123 and the conductive films 125 and 126 functions as an interlayer insulating film.

The conductive film 125 and the conductive film 126 serve as a source electrode and a drain electrode. The conductive film 127 functions as a gate electrode.

In the manufacturing process of the transistor 100F described in this embodiment, the conductive film 127 functioning as a gate electrode and the conductive films 125 and 126 functioning as a source electrode and a drain electrode are formed at the same time. Therefore, in the transistor 100F, the conductive film 127 does not overlap with the conductive films 125 and 126, and parasitic capacitance formed between the conductive film 127 and each of the conductive films 125 and 126 can be reduced. As a result, in the case where a large-sized substrate is used as the substrate 121, signal delays in the conductive films 125 and 126 and the conductive film 127 can be reduced.

In addition, in the transistor 100F, the impurity element is added to the oxide semiconductor film 123 using the conductive films 125 and 126 and the conductive film 127 as masks. That is, the low-resistance region can be formed in a self-aligned manner.

The substrate 101 illustrated in FIGS. 21A and 21B can be used as appropriate as the substrate 121.

As the insulating film 122, the insulating film 111 illustrated in FIGS. 21A and 21B can be used as appropriate.

The oxide semiconductor films 103 and 112 illustrated in FIGS. 21A and 21B can be used as appropriate as the oxide semiconductor film 123.

The insulating films 106 and 117 illustrated in FIGS. 21A and 21B can be used as appropriate as the insulating film 124.

Since the conductive films 125 and 126 and the conductive film 127 are formed at the same time, they are formed using the same materials and have the same stacked-layer structures.

The conductive films 114 and 116, the conductive film 118, the conductive films 104 and 105, the conductive film 102, and the conductive film 107 illustrated in FIGS. 21A and 21B can be used as appropriate as the conductive films 125 and 126 and the conductive film 127.

The insulating film 128 can be formed with a single layer or a stack using one or more of an oxide insulating film and a nitride insulating film. Note that an oxide insulating film is preferably used as at least a region of the insulating film 128 that is in contact with the oxide semiconductor film 123, in order to improve characteristics of the interface with the oxide semiconductor film 123. An oxide insulating film that releases oxygen by being heated is preferably used as the insulating film 128, in which case oxygen contained in the insulating film 128 can be moved to the oxide semiconductor film 123 by heat treatment.

The insulating film 128 can be formed with a single layer or a stack using, for example, one or more of silicon oxide, silicon oxynitride, silicon nitride oxide, silicon nitride, aluminum oxide, hafnium oxide, gallium oxide, a Ga—Zn oxide, and the like.

It is preferable that the insulating film 129 be a film functioning as a barrier film against hydrogen, water, or the like from the outside. The insulating film 129 can be formed with a single layer or a stack using, for example, one or more of silicon nitride, silicon nitride oxide, aluminum oxide, and the like.

The thicknesses of the insulating films 128 and 129 each can be greater than or equal to 30 nm and less than or equal to 500 nm, or greater than or equal to 100 nm and less than or equal to 400 nm.

Note that in a manner similar to that of the transistor 100B illustrated in FIGS. 21A and 21B, the transistor 100F can have a dual-gate structure in which a conductive film is provided below the insulating film 122 so as to overlap with the oxide semiconductor film 123.

<Structure Example 5 of Transistor>

Next, another structure of the transistor included in the display device is described with reference to FIGS. 28A to 28C and FIGS. 29A and 29B.

Figure 28A:
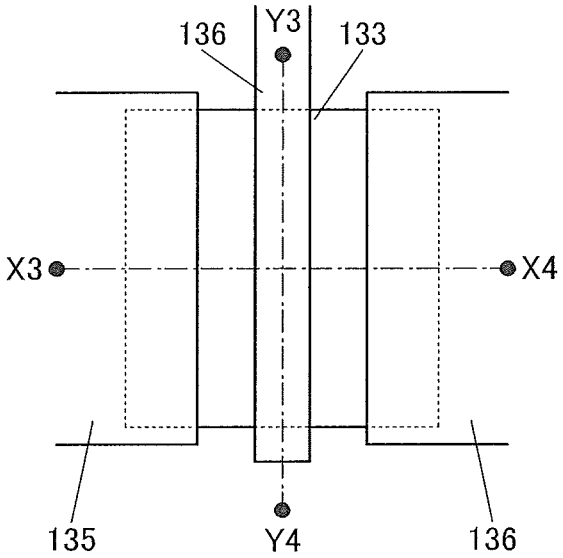
FIGS. 28A to 28C are a top view and cross-sectional views illustrating one embodiment of the present invention.
Figure 28B:
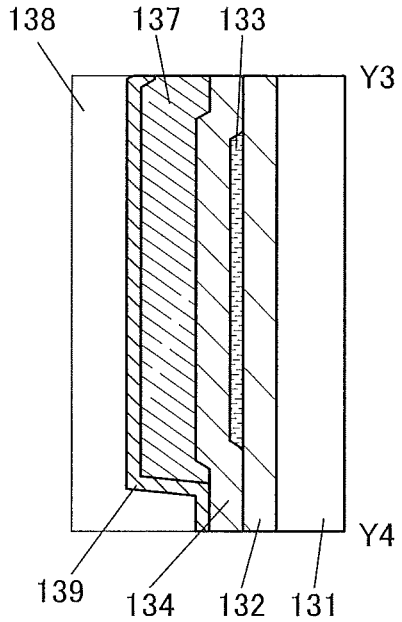
Figure 28C:
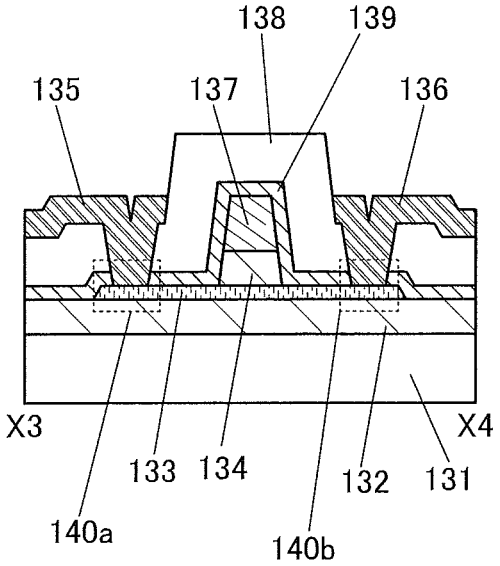

FIGS. 28A to 28C are a top view and cross-sectional views of a transistor 100G included in the display device. FIG. 28A is a top view of the transistor 100G, FIG. 28B is a cross-sectional view taken along dashed-dotted line Y3-Y4 in FIG. 28A, and FIG. 28C is a cross-sectional view taken along dashed-dotted line X3-X4 in FIG. 28A.

The transistor 100G illustrated in FIGS. 28A to 28C includes an oxide semiconductor film 133 over an insulating film 132 formed over a substrate 131, an insulating film 134 in contact with the oxide semiconductor film 133, a conductive film 137 overlapping with the oxide semiconductor film 133 with the insulating film 134 provided therebetween, an insulating film 139 in contact with the oxide semiconductor film 133, an insulating film 138 formed over the insulating film 139, a conductive film 135 in contact with the oxide semiconductor film 133 in an opening 140*a* formed in the insulating films 138 and 139, and a conductive film 136 in contact with the oxide semiconductor film 133 in an opening 140*b* formed in the insulating films 138 and 139.

The conductive film 137 of the transistor 100G functions as a gate electrode. The conductive films 135 and 136 function as a source electrode and a drain electrode.

Regions of the oxide semiconductor film 133 not overlapping with the conductive films 135 and 136 and the conductive film 137 each include an element which forms an oxygen vacancy. An element which forms oxygen vacancy is described below as an impurity element. Typical examples of an impurity element are hydrogen, boron, carbon, nitrogen, fluorine, aluminum, silicon, phosphorus, chlorine, a rare gas element, and the like. Typical examples of a rare gas element are helium, neon, argon, krypton, and xenon.

When the impurity element is added to the oxide semiconductor film, a bond between a metal element and oxygen in the oxide semiconductor film is cut, whereby an oxygen vacancy is formed. When the impurity element is added to the oxide semiconductor film, oxygen bonded to a metal element in the oxide semiconductor film is bonded to the impurity element, whereby oxygen is detached from the metal element and accordingly an oxygen vacancy is formed. As a result, the oxide semiconductor film has a higher carrier density and thus the conductivity thereof becomes higher.

Figure 29A:
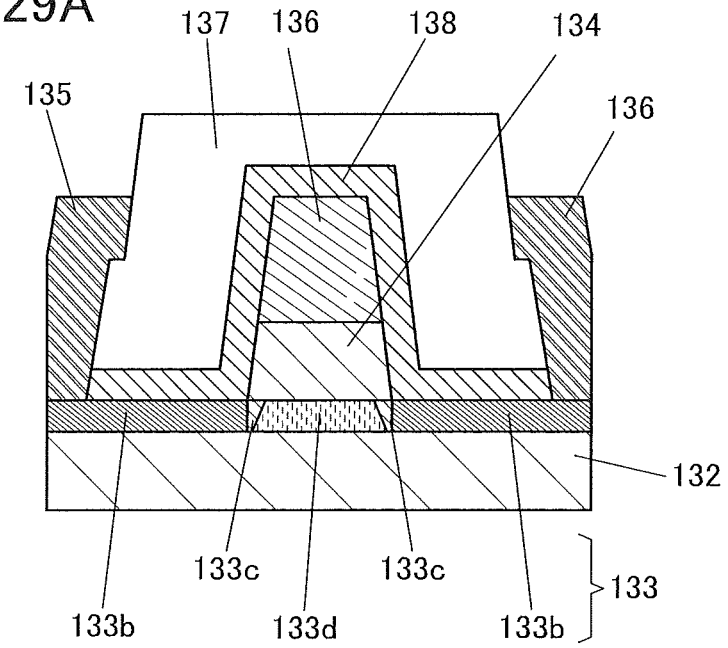
FIGS. 29A and 29B are cross-sectional views illustrating one embodiment of the present invention.
Figure 29B:
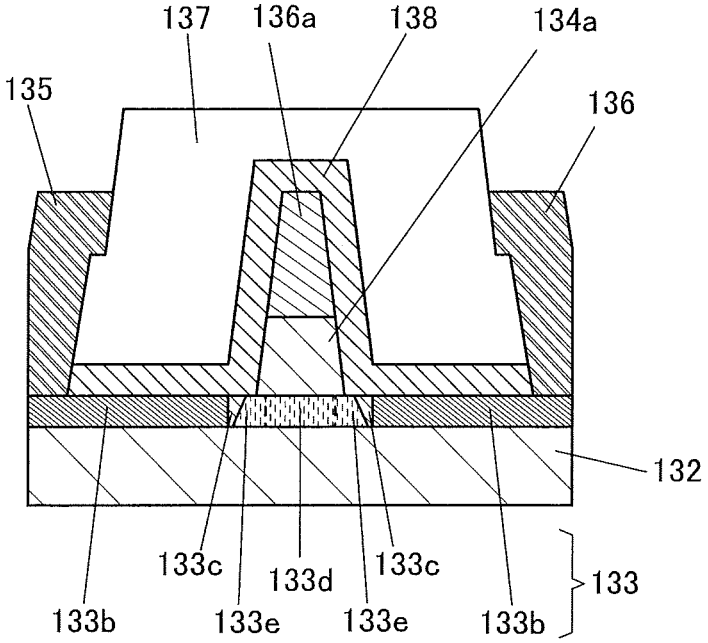

Here, FIG. 29A is a partial enlarged view of the oxide semiconductor film 133. As illustrated in FIG. 29A, the oxide semiconductor film 133 includes regions 133*b* in contact with the conductive films 135 and 136 or the insulating film 138 and a region 133*d* in contact with the insulating film 134. Note that in the case where the conductive film 137 has a tapered side surface, the oxide semiconductor film 133 may include a region 133*c* overlapping with a tapered portion of the conductive film 137.

The region 133*b* functions as a low-resistance region. The region 133*b* contains at least a rare gas element and hydrogen as impurity elements. Note that in the case where the conductive film 137 has a tapered side surface, the impurity element is added to the region 133*c* through the tapered portion of the conductive film 137; therefore, the region 133*c* contains the impurity element, though the concentration of the rare gas element which is an example of the impurity element of the region 133*c* is lower than that in the region 133*b*. With the regions 133*c*, source-drain breakdown voltage of the transistor can be increased.

In the case where the oxide semiconductor film 133 is formed by a sputtering method, the regions 133*b* to 133*d* each contain the rare gas element, and the concentrations of the rare gas elements in the regions 133*b* and 133*c* are higher than those in the region 133*d*. This is due to the fact that in the case where the oxide semiconductor film 133 is formed by a sputtering method, the rare gas element is contained in the oxide semiconductor film 133 because the rare gas element is used as a sputtering gas and the rare gas element is intentionally added to the oxide semiconductor film 133 in order to form oxygen vacancies in the regions 133*b* and 133*c*. Note that a rare gas element different from that in the region 133*d* may be added to the regions 133*b* and 133*c*.

Since the region 133*b* is in contact with the insulating film 138, the concentration of hydrogen in the region 133*b* is higher than that in the region 133*d*. In addition, in the case where hydrogen is diffused from the region 133*b* to the region 133*c*, the concentration of hydrogen in the region 133*c* is higher than that in the region 133*d*. However, the concentration of hydrogen in the region 133*b* is higher than that in the region 133*c*.

In the regions 133*b* and 133*c*, the concentrations of hydrogen measured by secondary ion mass spectrometry (SIMS) can be greater than or equal to $8\times10^{19}$ atoms/cm$^3$, greater than or equal to $1\times10^{20}$ atoms/cm$^3$, or greater than or equal to $5\times10^{20}$ atoms/cm$^3$. Note that the concentration of hydrogen in the region 133*d* which is measured by secondary ion mass spectrometry can be less than or equal to $5\times10^{19}$ atoms/cm$^3$, less than or equal to $1\times10^{19}$ atoms/cm$^3$, less than or equal to $5\times10^{18}$ atoms/cm$^3$, less than or equal to $1\times10^{18}$ atoms/cm$^3$, less than or equal to $5\times10^{17}$ atoms/cm$^3$, or less than or equal to $1\times10^{16}$ atoms/cm$^3$.

In the case where boron, carbon, nitrogen, fluorine, aluminum, silicon, phosphorus, or chlorine is added to the oxide semiconductor film 133 as an impurity element, only the regions 133*b* and 133*c* contain the impurity element. Therefore, the concentrations of the impurity element in the regions 133*b* and 133*c* are higher than that in the region 133*d*. Note that the concentrations of the impurity element in the regions 133*b* and 133*c* which are measured by secondary ion mass spectrometry can be greater than or equal to $1\times10^{18}$ atoms/cm$^3$ and less than or equal to $1\times10^{22}$ atoms/cm$^3$, greater than or equal to $1\times10^{19}$ atoms/cm$^3$ and less than or equal to $1\times10^{21}$ atoms/cm$^3$, or greater than or equal to $5\times10^{19}$ atoms/cm$^3$ and less than or equal to $5\times10^{20}$ atoms/cm$^3$.

The regions 133*b* and 133*c* have higher concentrations of hydrogen and larger amounts of oxygen vacancies due to addition of the rare gas element than the region 133*d*. Therefore, the regions 133*b* and 133*c* have higher conductivity and function as low-resistance regions. The resistivity of the regions 133*b* and 133*c* can be typically greater than or equal to $1\times10^{-3}$ Ωcm and less than $1\times10^{4}$ Ωcm, or greater than or equal to $1\times10^{-3}$ Ωcm and less than $1\times10^{-1}$ Ωcm.

Note that when the amount of hydrogen in each of the regions 133*b* and 133*c* is the same as or smaller than the amount of oxygen vacancies therein, hydrogen is easily captured by oxygen vacancies and is less likely to be diffused to the region 133*d* serving as a channel. As a result, a transistor having normally-off characteristics can be obtained.

The region 133*d* serves as a channel.

In addition, after the impurity element is added to the oxide semiconductor film 133 using the conductive film 137 as a mask, the area of the conductive film 137 when seen from the above may be reduced. This can be performed in such a manner that a slimming process is performed on a mask over the conductive film 137 in a step of forming the conductive film 137 so as to obtain a mask with a minuter structure. Then, the conductive film 137 and the insulating film 134 are etched using the mask, so that a conductive film 137*a* and an insulating film 134*a* illustrated in FIG. 29B can be formed. As the slimming process, an ashing process using an oxygen radical or the like can be employed, for example.

As a result, an offset region 133*e* is formed between the region 133*c* and the region 133*d* serving as a channel in the oxide semiconductor film 133. Note that the length of the offset region 133*e* in the channel length direction is set to be less than 0.1 μm, whereby a decrease in the on-state current of the transistor can be suppressed.

The substrate 131 illustrated in FIGS. 21A and 21B can be used as appropriate as the substrate 131 illustrated in FIGS. 28A to 28C.

The insulating film 111 illustrated in FIGS. 21A and 21B can be used as appropriate as the insulating film 134 illustrated in FIGS. 28A to 28C.

The oxide semiconductor films 103 and 112 illustrated in FIGS. 21A and 21B can be used as appropriate as the oxide semiconductor film 133 illustrated in FIGS. 28A to 28C.

The insulating films 106 and 117 illustrated in FIGS. 21A and 21B can be used as appropriate as the insulating film 134 illustrated in FIGS. 28A to 28C.

The conductive films 114 and 116, the conductive film 118, the conductive films 104 and 105, the conductive film 102, and the conductive film 107 illustrated in FIGS. 21A and 21B can be used as appropriate as the conductive films 135 and 136 and the conductive film 137 illustrated in FIGS. 28A to 28C.

The thicknesses of the insulating films 137 and 138 each can be greater than or equal to 30 nm and less than or equal to 500 nm, or greater than or equal to 100 nm and less than or equal to 400 nm.

In the transistor 100G, the conductive film 137 does not overlap with the conductive films 135 and 136, and parasitic capacitance formed between the conductive film 137 and each of the conductive films 135 and 136 can be reduced. As a result, in the case where a large-sized substrate is used as the substrate 131, signal delays in the conductive films 135 and 136 and the conductive film 137 can be reduced.

In addition, in the transistor 100G, the impurity element is added to the oxide semiconductor film 133 using the conductive film 137 as a mask. That is, the low-resistance regions can be formed in a self-aligned manner.

Note that in a manner similar to that of the transistor 100B illustrated in FIGS. 21A and 21B, the transistor 100G can have a dual-gate structure in which a conductive film is provided below the insulating film 132 so as to overlap with the oxide semiconductor film 133.

The structure described above in this embodiment can be combined as appropriate with any of the structures described in the other embodiments.

Embodiment 5

Figure 31:
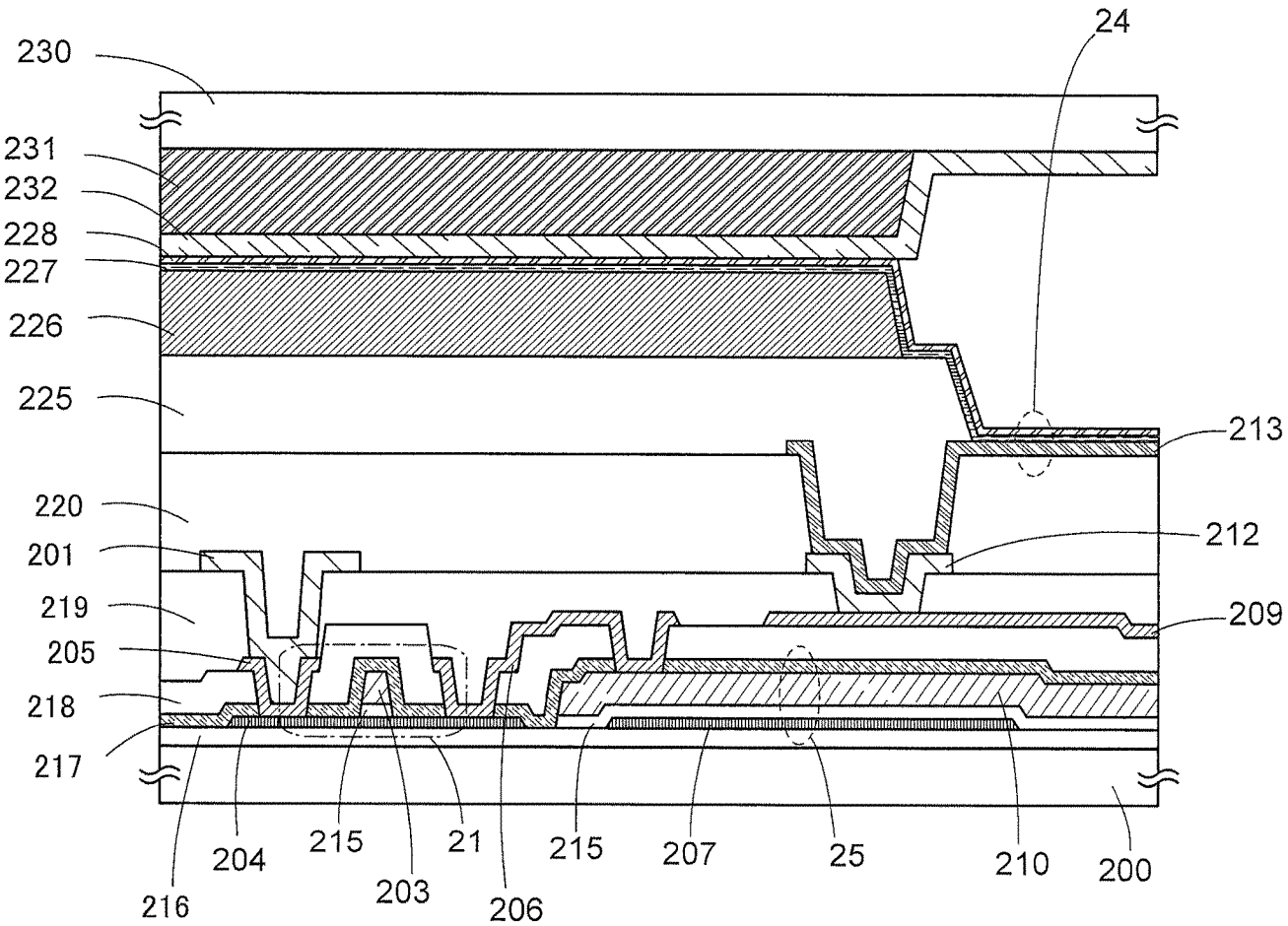
FIG. 31 is a cross sectional view illustrating one embodiment of the present invention.

An example of a cross-sectional structure of a display device will be described in this embodiment. FIG. 31 illustrates the cross-sectional structure of the transistor 21, the capacitor 25, and the light-emitting element 24 of the pixel 20

Specifically, the display device illustrated in FIG. 31 includes an insulating film 216 over a substrate 200, and the transistor 21 and the capacitor 25 over the insulating film 216. The transistor 21 includes a semiconductor film 204, an insulating film 215 over the semiconductor film 204, a conductive film 203 overlapping with the semiconductor film 204 with the insulating film 215 provided therebetween and functioning as a gate, a conductive film 205 which is in contact with the semiconductor film 204 and is provided in an opening formed in an insulating film 217 and an insulating film 218, and a conductive film 206 which is similarly in contact with the semiconductor film 204 and is provided in an opening formed in the insulating films 217 and 218. Note that the conductive films 205 and 206 function as a source and a drain of the transistor 21.

The capacitor 25 includes a semiconductor film 207 functioning as an electrode, the insulating film 215 over the semiconductor film 207, and a conductive film 210 overlapping with the semiconductor film 207 with the insulating film 215 provided therebetween and functioning as an electrode.

The insulating film 215 may be formed with a single layer or a stack of an insulating film containing one or more of aluminum oxide, aluminum oxynitride, magnesium oxide, silicon oxide, silicon oxynitride, silicon nitride oxide, silicon nitride, gallium oxide, germanium oxide, yttrium oxide, zirconium oxide, lanthanum oxide, neodymium oxide, hafnium oxide, and tantalum oxide. Note that in this specification, oxynitride contains more oxygen than nitrogen, and nitride oxide contains more nitrogen than oxygen.

In the case where an oxide semiconductor is used for the semiconductor film 204, it is preferable to use a material that can supply oxygen to the semiconductor film 204 for the insulating film 216. By using the material for the insulating film 216, oxygen contained in the insulating film 216 can be moved to the semiconductor film 204, and the amount of oxygen vacancy in the semiconductor film 204 can be reduced. Oxygen contained in the insulating film 216 can be moved to the semiconductor film 204 efficiently by heat treatment performed after the semiconductor film 204 is formed.

The insulating film 217 is provided over the semiconductor film 204 and the conductive films 203 and 210; the insulating film 218 is provided over the insulating film 217; and the conductive films 205 and 206 and a conductive film 209, and an insulating film 219 are provided over the insulating film 218. Conductive films 201 and 212 are provided over the insulating film 219, the conductive film 201 is electrically connected to the conductive film 205 in an opening formed in the insulating film 219, and the conductive film 212 is electrically connected to the conductive film 209 in an opening formed in the insulating film 219.

In the case where an oxide semiconductor is used for the semiconductor film 204, the insulating film 217 is preferably configured to block oxygen, hydrogen, water, an alkali metal, an alkaline earth metal, and the like. It is possible to prevent outward diffusion of oxygen from the semiconductor film 204 and entry of hydrogen, water, or the like into the semiconductor film 204 from the outside by providing the insulating film 217. The insulating film 217 can be formed using a nitride insulating film, for example. As the nitride insulating film, a silicon nitride film, a silicon nitride oxide film, an aluminum nitride film, an aluminum nitride oxide film, and the like can be given. Note that instead of the nitride insulating film having a blocking effect against oxygen, hydrogen, water, an alkali metal, an alkaline earth metal, and the like, an oxide insulating film having a blocking effect against oxygen, hydrogen, water, and the like may be provided. As the oxide insulating film having a blocking effect against oxygen, hydrogen, water, and the like, an aluminum oxide film, an aluminum oxynitride film, a gallium oxide film, a gallium oxynitride film, an yttrium oxide film, an yttrium oxynitride film, a hafnium oxide film, a hafnium oxynitride film, and the like can be given.

An insulating film 220 and a conductive film 213 are provided over the insulating film 219 and the conductive films 201 and 212, and the conductive film 213 is electrically connected to the conductive film 212 in an opening formed in the insulating film 220.

An insulating film 225 is provided over the insulating film 220 and the conductive film 213. The insulating film 225 has an opening in a region overlapping with the conductive film 213. Over the insulating film 225, an insulating film 226 is provided in a region different from the opening of the insulating film 225. An EL layer 227 and a conductive film 228 are sequentially stacked over the insulating films 225 and 226. A portion in which the conductive films 213 and 228 overlap with each other with the EL layer 227 provided therebetween functions as the light-emitting element 24. One of the conductive films 213 and 228 functions as an anode, and the other functions as a cathode.

The light-emitting device includes a substrate 230 that faces the substrate 200 with the light-emitting element 24 provided therebetween. A blocking film 231 having a function of blocking light is provided under the substrate 230, i.e., on a surface of the substrate 230 that is closer to the light-emitting element 24. The blocking film 231 has an opening in a region overlapping with the light-emitting element 24. In the opening overlapping with the light-emitting element 24, a coloring layer 232 that transmits visible light in a specific wavelength range is provided under the substrate 230.

Note that the insulating film 226 is provided to adjust the distance between the light-emitting element 24 and the substrate 230 and may be omitted in some cases.

Although the top-emission structure is employed in this embodiment in which light of the light-emitting element 24 is extracted from the side opposite to the element substrate, a bottom-emission structure in which light of the light-emitting element 24 is extracted from the element substrate side or a dual-emission structure in which light of the light-emitting element 24 is extracted from both the element substrate side and the side opposite to the element substrate can also be applied to embodiments of the present invention.

The structure described above in this embodiment can be combined as appropriate with any of the structures described in the other embodiments.

Embodiment 6

In this embodiment, a display device including a light-emitting element of one embodiment of the present invention and an electronic device in which the display device is provided with an input device will be described with reference to FIGS. 32A and 32B, FIGS. 33A to 33C, and FIGS. 34A and 34B.

<Description 1 of Touch Panel>

In this embodiment, a touch panel 500 including a display device and an input device will be described as an example of an electronic device. In addition, an example in which a touch sensor is used as an input device will be described.

Figure 32A:
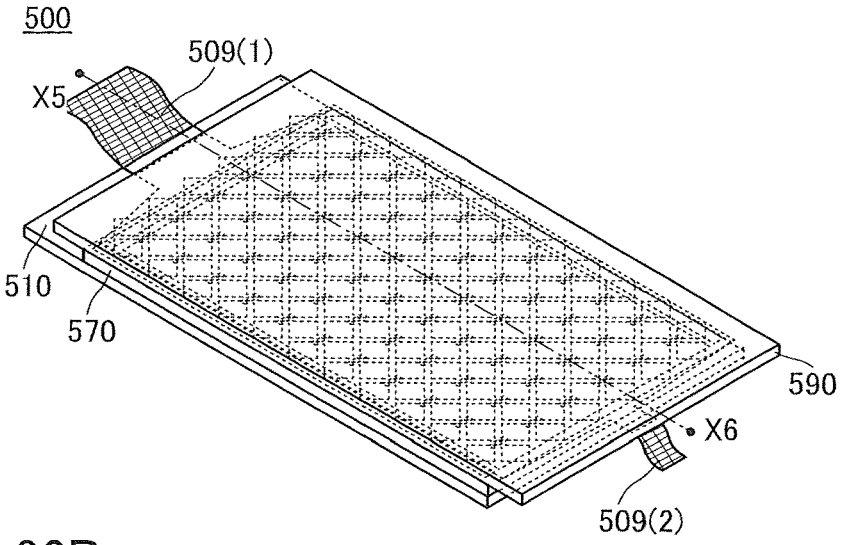
FIGS. 32A and 32B are perspective view illustrating one embodiment of the present invention.
Figure 32B:
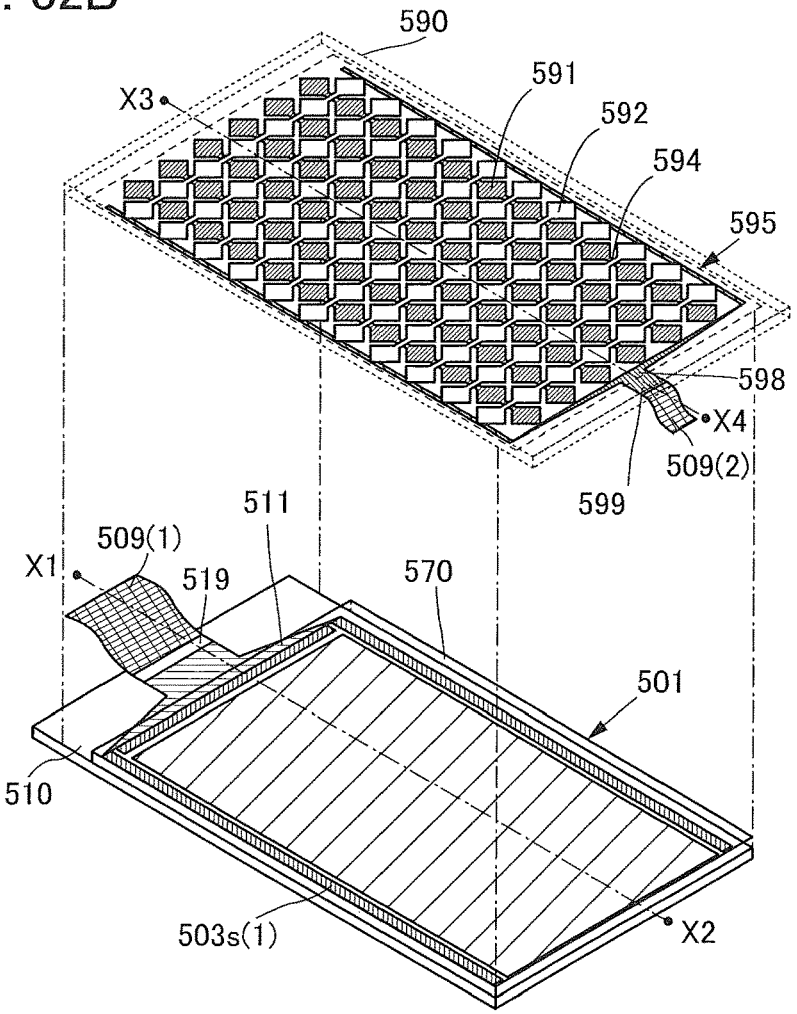

FIGS. 32A and 32B are perspective views of the touch panel 500. Note that FIGS. 32A and 32B illustrate only main components of the touch panel 500 for simplicity.

The touch panel 500 includes a display device 501 and a touch sensor 595 (see FIG. 32B). The touch panel 500 also includes a substrate 510, a substrate 570, and a substrate 590. The substrate 510, the substrate 570, and the substrate 590 each have flexibility. Note that one or all of the substrates 510, 570, and 590 may be inflexible.

The display device 501 includes a plurality of pixels over the substrate 510 and a plurality of wirings 511 through which signals are supplied to the pixels. The plurality of wirings 511 are led to a peripheral portion of the substrate 510, and parts of the plurality of wirings 511 form a terminal 519. The terminal 519 is electrically connected to an FPC 509(1).

The substrate 590 includes the touch sensor 595 and a plurality of wirings 598 electrically connected to the touch sensor 595. The plurality of wirings 598 are led to a peripheral portion of the substrate 590, and parts of the plurality of wirings 598 form a terminal. The terminal is electrically connected to an FPC 509(2). Note that in FIG. 32B, electrodes, wirings, and the like of the touch sensor 595 provided on the back side of the substrate 590 (the side facing the substrate 510) are indicated by solid lines for clarity.

As the touch sensor 595, a capacitive touch sensor can be used. Examples of the capacitive touch sensor are a surface capacitive touch sensor and a projected capacitive touch sensor.

Examples of the projected capacitive touch sensor are a self capacitive touch sensor and a mutual capacitive touch sensor, which differ mainly in the driving method. The use of a mutual capacitive type is preferable because multiple points can be sensed simultaneously.

Note that the touch sensor 595 illustrated in FIG. 32B is an example of using a projected capacitive touch sensor.

Note that a variety of sensors that can sense proximity or touch of a sensing target such as a finger can be used as the touch sensor 595.

The projected capacitive touch sensor 595 includes electrodes 591 and electrodes 592. The electrodes 591 are electrically connected to any of the plurality of wirings 598, and the electrodes 592 are electrically connected to any of the other wirings 598.

The electrodes 592 each have a shape of a plurality of quadrangles arranged in one direction with one corner of a quadrangle connected to one corner of another quadrangle as illustrated in FIGS. 32A and 32B.

The electrodes 591 each have a quadrangular shape and are arranged in a direction intersecting with the direction in which the electrodes 592 extend.

A wiring 594 electrically connects two electrodes 591 between which the electrode 592 is positioned. The intersecting area of the electrode 592 and the wiring 594 is preferably as small as possible. Such a structure allows a reduction in the area of a region where the electrodes are not provided, reducing variation in transmittance. As a result, variation in luminance of light passing through the touch sensor 595 can be reduced.

Note that the shapes of the electrodes 591 and the electrodes 592 are not limited thereto and can be any of a variety of shapes. For example, a structure may be employed in which the plurality of electrodes 591 are arranged so that gaps between the electrodes 591 are reduced as much as possible, and the electrodes 592 are spaced apart from the electrodes 591 with an insulating layer interposed therebetween to have regions not overlapping with the electrodes 591. In this case, it is preferable to provide, between two adjacent electrodes 592, a dummy electrode electrically insulated from these electrodes because the area of regions having different transmittances can be reduced.

<Display Device>

Figure 33A:
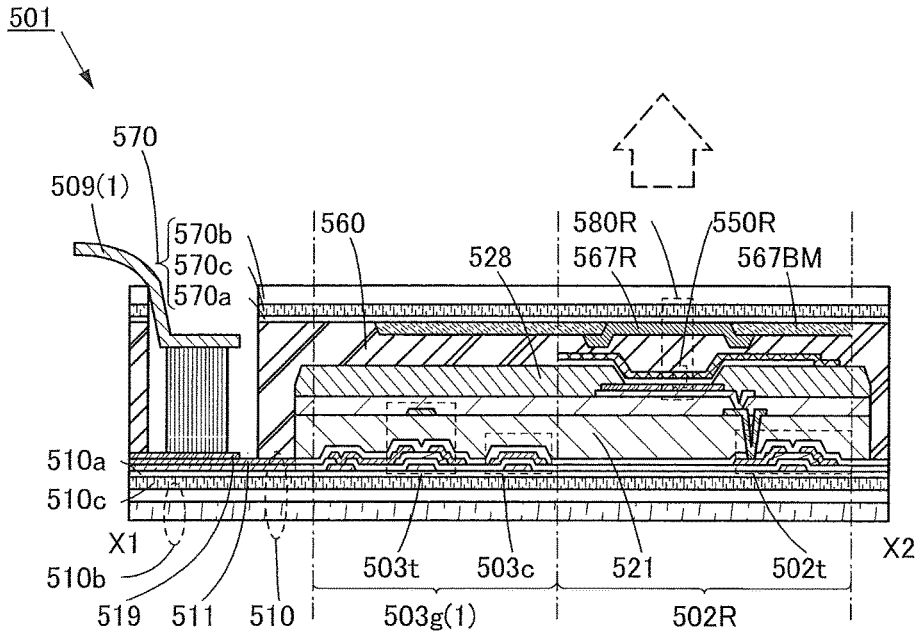
FIGS. 33A to 33C are cross-sectional views illustrating one embodiment of the present invention.

Next, the display device 501 will be described in detail with reference to FIG. 33A. FIG. 33A corresponds to a cross-sectional view taken along dashed-dotted line X1-X2 in FIG. 32B.

The display device 501 includes a plurality of pixels arranged in a matrix. Each of the pixels includes a display element and a pixel circuit for driving the display element.

In the following description, an example of using a light-emitting element that emits white light as a display element will be described; however, the display element is not limited to such an element. For example, light-emitting elements that emit light of different colors may be included so that the light of different colors can be emitted from adjacent pixels.

For the substrate 510 and the substrate 570, for example, a flexible material with a vapor permeability of lower than or equal to $1\times10^{-5}$ $g\cdot m^{-2}\cdot day^{-1}$, preferably lower than or equal to $1\times10^{-6}$ $g\cdot m^{-2}\cdot day^{-1}$ can be favorably used. Alternatively, materials whose thermal expansion coefficients are substantially equal to each other are preferably used for the substrate 510 and the substrate 570. For example, the coefficients of linear expansion of the materials are preferably lower than or equal to $1\times10^{-3}$/K, further preferably lower than or equal to $5\times10^{-5}$/K, and still further preferably lower than or equal to $1\times10^{-5}$/K.

Note that the substrate 510 is a stacked body including an insulating layer 510*a* for preventing impurity diffusion into the light-emitting element, a flexible substrate 510*b*, and an adhesive layer 510*c* for attaching the insulating layer 510*a* and the flexible substrate 510*b* to each other. The substrate 570 is a stacked body including an insulating layer 570*a* for preventing impurity diffusion into the light-emitting element, a flexible substrate 570*b*, and an adhesive layer 570*c* for attaching the insulating layer 570*a* and the flexible substrate 570*b* to each other.

For the adhesive layer 510*c* and the adhesive layer 570*c*, for example, materials that include polyester, polyolefin, polyamide (e.g., nylon, aramid), polyimide, polycarbonate, polyurethane, an acrylic resin, an epoxy resin, or a resin having a siloxane bond can be used.

A sealing layer 560 is provided between the substrate 510 and the substrate 570. The sealing layer 560 preferably has a refractive index higher than that of air. In the case where light is extracted to the sealing layer 560 side as illustrated in FIG. 33A, the sealing layer 560 also serves as a layer (hereinafter, also referred to as an optical bonding layer) that optically bonds two components (here, the substrates 510 and 570) between which the sealing layer 560 is sandwiched.

A sealant may be formed in the peripheral portion of the sealing layer 560. With the use of the sealant, a light-emitting element 550R can be provided in a region surrounded by the substrate 510, the substrate 570, the sealing layer 560, and the sealant. Note that an inert gas (such as nitrogen or argon) may be used instead of the sealing layer 560. A drying agent may be provided in the inert gas so as to adsorb moisture or the like. For example, an epoxy-based resin or a glass flit is preferably used as the sealant. As a material used for the sealant, a material which is impermeable to moisture or oxygen is preferably used.

The display device 501 includes a pixel 502R. The pixel 502R includes a light-emitting module 580R.

The pixel 502R includes the light-emitting element 550R and a transistor 502*t* that can supply electric power to the light-emitting element 550R. Note that the transistor 502*t* functions as part of the pixel circuit. The light-emitting module 580R includes the light-emitting element 550R and a coloring layer 567R.

The light-emitting element 550R includes a lower electrode, an upper electrode, and an EL layer between the lower electrode and the upper electrode. As the light-emitting element 550R, any of the light-emitting elements described in any of the above Embodiments can be used, for example.

A microcavity structure may be employed between the lower electrode and the upper electrode so as to increase the intensity of light having a specific wavelength.

In the case where the sealing layer 560 is provided on the light extraction side, the sealing layer 560 is in contact with the light-emitting element 550R and the coloring layer 567R.

The coloring layer 567R is positioned in a region overlapping with the light-emitting element 550R. Accordingly, part of light emitted from the light-emitting element 550R passes through the coloring layer 567R and is emitted to the outside of the light-emitting module 580R as indicated by an arrow in FIG. 33A.

The display device 501 includes a light-blocking layer 567BM on the light extraction side. The light-blocking layer 567BM is provided so as to surround the coloring layer 567R.

The coloring layer 567R is a coloring layer having a function of transmitting light in a particular wavelength region. For example, a color filter for transmitting light in a red wavelength range, a color filter for transmitting light in a green wavelength range, a color filter for transmitting light in a blue wavelength range, a color filter for transmitting light in a yellow wavelength range, or the like can be used. Each color filter can be formed with any of various materials by a printing method, an inkjet method, an etching method using a photolithography technique, or the like.

An insulating layer 521 is provided in the display device 501. The insulating layer 521 covers the transistor 502*t*. With the insulating layer 521, unevenness caused by the pixel circuit is planarized. The insulating layer 521 may have a function of suppressing impurity diffusion. This can prevent the reliability of the transistor 502*t* or the like from being lowered by impurity diffusion.

The light-emitting element 550R is formed over the insulating layer 521. A partition 528 is provided so as to overlap with an end portion of the lower electrode of the light-emitting element 550R. Note that a spacer for controlling the distance between the substrate 510 and the substrate 570 may be formed over the partition 528.

A gate line driver circuit 503*g*(1) includes a transistor 503*t* and a capacitor 503*c*. Note that the driver circuit can be formed in the same process and over the same substrate as those of the pixel circuits.

The wirings 511 through which signals can be supplied are provided over the substrate 510. The terminal 519 is provided over the wirings 511. The FPC 509(1) is electrically connected to the terminal 519. The FPC 509(1) is configured to supply a video signal, a clock signal, a start signal, a reset signal, or the like. Note that the FPC 509(1) may be provided with a printed wiring board (PWB).

Figure 33B:
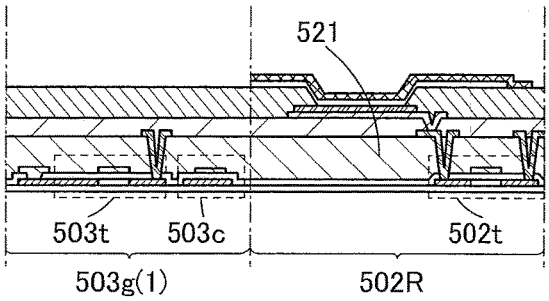

In the display device 501, transistors with any of a variety of structures can be used. FIG. 33A illustrates an example of using bottom-gate transistors; however, the present invention is not limited to this example, and top-gate transistors may be used in the display device 501 as illustrated in FIG. 33B.

The description in the above embodiment can be referred to for the structures of the transistor 502*t* and 503*t*.

<Touch Sensor>

Figure 33C:
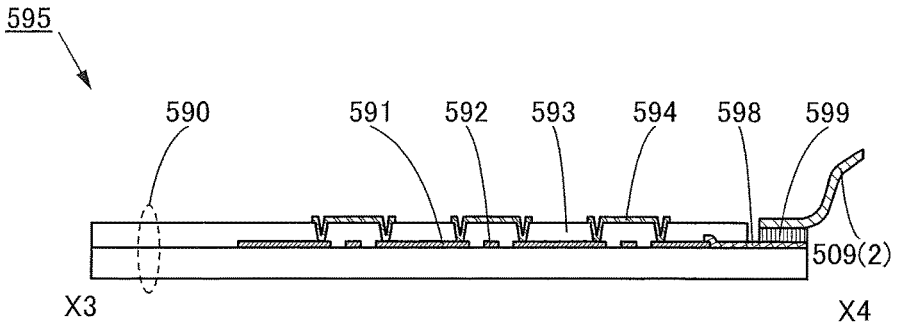

Next, the touch sensor 595 will be described in detail with reference to FIG. 33C. FIG. 33C corresponds to a cross-sectional view taken along dashed-dotted line X3-X4 in FIG. 32B.

The touch sensor 595 includes the electrodes 591 and the electrodes 592 provided in a staggered arrangement on the substrate 590, an insulating layer 593 covering the electrodes 591 and the electrodes 592, and the wiring 594 that electrically connects the adjacent electrodes 591 to each other.

The electrodes 591 and the electrodes 592 are formed using a light-transmitting conductive material. As a light-transmitting conductive material, a conductive oxide such as indium oxide, indium tin oxide, indium zinc oxide, zinc oxide, or zinc oxide to which gallium is added can be used. Note that a film including graphene may be used as well. The film including graphene can be formed, for example, by reducing a film containing graphene oxide. As a reducing method, a method with application of heat or the like can be employed.

The electrodes 591 and the electrodes 592 may be formed by, for example, depositing a light-transmitting conductive material on the substrate 590 by a sputtering method and then removing an unnecessary portion by any of various pattern forming techniques such as photolithography.

Examples of a material for the insulating layer 593 are a resin such as an acrylic resin or an epoxy resin, a resin having a siloxane bond, and an inorganic insulating material such as silicon oxide, silicon oxynitride, or aluminum oxide.

Openings reaching the electrodes 591 are formed in the insulating layer 593, and the wiring 594 electrically connects the adjacent electrodes 591. A light-transmitting conductive material can be favorably used as the wiring 594 because the aperture ratio of the touch panel can be increased. Moreover, a material with higher conductivity than the conductivities of the electrodes 591 and 592 can be favorably used for the wiring 594 because electric resistance can be reduced.

One electrode 592 extends in one direction, and a plurality of electrodes 592 are provided in the form of stripes. The wiring 594 intersects with the electrode 592.

Adjacent electrodes 591 are provided with one electrode 592 provided therebetween. The wiring 594 electrically connects the adjacent electrodes 591.

Note that the plurality of electrodes 591 are not necessarily arranged in the direction orthogonal to one electrode 592 and may be arranged to intersect with one electrode 592 at an angle of more than 0 degrees and less than 90 degrees.

The wiring 598 is electrically connected to any of the electrodes 591 and 592. Part of the wiring 598 functions as a terminal. For the wiring 598, a metal material such as aluminum, gold, platinum, silver, nickel, titanium, tungsten, chromium, molybdenum, iron, cobalt, copper, or palladium or an alloy material containing any of these metal materials can be used.

Note that an insulating layer that covers the insulating layer 593 and the wiring 594 may be provided to protect the touch sensor 595.

A connection layer 599 electrically connects the wiring 598 to the FPC 509(2).

As the connection layer 599, any of anisotropic conductive films (ACF), anisotropic conductive pastes (ACP), and the like can be used.

<Description 2 of Touch Panel>

Figure 34A:
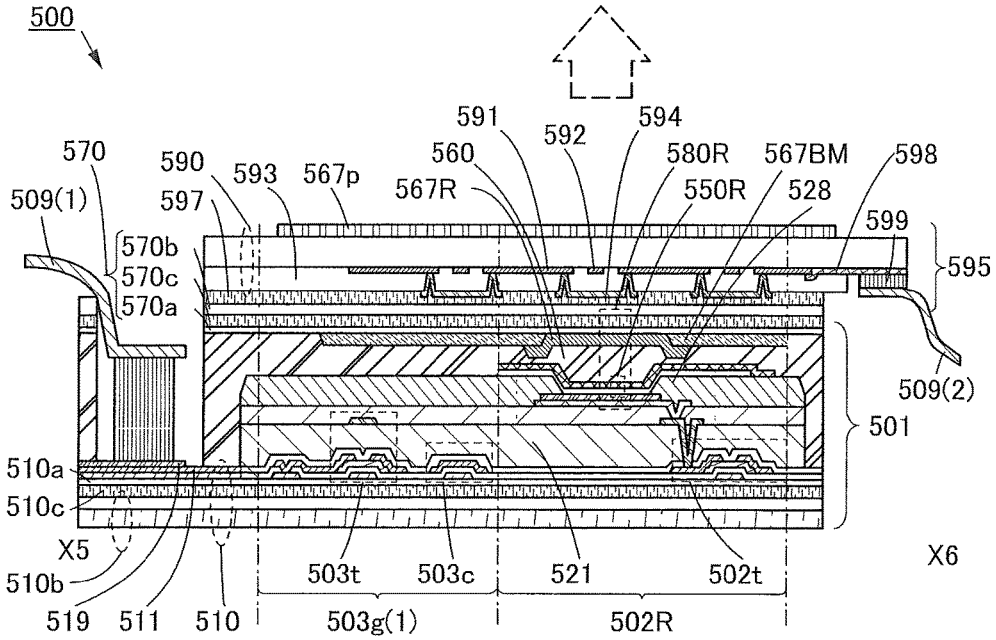
FIGS. 34A and 34B are cross-sectional views illustrating one embodiment of the present invention.

Next, the touch panel 500 will be described in detail with reference to FIG. 34A. FIG. 34A corresponds to a cross-sectional view taken along dashed-dotted line X5-X6 in FIG. 32A.

In the touch panel 500 illustrated in FIG. 34A, the display device 501 described with reference to FIG. 33A and the touch sensor 595 described with reference to FIG. 33C are attached to each other.

The touch panel 500 illustrated in FIG. 34A includes an adhesive layer 597 and an anti-reflective layer 567*p* in addition to the components described with reference to FIGS. 33A and 33C.

The adhesive layer 597 is provided in contact with the wiring 594. Note that the adhesive layer 597 attaches the substrate 590 to the substrate 570 so that the touch sensor 595 overlaps with the display device 501. The adhesive layer 597 preferably has a light-transmitting property. A heat curable resin or an ultraviolet curable resin can be used for the adhesive layer 597. For example, an acrylic resin, an urethane-based resin, an epoxy-based resin, or a siloxane-based resin can be used.

The anti-reflective layer 567*p* is positioned in a region overlapping with pixels. As the anti-reflective layer 567*p*, a circularly polarizing plate can be used, for example.

Next, a touch panel having a structure different from that illustrated in FIG. 34A will be described with reference to FIG. 34B.

Figure 34B:
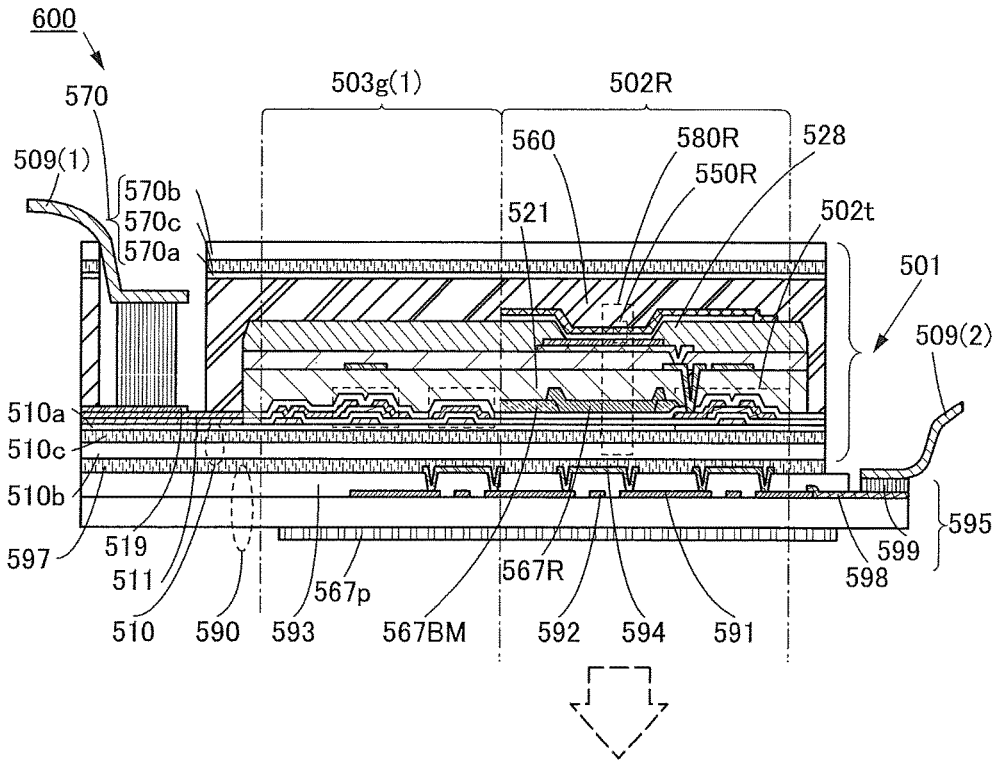

FIG. 34B is a cross-sectional view of a touch panel 600. The touch panel 600 illustrated in FIG. 34B differs from the touch panel 500 illustrated in FIG. 34A in the position of the touch sensor 595 relative to the display device 501. Different parts are described in detail below, and the above description of the touch panel 500 is referred to for the other similar parts.

The coloring layer 567R is positioned in a region overlapping with the light-emitting element 550R. The light-emitting element 550R illustrated in FIG. 34B emits light to the side where the transistor 502*t* is provided. Accordingly, part of light emitted from the light-emitting element 550R passes through the coloring layer 567R and is emitted to the outside of the light-emitting module 580R as indicated by an arrow in FIG. 34B.

The touch sensor 595 is provided on the substrate 510 side of the display device 501.

The adhesive layer 597 is provided between the substrate 510 and the substrate 590 and attaches the touch sensor 595 to the display device 501.

As illustrated in FIG. 34A or 34B, light may be emitted from the light-emitting element to one of upper and lower sides, or both, of the substrate.

The display device and the electronic device described in this embodiment has any structure described in the above embodiments, so that external correction can be performed in parallel with display operation. Thus, the display device and the electronic device with small variation in luminance and small display unevenness can be obtained. Alternatively, the display device and the electronic device which are capable of high definition display can be obtained.

The structure described in this embodiment can be used in appropriate combination with the structure described in any of the other embodiments.

Embodiment 7

In this embodiment, a display module and an electronic device that can be formed using the display device described in the above embodiment are described.

<External View of Display Device>

Figure 35:
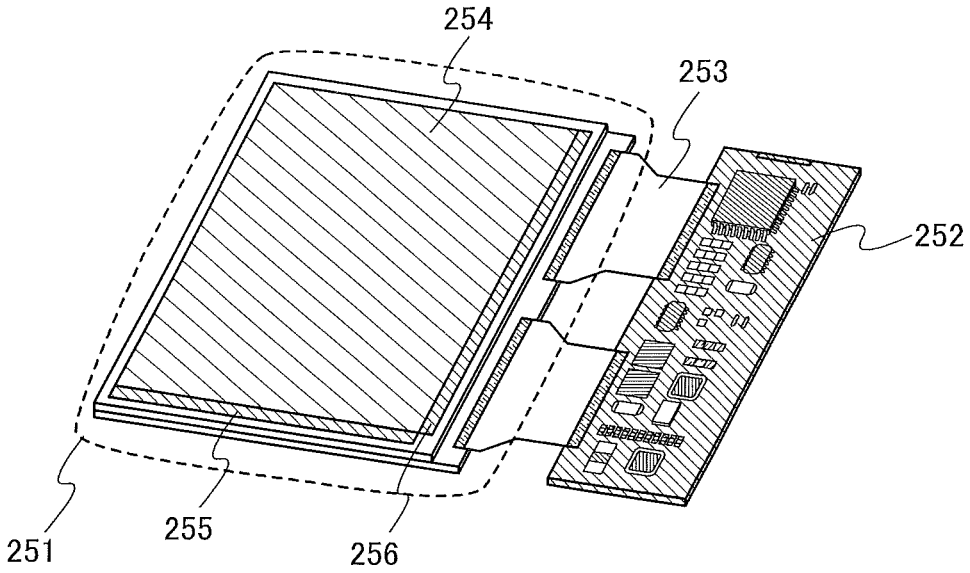
FIG. 35 is a perspective view illustrating one embodiment of the present invention.

FIG. 35 is a perspective view illustrating an example of an external view of a display device. The display device in FIG. 35 includes a panel 251; a circuit board 252 including a controller, a power supply circuit, an image processing circuit, an image memory, a CPU, and the like; and a connection portion 253. The panel 251 includes a pixel portion 254 including a plurality of pixels, a driver circuit 255 that selects pixels row by row, and a driver circuit 256 that controls input of a video signal to the pixels in a selected row.

A variety of signals and power supply potentials are input from the circuit board 252 to the panel 251 through the connection portion 253. As the connecting portion 253, a flexible printed circuit (FPC) or the like can be used. In the case where a COF tape is used as the connection portion 253, part of circuits in the circuit board 252 or part of the driver circuit 255 or the driver circuit 256 included in the panel 251 may be formed on a chip separately prepared, and the chip may be electrically connected to the COF tape by a chip-on-film (COF) method.

<Structural Example of Electronic Device>

The display device described in any of the above embodiments can be used for display devices, laptops, or image reproducing devices provided with recording media (typically devices which reproduce the content of recording media such as DVDs (digital versatile disc) and have displays for displaying the reproduced images). In addition to the above examples, as an electronic device which include the display device according to one embodiment of the present invention, mobile phones, portable game machines, portable information terminals, e-book readers, cameras such as video cameras and digital still cameras, goggle-type displays (head mounted displays), navigation systems, audio reproducing devices (e.g., car audio components and digital audio players), copiers, facsimiles, printers, multifunction printers, automated teller machines (ATM), vending machines, and the like can be given. Specific examples of such an electronic device are illustrated in FIGS. 36A to 36F.

Figure 36A:
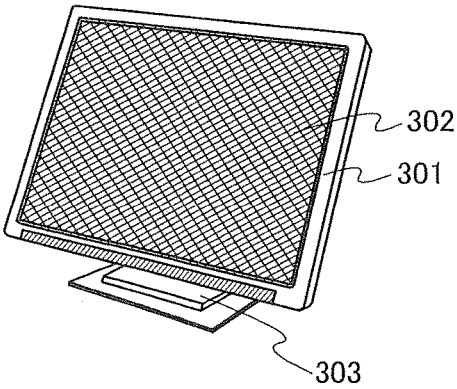
FIGS. 36A to 36F are electronic devices each illustrating one embodiment of the present invention.

FIG. 36A illustrates a display device including a housing 301, a display portion 302, a supporting base 303, and the like. The display device described in any of the above embodiments can be used in the display portion 302. Note that a display device includes all display devices for displaying information, such as display devices for personal computers, for receiving television broadcast, and for displaying advertisement, in its category.

Figure 36B:
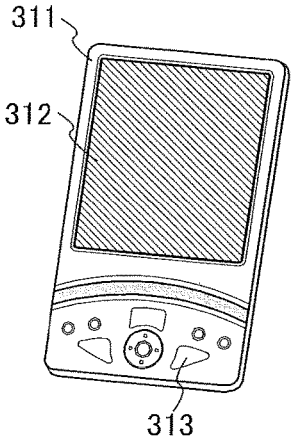

FIG. 36B illustrates a portable information terminal including a housing 311, a display portion 312, an operation key 313, and the like. The display device described in any of the above embodiments can be used in the display portion 312.

Figure 36C:
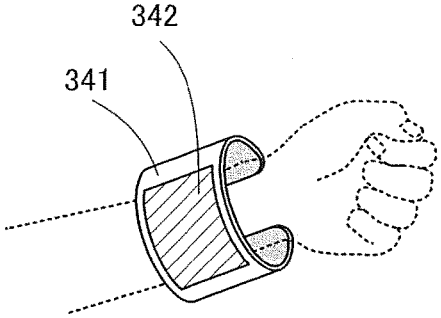

FIG. 36C illustrates a display device, which includes a housing 341 having a curved surface, a display portion 342, and the like. When a flexible substrate is used for the display device described in any of the above embodiments, it is possible to use the display device as the display portion 342 supported by the housing 341 having a curved surface. Consequently, it is possible to provide a user-friendly display device that is flexible and lightweight.

Figure 36D:
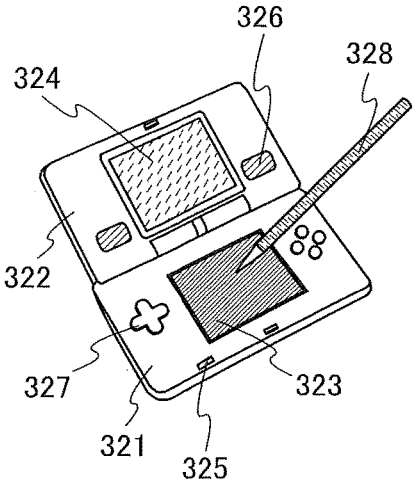

FIG. 36D illustrates a portable game machine including a housing 321, a housing 322, a display portion 323, a display portion 324, a microphone 325, speakers 326, an operation key 327, a stylus 328, and the like. The display device described in any of the above embodiments can be used in the display portion 323 or the display portion 324. When the display device described in any of the above embodiments is used as the display portion 323 or 324, it is possible to provide a user-friendly portable game machine with quality that hardly deteriorates. Note that although the portable game machine illustrated in FIG. 36D includes the two display portions 323 and 324, the number of display portions included in the portable game machine is not limited to two.

Figure 36E:
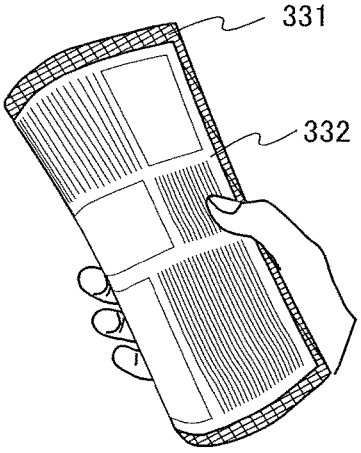

FIG. 36E illustrates an e-book reader, which includes a housing 331, a display portion 332, and the like. The display device described in any of the above embodiments can be used in the display portion 332. When a flexible substrate is used, the display device can have flexibility, so that it is possible to provide a user-friendly e-book reader which is flexible and lightweight.

Figure 36F:
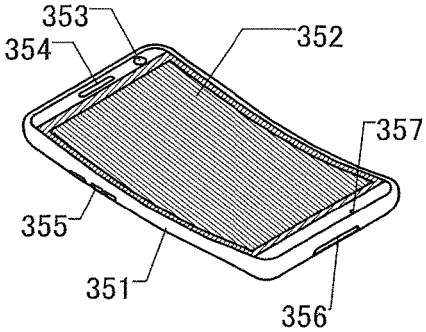

FIG. 36F illustrates a mobile phone which includes a display portion 352, a microphone 357, a speaker 354, a camera 353, an external connection port 356, and an operation button 355 in a housing 351. The display device described in any of the above-described embodiments can be used in the display portion 352. When the display device described in any of the above embodiments is provided over a flexible substrate, the display device can be used as the display portion 352 having a curved surface as illustrated in FIG. 36F.

With the use of the display device described in any of the above embodiments for the electronic device of this embodiment, external correction can be performed in parallel with display operation. Thus, an electronic device with small variation in luminance and small display unevenness can be obtained. Alternatively, the electronic device capable of high definition display can be obtained.

The structure described above in this embodiment can be combined as appropriate with any of the structures described in the other embodiments.

(Supplementary Notes on the Description in this Specification and the Like)

The following are notes on the description of the above embodiments and structures in the embodiments.

<Notes on One Embodiment of the Present Invention Described in Embodiments>

One embodiment of the present invention can be constituted by appropriately combining the structure described in an embodiment with any of the structures described the other embodiments. In addition, in the case where a plurality of structure examples are described in one embodiment, some of the structure examples can be combined as appropriate.

Note that a content (or may be part of the content) described in one embodiment may be applied to, combined with, or replaced by a different content (or may be part of the different content) described in the embodiment and/or a content (or may be part of the content) described in one or a plurality of different embodiments.

Note that in each embodiment, a content described in the embodiment is a content described with reference to a variety of diagrams or a content described with a text described in this specification.

Note that by combining a diagram (or may be part of the diagram) illustrated in one embodiment with another part of the diagram, a different diagram (or may be part of the different diagram) illustrated in the embodiment, and/or a diagram (or may be part of the diagram) illustrated in one or a plurality of different embodiments, much more diagrams can be formed.

In each Embodiment, one embodiment of the present invention has been described; however, one embodiment of the present invention is not limited to the described embodiments. For example, a structure in which a light-emitting element is used as an example of a display element is described in the above embodiment; however, one embodiment of the invention is not limited to that structure. Another display element, e.g., a liquid crystal element, may be used depending on conditions. A structure in which data on the threshold voltage is read out in the blanking period is described in the above embodiments; however, one embodiment of the present invention is not limited thereto. Data on transistors may be read out in a period other than the blanking period depending on conditions. Furthermore, a structure in which data on current characteristics of driving transistors in pixels is read out is described in the above embodiments; however, one embodiment of the present invention is not limited thereto. Depending on conditions, data on current characteristics of transistors other than the driving transistor may be read out, for example. Alternatively, depending on circumstances or conditions, data on current characteristics of the transistors is not necessarily read out. Alternatively, depending on circumstances or conditions, external correction is not necessarily performed.

<Notes on the Description for Drawings>

In this specification and the like, terms for explaining arrangement, such as "over" and "under", are used for convenience to describe the positional relation between components with reference to drawings. Furthermore, the positional relation between components is changed as appropriate in accordance with a direction in which the components are described. Therefore, the terms for explaining arrangement are not limited to those used in this specification and may be changed to other terms as appropriate depending on the situation.

The term "over" or "below" does not necessarily mean that a component is placed directly on or directly below and directly in contact with another component. For example, the expression "electrode B over insulating layer A" does not necessarily mean that the electrode B is on and in direct contact with the insulating layer A and can mean the case where another component is provided between the insulating layer A and the electrode B.

Furthermore, in a block diagram in this specification and the like, components are functionally classified and shown by blocks that are independent from each other. However, in an actual circuit and the like, such components are sometimes hard to classify functionally, and there is a case in which one circuit is concerned with a plurality of functions or a case in which a plurality of circuits are concerned with one function. Therefore, blocks in a block diagram do not necessarily show components described in the specification, which can be explained with another term as appropriate depending on the situation.

In drawings, the size, the layer thickness, or the region is determined arbitrarily for description convenience. Therefore, the size, the layer thickness, or the region is not limited to the illustrated scale. Note that the drawings are schematically shown for clarity, and embodiments of the present invention are not limited to shapes or values shown in the drawings. For example, the following can be included: variation in signal, voltage, or current due to noise or difference in timing.

In drawings such as plan views (also referred to as layout views) and perspective views, some of components might not be illustrated for clarity of the drawings.

<Notes on Expressions that can be Rephrased>

In this specification or the like, in describing connections of a transistor, one of a source and a drain is referred to as "one of a source and a drain" (or a first electrode or a first terminal), and the other of the source and the drain is referred to as "the other of the source and the drain" (or a second electrode or a second terminal). This is because a source and a drain of a transistor are interchangeable depending on the structure, operation conditions, or the like of the transistor. Note that the source or the drain of the transistor can also be referred to as a source (or drain) terminal, a source (or drain) electrode, or the like as appropriate depending on the situation.

In addition, in this specification and the like, the term such as an "electrode" or a "wiring" does not limit a function of the component. For example, an "electrode" is used as part of a "wiring" in some cases, and vice versa. Further, the term "electrode" or "wiring" can also mean a combination of a plurality of "electrodes" and "wirings" formed in an integrated manner.

In this specification and the like, "voltage" and "potential" can be replaced with each other. The term "voltage" refers to a potential difference from a reference potential. When the reference potential is a ground potential, for example, "voltage" can be replaced with "potential." The ground potential does not necessarily mean 0 V. Potentials are relative values, and the potential applied to a wiring or the like is changed depending on the reference potential, in some cases.

In this specification and the like, the terms "film" and "layer" can be interchanged with each other depending on the case or circumstances. For example, the term "conductive layer" can be changed into the term "conductive film" in some cases. Also, the term "insulating film" can be changed into the term "insulating layer" in some cases.

<Notes on Definitions of Terms>

The following are definitions of the terms mentioned in the above embodiments.

<<Switch>>

In this specification and the like, a switch is conducting (on state) or not conducting (off state) to determine whether current flows therethrough or not. Alternatively, a switch is configured to select and change a current path.

Examples of a switch are an electrical switch, a mechanical switch, and the like. That is, any element can be used as a switch as long as it can control current, without limitation to a certain element.

Examples of the electrical switch are a transistor (e.g., a bipolar transistor or a MOS transistor), a diode (e.g., a PN diode, a PIN diode, a Schottky diode, a metal-insulator-metal (MIM) diode, a metal-insulator-semiconductor (MIS) diode, or a diode-connected transistor), and a logic circuit in which such elements are combined.

In the case of using a transistor as a switch, an "on state" of the transistor refers to a state in which a source and a drain of the transistor are electrically short-circuited. Furthermore, an "off state" of the transistor refers to a state in which the source and the drain of the transistor are electrically disconnected. In the case where a transistor operates just as a switch, the polarity (conductivity type) of the transistor is not particularly limited to a certain type.

An example of a mechanical switch is a switch formed using a micro electro mechanical system (MEMS) technology, such as a digital micromirror device (DMD). Such a switch includes an electrode which can be moved mechanically, and operates by controlling conduction and non-conduction in accordance with movement of the electrode.

<<Channel Length>>

In this specification and the like, the channel length refers to, for example, a distance between a source and a drain in a region where a semiconductor (or a portion where current flows in a semiconductor when a transistor is on) and a gate overlap with each other or a region where a channel is formed in a plan view of the transistor.

In one transistor, channel lengths in all regions are not necessarily the same. In other words, the channel length of one transistor is not fixed to one value in some cases. Therefore, in this specification, the channel length is any one of values, the maximum value, the minimum value, or the average value in a region where a channel is formed.

<<Channel Width>>

In this specification and the like, the channel width refers to, for example, the length of a portion where a source and a drain face each other in a region where a semiconductor (or a portion where current flows in a semiconductor when a transistor is on) and a gate electrode overlap with each other, or a region where a channel is formed in a plan view of the transistor.

In one transistor, channel widths in all regions are not necessarily the same. In other words, the channel width of one transistor is not fixed to one value in some cases. Therefore, in this specification, the channel width is any one of values, the maximum value, the minimum value, or the average value in a region where a channel is formed.

<<Pixel>>

In this specification and the like, one pixel refers to one element whose brightness can be controlled, for example. Therefore, for example, one pixel expresses one color element by which brightness is expressed. Accordingly, in the case of a color display device formed of color elements of R (red), G (green), and B (blue), the smallest unit of an image is formed of three pixels of an R pixel, a G pixel, and a B pixel.

Note that the number of color elements is not limited to three, and more color elements may be used. For example, RGBW (W: white), RGB added with yellow, cyan, or magenta, and the like may be employed.

<<Connection>>

In this specification and the like, when it is described that "A and B are connected to each other", the case where A and B are electrically connected to each other is included in addition to the case where A and B are directly connected to each other. Here, the expression "A and B are electrically connected" means the case where electric signals can be transmitted and received between A and B when an object having any electric action exists between A and B.

Note that, for example, the case where a source (or a first terminal or the like) of a transistor is electrically connected to X through (or not through) Z1 and a drain (or a second terminal or the like) of the transistor is electrically connected to Y through (or not through) Z2, or the case where a source (or a first terminal or the like) of a transistor is directly connected to one part of Z1 and another part of Z1 is directly connected to X while a drain (or a second terminal or the like) of the transistor is directly connected to one part of Z2 and another part of Z2 is directly connected to Y, can be expressed by using any of the following expressions.

Examples of the expressions include, "X, Y, a source (or a first terminal or the like) of a transistor, and a drain (or a second terminal or the like) of the transistor are electrically connected to each other, and X, the source (or the first terminal or the like) of the transistor, the drain (or the second terminal or the like) of the transistor, and Y are electrically connected to each other in this order", "a source (or a first terminal or the like) of a transistor is electrically connected to X, a drain (or a second terminal or the like) of the transistor is electrically connected to Y, and X, the source (or the first terminal or the like) of the transistor, the drain (or the second terminal or the like) of the transistor, and Y are electrically connected to each other in this order", and "X is electrically connected to Y through a source (or a first terminal or the like) and a drain (or a second terminal or the like) of a transistor, and X, the source (or the first terminal or the like) of the transistor, the drain (or the second terminal or the like) of the transistor, and Y are provided to be connected in this order". When the connection order in a circuit configuration is defined by an expression similar to the above examples, a source (or a first terminal or the like) and a drain (or a second terminal or the like) of a transistor can be distinguished from each other to specify the technical scope.

Other examples of the expressions include, "a source (or a first terminal or the like) of a transistor is electrically connected to X through at least a first connection path, the first connection path does not include a second connection path, the second connection path is a path between the source (or the first terminal or the like) of the transistor and a drain (or a second terminal or the like) of the transistor, Z1 is on the first connection path, the drain (or the second terminal or the like) of the transistor is electrically connected to Y through at least a third connection path, the third connection path does not include the second connection path, and Z2 is on the third connection path" and "a source (or a first terminal or the like) of a transistor is electrically connected to X at least with a first connection path through Z1, the first connection path does not include a second connection path, the second connection path includes a connection path through which the transistor is provided, a drain (or a second terminal or the like) of the transistor is electrically connected to Y at least with a third connection path through Z2, and the third connection path does not include the second connection path." Still another example of the expression is "a source (or a first terminal or the like) of a transistor is electrically connected to X through at least Z1 on a first electrical path, the first electrical path does not include a second electrical path, the second electrical path is an electrical path from the source (or the first terminal or the like) of the transistor to a drain (or a second terminal or the like) of the transistor, the drain (or the second terminal or the like) of the transistor is electrically connected to Y through at least 22 on a third electrical path, the third electrical path does not include a fourth electrical path, and the fourth electrical path is an electrical path from the drain (or the second terminal or the like) of the transistor to the source (or the first terminal or the like) of the transistor". When the connection path in a circuit configuration is defined by an expression similar to the above examples, a source (or a first terminal or the like) and a drain (or a second terminal or the like) of a transistor can be distinguished from each other to specify the technical scope.

Note that these expressions are examples and there is no limitation on the expressions. Here, X, Y, Z1, and Z2 each denote an object (e.g., a device, an element, a circuit, a wiring, an electrode, a terminal, a conductive film, and a layer).

This application is based on Japanese Patent Application serial no. 2014-196518 filed with Japan Patent Office on Sep. 26, 2014, the entire contents of which are hereby incorporated by reference.

What is claimed is:

1. A display device comprising:
a plurality of first wirings;
a plurality of second wirings;
a plurality of third wirings;
a plurality of fourth wirings;
a plurality of fifth wirings;
a plurality of pixels arranged in a matrix; and
a plurality of reading circuits,
wherein each of the plurality of pixels includes a light-emitting element, a first transistor, a second transistor, and a third transistor,
wherein each of the plurality of first wirings extends in a row direction,
wherein each of the plurality of second wirings extends in a column direction,
wherein each of the plurality of fourth wirings extends in the row direction,
wherein each of the plurality of fifth wirings extends in the column direction,
wherein a gate of the first transistor is electrically connected to one of the plurality of first wirings,
wherein one of a source and a drain of the first transistor is electrically connected to one of the plurality of second wirings,
wherein the other of the source and the drain of the first transistor is electrically connected to a gate of the second transistor,
wherein one of a source and a drain of the second transistor is electrically connected to one of the plurality of third wirings,
wherein the other of the source and the drain of the second transistor is electrically connected to one of a source and a drain of the third transistor,
wherein a gate of the third transistor is electrically connected to one of the plurality of fourth wirings,
wherein the other of the source and the drain of the third transistor is electrically connected to one of the plurality of fifth wirings,
wherein the light-emitting element is electrically connected to the other of the source and the drain of the second transistor,
wherein one of the plurality of reading circuits is electrically connected to one of the plurality of fifth wirings,
wherein in a blanking period of the display device:
in each of the plurality of pixels in a row in which all pixels are displayed in black, the first transistor is turned on by one of the plurality of first wirings and the third transistor is turned on by one of the plurality of fourth wirings;
the second transistor is turned on by one of the plurality of second wirings;
data on current characteristics of the second transistor is read out by the plurality of reading circuits; and
the plurality of pixels in the row are displayed in black via one of the plurality of second wirings, and
wherein a signal for correcting variation in the current characteristics in accordance with the data on the current characteristics is input to the pixels.

2. The display device according to claim 1,
wherein the second transistor is p-channel transistor.

3. The display device according to claim 1,
wherein in a period where the data on the current characteristics of the second transistor is read out by the plurality of reading circuits, forward bias is not applied to the light-emitting elements in the row in which all pixels are displayed in black.

4. The display device according to claim 1,
wherein a capacitor is provided between the gate of the second transistor and the other of the source and the drain of the second transistor.

5. The display device according to claim 1,
wherein a current value of the second transistor is read out as the data on the current characteristics of the second transistor.

6. The display device according to claim 2,
wherein in a period where the data on the current characteristics of the second transistor is read out by the plurality of reading circuits, forward bias is not applied to the light-emitting elements in the row in which all pixels are displayed in black.

7. The display device according to claim 2,
wherein a capacitor is provided between the gate of the second transistor and the other of the source and the drain of the second transistor.

8. The display device according to claim 2,
wherein a current value of the second transistor is read out as the data on the current characteristics of the second transistor.

9. A display device comprising:
a plurality of first wirings;
a plurality of second wirings;
a plurality of third wirings;
a plurality of fourth wirings;
a plurality of fifth wirings;
a plurality of pixels arranged in a matrix; and
a plurality of reading circuits,
wherein each of the plurality of pixels includes a light-emitting element, a first transistor, a second transistor, and a third transistor,
wherein each of the plurality of first wirings extends in a row direction,
wherein each of the plurality of second wirings extends in a column direction,
wherein each of the plurality of fourth wirings extends in the row direction,
wherein a gate of the first transistor is electrically connected to one of the plurality of first wirings,
wherein one of a source and a drain of the first transistor is electrically connected to one of the plurality of second wirings,
wherein the other of the source and the drain of the first transistor is electrically connected to the light-emitting element,
wherein one of a source and a drain of the second transistor is electrically connected to one of the plurality of third wirings,
wherein the other of the source and the drain of the second transistor is electrically connected to one of a source and a drain of the third transistor,
wherein a gate of the third transistor is electrically connected to one of the plurality of fourth wirings,
wherein the other of the source and the drain of the third transistor is electrically connected to one of the plurality of fifth wirings,
wherein one of the plurality of reading circuits is electrically connected to one of the plurality of second wirings,
wherein in a blanking period of the display device:
in each of the plurality of pixels in a row in which all pixels are displayed in black, the first transistor is turned on by one of the plurality of first wirings and the third transistor is turned on by one of the plurality of fourth wirings;
the second transistor is turned on by one of the plurality of second wirings;
data on current characteristics of the second transistor is read out by the plurality of reading circuits; and
the plurality of pixels in the row are displayed in black via one of the plurality of second wirings, and
wherein a signal for correcting variation in the current characteristics in accordance with the data on the current characteristics is input to the pixels.

10. The display device according to claim 9,
wherein in a period where the data on the current characteristics of the second transistor is read out by the plurality of reading circuits, forward bias is not applied to the light-emitting elements in the row in which all pixels are displayed in black.

11. The display device according to claim 9,
wherein a capacitor is provided between the gate of the second transistor and the other of the source and the drain of the second transistor.

12. The display device according to claim 9,
wherein a current value of the second transistor is read out as the data on the current characteristics of the second transistor.

13. A driving method of a display device, the display device comprising a plurality of pixels arranged in a matrix and a plurality of reading circuits provided outside the plurality of pixels, and each of the plurality of pixels comprising a light-emitting element and a transistor which supplies current to the light-emitting element, the method comprising the steps of:
in a blanking period of the display device,
selecting a row in which all pixels are displayed in black and inputting a reading signal to the row;
reading data on current characteristics of the transistor included in each of the pixels in the selected row, and at the same time, performing display in pixels in rows other than the selected row;
inputting a signal for black display in the selected row so that the plurality of pixels in the selected row are displayed in black, and
producing a signal for correcting variation in the current characteristics in accordance with the data on the current characteristics.

14. The driving method of the display device according to claim 13,
wherein forward bias is not applied to the light-emitting element in the selected row while the data on the current characteristics of the transistors included in the plurality of pixels in the selected row is read out by the reading circuits.

15. The driving method of the display device according to claim 13,
wherein a current value of the transistor is read out as the data on the current characteristics of the transistor.

16. The driving method of the display device according to claim 14, wherein the current value of the transistor is read out as the data on the current characteristics of the transistor.

* * * * *